US007806282B1

(12) United States Patent
LaBonia, Jr. et al.

(10) Patent No.: US 7,806,282 B1
(45) Date of Patent: Oct. 5, 2010

(54) STORAGE UNIT WITH SHELVES HAVING INCLINED FRONT END PORTIONS TO FACILITATE SCOOPING PARTS AND COMPONENTS

(75) Inventors: Vincent LaBonia, Jr., Wallingford, CT (US); John Szalan, Shelton, CT (US); Brian Moulder, Orange, CT (US); Peter Corrado, East Haven, CT (US)

(73) Assignee: Platt and LaBonia Co., North Haven, CT (US)

( * ) Notice: Subject to any disclaimer, the term of this patent is extended or adjusted under 35 U.S.C. 154(b) by 61 days.

(21) Appl. No.: 11/553,046

(22) Filed: Oct. 26, 2006

Related U.S. Application Data

(63) Continuation of application No. 10/676,521, filed on Oct. 1, 2003, now Pat. No. 7,128,379.

(60) Provisional application No. 60/479,343, filed on Jun. 18, 2003, provisional application No. 60/450,125, filed on Feb. 26, 2003.

(51) Int. Cl.
*A47F 5/00* (2006.01)

(52) U.S. Cl. ..... 211/135

(58) Field of Classification Search ..... 211/135, 211/134, 184, 88.01; D6/511; 108/61, 60; 220/532; 206/529, 534, 561
See application file for complete search history.

(56) References Cited

U.S. PATENT DOCUMENTS

| | | | | | |
|---|---|---|---|---|---|
| 2,915,193 | A * | 12/1959 | Bromberg | 108/61 |
| 3,200,983 | A * | 8/1965 | Walter | 220/533 |
| 3,207,321 | A * | 9/1965 | Joyce | 211/126.5 |
| 3,581,906 | A * | 6/1971 | Joyce | 211/126.5 |
| 3,746,213 | A * | 7/1973 | Morrison | 221/303 |
| D243,647 | S * | 3/1977 | Schoenfeld | D6/467 |
| 4,476,985 | A * | 10/1984 | Norberg et al. | 211/133.6 |
| 4,577,773 | A * | 3/1986 | Bitel | 220/533 |
| 4,768,659 | A * | 9/1988 | Merl | 211/59.2 |
| 5,464,103 | A * | 11/1995 | O'Brien | 211/133.3 |
| 5,482,342 | A * | 1/1996 | Kowalski et al. | 294/160 |
| 5,553,710 | A * | 9/1996 | Takama | 206/561 |
| 6,047,647 | A * | 4/2000 | Laraia, Jr. | 108/61 |
| D431,403 | S | 10/2000 | Ford | |
| 6,332,547 | B1 * | 12/2001 | Shaw et al. | 211/59.2 |
| D510,220 | S | 10/2005 | Sandy | |
| D521,286 | S | 5/2006 | Colmenares | |
| D525,059 | S | 7/2006 | Golias et al. | |
| D541,563 | S * | 5/2007 | LaBonia et al. | D6/511 |
| 2006/0226104 | A1 * | 10/2006 | Schmidt | 211/184 |

* cited by examiner

*Primary Examiner*—Sarah Purol
(74) *Attorney, Agent, or Firm*—Raymond Nuzzo

(57) ABSTRACT

A storage unit having a back panel, a top panel attached to the back panel, a bottom panel attached to the back panel, a pair of opposing side panels attached to the back, top and bottom panels so as to define a housing having an interior, and a plurality of shelf members positioned within the interior of the housing and arranged in a vertically oriented fashion. The shelf members are removably mounted to the back panel and opposing side panels. The storage unit further comprises a plurality of divider members removably positioned between (i) each pair of consecutive shelf members, (ii) the top panel and an uppermost shelf member and (iii) the bottom panel and a lowermost shelf member. The divider members define a plurality of compartments. In one embodiment, the compartments function as drawer-receiving spaces wherein each drawer-receiving space is sized for receiving a corresponding drawer. Each divider member can be repositioned to provide compartments of varying sizes.

7 Claims, 55 Drawing Sheets

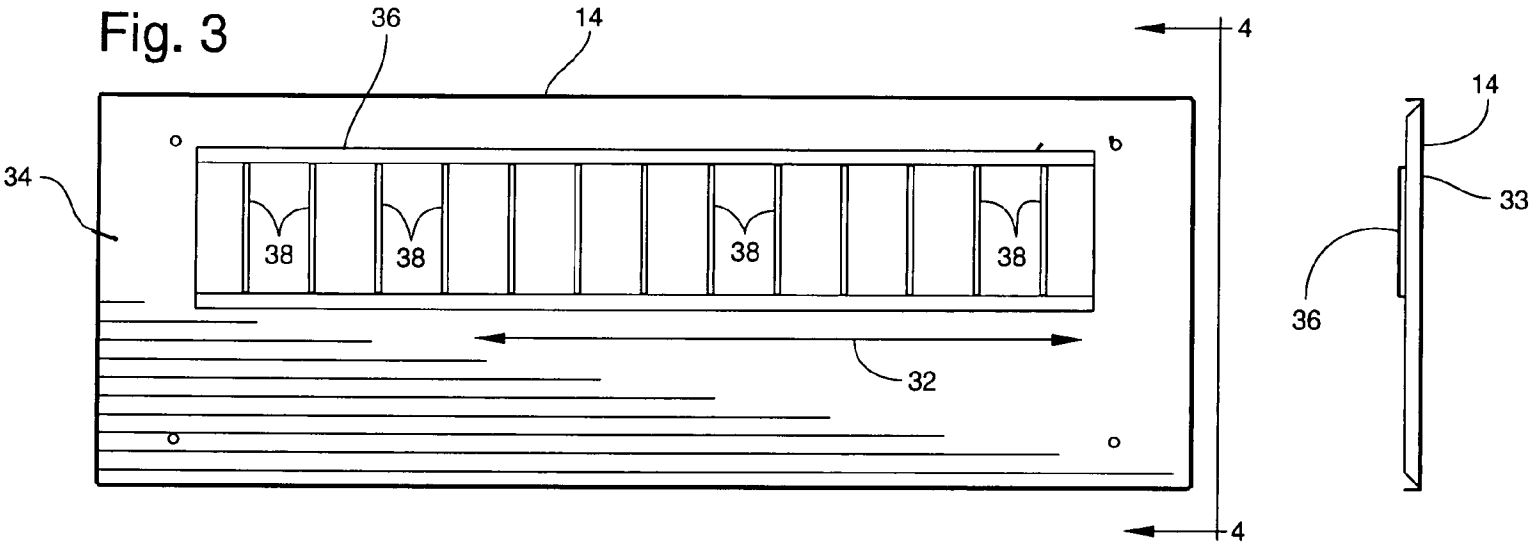
Fig. 3
Fig. 4
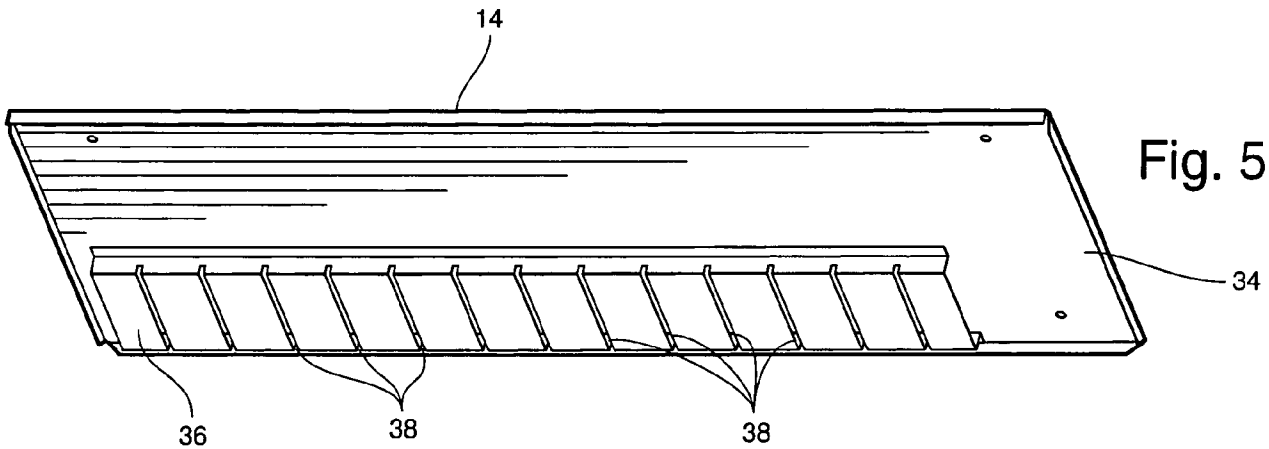
Fig. 5

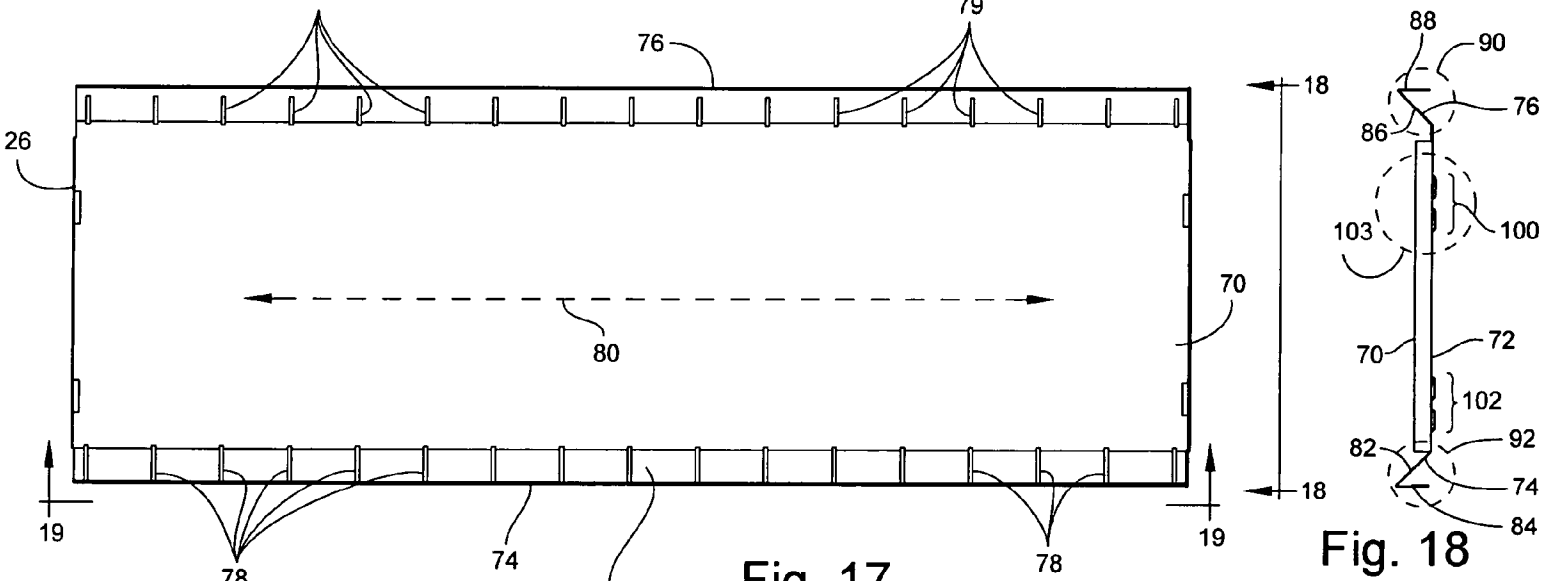
Fig. 17
Fig. 18
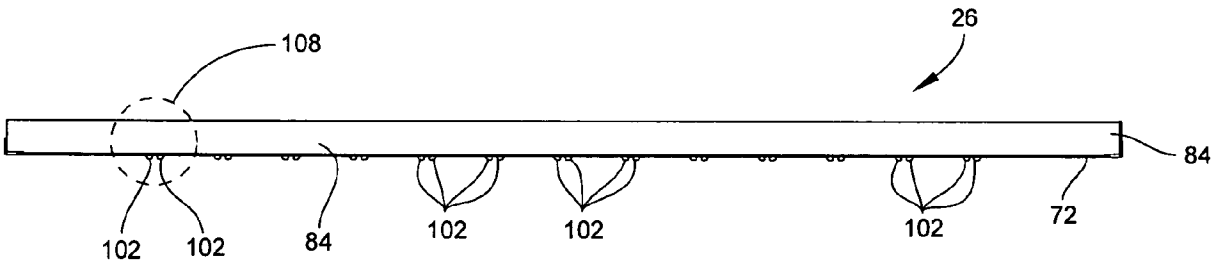
Fig. 19

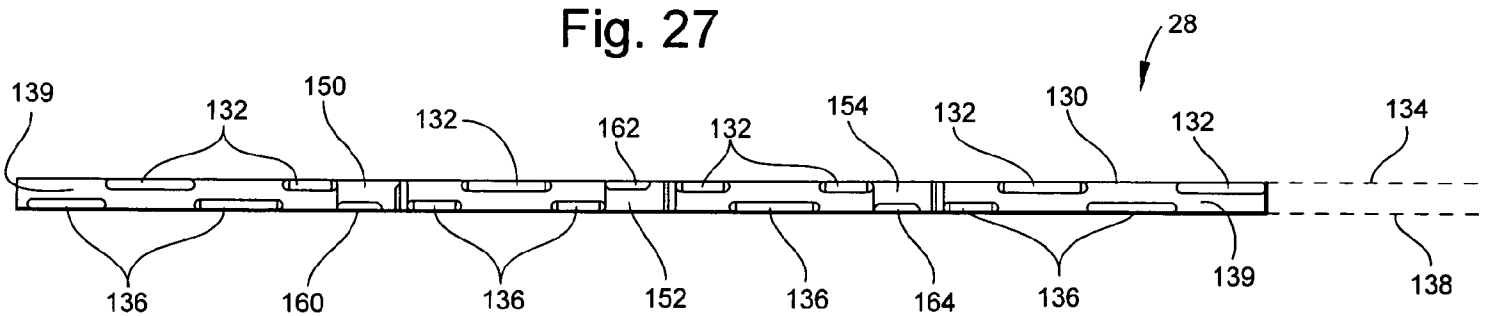
Fig. 27
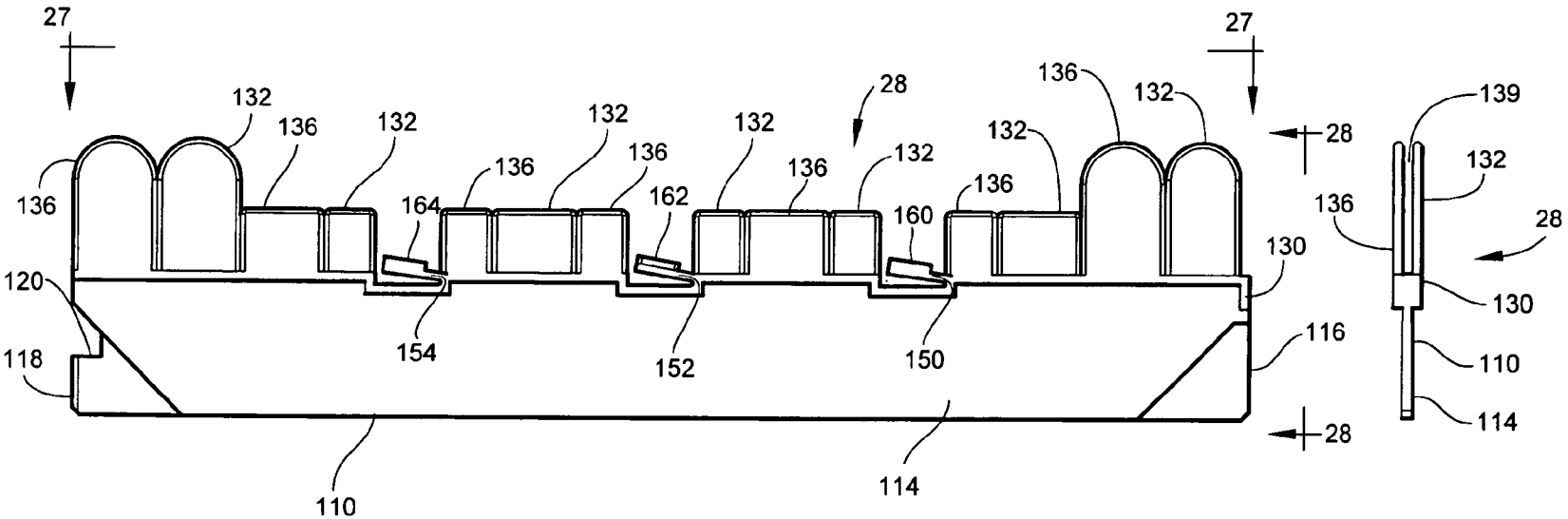
Fig. 28
Fig. 26

STORAGE UNIT WITH SHELVES HAVING INCLINED FRONT END PORTIONS TO FACILITATE SCOOPING PARTS AND COMPONENTS

CROSS-REFERENCE TO RELATED APPLICATIONS

This application is a continuation of prior U.S. application Ser. No. 10/676,521, filed Oct. 1, 2003 now U.S. Pat. No. 7,128,379, which claims the benefit of U.S. Provisional Application No. 60/479,343, filed Jun. 18, 2003, and U.S. Provisional Application No. 60/450,125, filed Feb. 26, 2003. The aforesaid application Ser. Nos. 10/676,521, 60/479,343 and 60/450,125 are hereby incorporated by reference.

BACKGROUND OF THE INVENTION

1. Field of the Invention

The present invention relates to a multi-drawer storage unit.

2. Description of Related Art

Multi-drawer storage units are known in art. Multi-drawer storage units are used in industry for storing a variety of components such as screws, nuts, washers, electrical components, etc. Such storage units are also used in retail establishments such as hardware stores. Examples of such storage units are described in U.S. Pat. Nos. 3,866,993, 3,954,315, 4,440,461, 4,838,627, 5,632,542, 5,664,856, 5,823,650 and 6,076,908. Such storage units are typically fabricated from metal and generally comprise a metal box-like housing and a plurality of drawers or trays that are slidably disposed within the housing.

SUMMARY OF THE INVENTION

The present invention is directed to a storage unit. In one embodiment, the storage unit comprises a back panel, a top panel attached to the back panel, a bottom panel attached to the back panel, a pair of opposing side panels attached to the back, top and bottom panels so as to define a housing having an interior, and a plurality of shelf members positioned within the interior of the housing and arranged in a vertically oriented fashion. The shelf members are removably mounted to the back panel and opposing side panels. In one embodiment, the storage unit further comprises a plurality of divider members removably positioned between (i) each pair of consecutive shelf members, (ii) the top panel and an uppermost shelf member and (iii) the bottom panel and a lowermost shelf member. The divider members form a plurality of separate open compartments which enable users to place components on a shelf member or remove components from the shelf members. In one embodiment, drawer assemblies are removably positioned within the open compartments. The divider members can be repositioned to provide open compartments of varying sizes.

In another embodiment, the storage unit comprises a top panel, a bottom panel, a pair of opposing side panels attached to the top and bottom panels, a back panel slidably attached to the side panels so as to define a housing having an interior, and a plurality of shelf members positioned within the interior of the housing and arranged in a vertically oriented fashion. The shelf members are removably mounted to the opposing side panels. The storage unit further comprises a plurality of divider members removably positioned between (i) each pair of consecutive shelf members, (ii) the top panel and an uppermost shelf member and (iii) the bottom panel and a lowermost shelf member. The divider members define a plurality of open compartments and are configured to be repositioned to provide open compartments of varying sizes.

BRIEF DESCRIPTION OF THE DRAWINGS

The features of the invention are believed to be novel. The figures are for illustration purposes only and are not drawn to scale. The invention itself may best be understood by reference to the detailed description which follows taken in conjunction with the accompanying drawings in which:

FIG. 3 is a bottom plan view of a top panel shown in FIG. 2.

FIG. 4 is a view taken along line 4-4 of FIG. 3.

FIG. 5 is a perspective view of the top panel of FIG. 3.

FIG. 17 is a plan view of one of a plurality of shelf members shown in FIG. 2.

FIG. 18 is an end view taken along line 18-18 of FIG. 17.

FIG. 19 is a front view taken along line 19-19 of FIG. 17.

FIG. 26 is side elevational view of a base member of the divider member of FIG. 24.

FIG. 27 is a top plan view taken along line 27-27 of FIG. 26.

FIG. 28 is an end view taken along line 28-28 of FIG. 26.

DETAILED DESCRIPTION OF THE INVENTION

Figure 1:
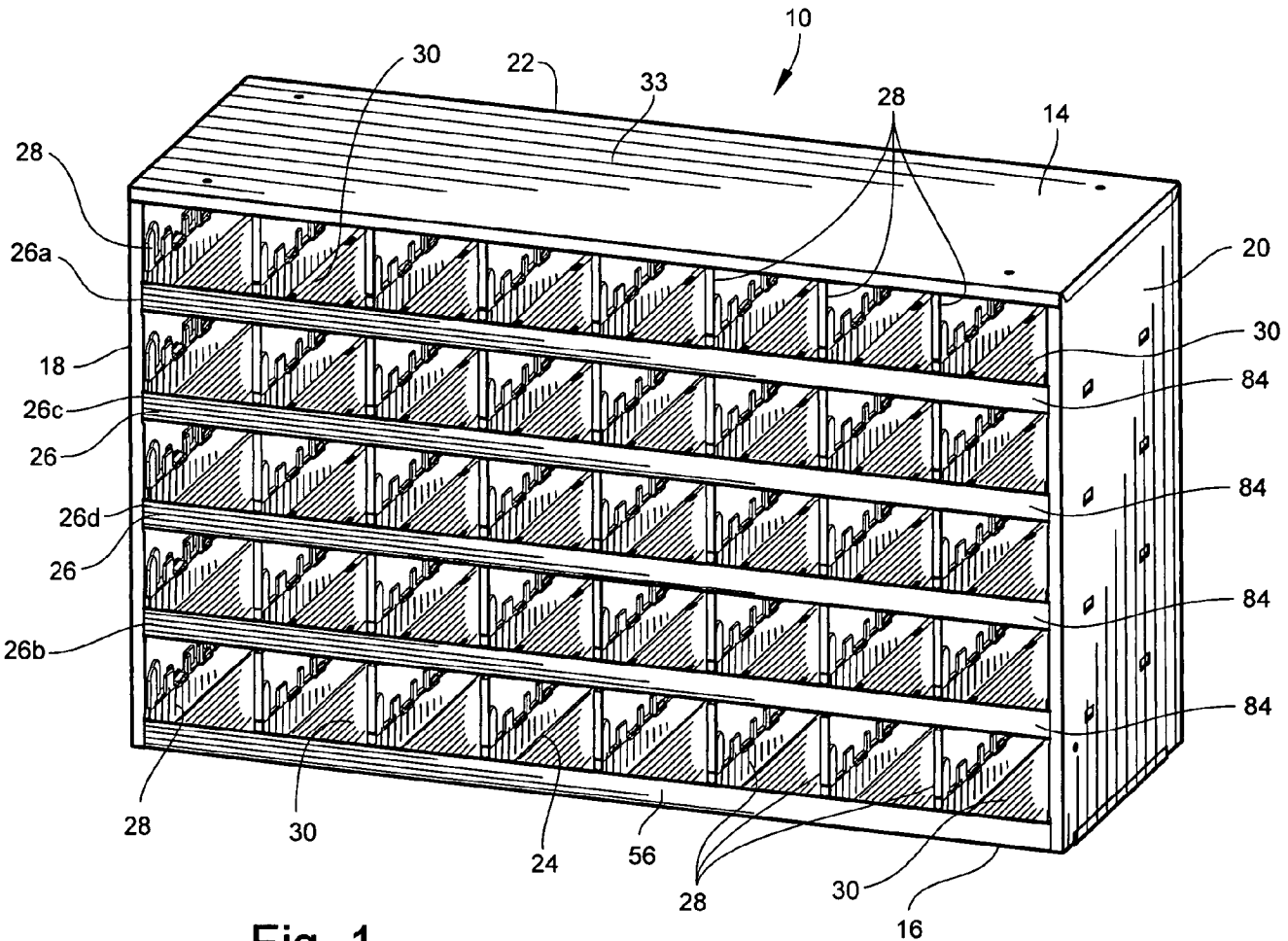
FIG. 1 is a perspective view of a storage unit in accordance with one embodiment of the present invention.

Referring to FIGS. 1, 2, 14 and 40, there is shown storage unit 10 in accordance with one embodiment of the present invention. Storage unit 10 generally comprises back panel 12, top panel 14 which is attached to back panel 12, bottom panel 16 which is attached to back panel 12, and a pair of opposing side panels 18 and 20 which are attached to the back, top and bottom panels 12, 14 and 16, respectively, so as to define a housing structure 22 having interior 24. Storage unit 10 further comprises a plurality of shelf members 26 positioned within interior 24. Shelf members 26 are arranged in a vertically oriented fashion. The plurality of shelf members 26 includes an uppermost shelf member 26*a*, lowermost shelf member 26*b* and intermediate shelf members 26*c* and 26*d*. Although four shelf members 26 are shown, it is to be understood that storage unit 10 can be configured to utilize more or less than four shelf members 26. Shelf members 26 are removably attached to back panel 12 and opposing side panels 18 and 20. Storage unit 10 further comprises a plurality of divider members 28 removably positioned between (i) each pair of consecutive shelf members 26, (ii) top panel 14 and uppermost shelf member 26*a* and (iii) bottom panel 16 and lowermost shelf member 26*b*. Divider members 28 define a plurality of separate open compartments 30 which enable users to place components on shelf members 26 or remove components from shelf members 26. In one embodiment, drawer assemblies (described in the ensuing description) are removably positioned within the separate open compartments 30. Divider members 28 can be repositioned to provide separate open compartments 30 of varying sizes.

Referring to FIGS. 1-5, top panel 14 has longitudinally extending axis 32, top side 33 and bottom side 34 that confronts interior 24. In a preferred embodiment, top side 33 is substantially planar. Rail member 36 is attached to bottom side 34 and extends in substantially the same direction as longitudinally extending axis 32. Rail member 36 has a plurality of spaced slots 38 formed therein. Each slot 38 is sized to receive a portion of a corresponding divider member 28. This aspect of the invention is described in the ensuing description. Each slot 38 is substantially perpendicular to longitudinally extending axis 32. In a preferred embodiment, slots 38 are equidistantly spaced. In an alternate embodiment, slots 38 are not equidistantly spaced.

Figure 13:
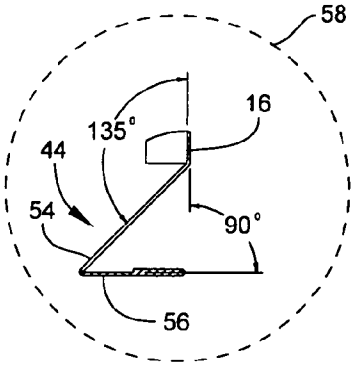
FIG. 13 is an enlarged view of a portion of the view of FIG. 10.
Figure 9:
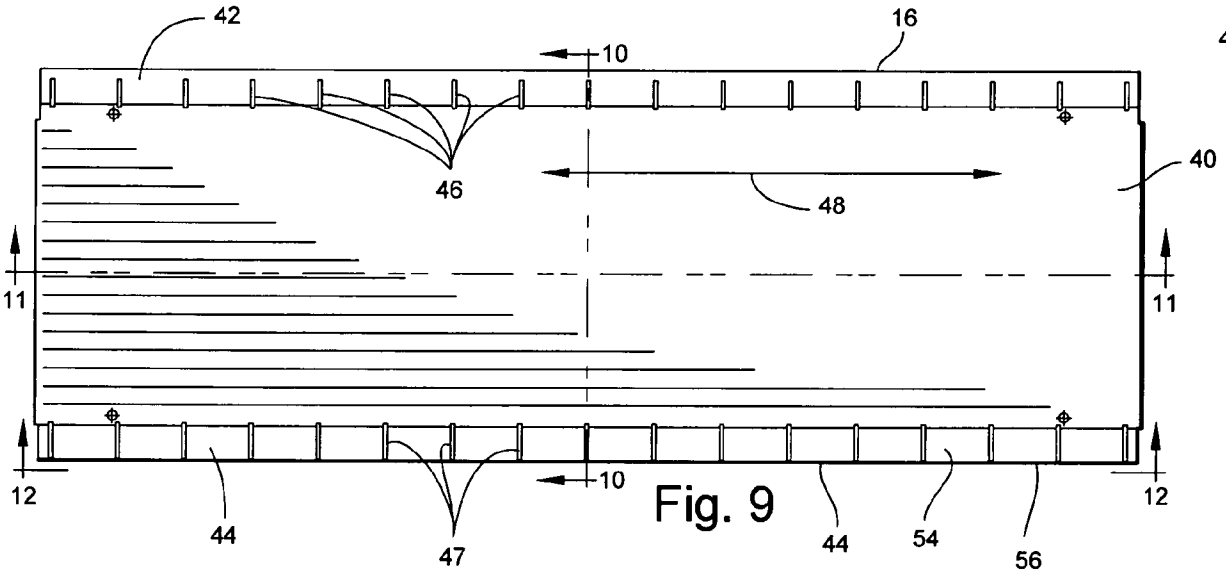
FIG. 9 is a plan view of a bottom panel shown in FIG. 2.
Figure 11:
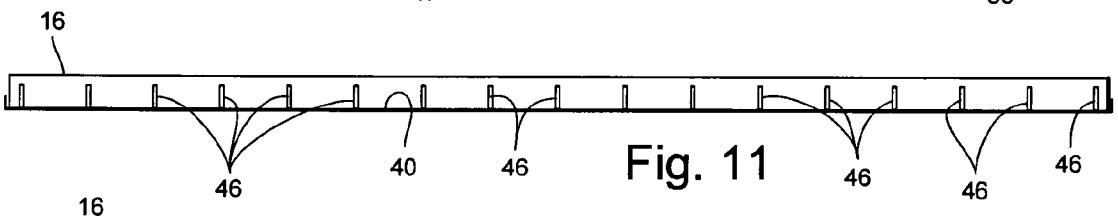
FIG. 11 is a cross-sectional view taken along line 11-11 of FIG. 9.
Figure 12:
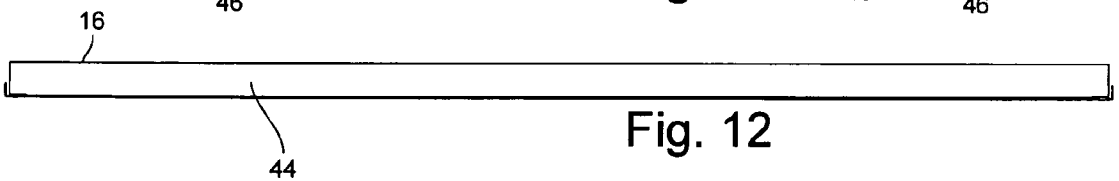
FIG. 12 is a front view taken along line 12-12 of FIG. 9.

Referring to FIGS. 1, 2 and 9-13, bottom panel 16 has top side 40 and a pair of opposing lengthwise end portions 42 and 44. Each lengthwise end portion 42 and 44 extends upward with respect to the plane of top side 40. Lengthwise end portion 42 has a plurality of slots 46 formed therein. Each slot 46 is sized for receiving a portion of one of the divider members 28. Similarly, lengthwise end portion 44 has a plurality of slots 47 formed therein. Each slot 47 is sized for receiving a portion of one of the divider members 28. In one embodiment, slots 46 and 47 are equidistantly spaced. In another embodiment, slots 46 and 47 are not equidistantly spaced. Bottom panel 16 has longitudinally extending axis 48. Slots 46 and 47 are generally perpendicular to longitudinally extending axis 48. Each slot 46 of lengthwise end portion 42 is substantially coplanar with a corresponding slot 47 of lengthwise end portion 44. In accordance with the invention, each lengthwise end portion 42 and 44 is generally triangular shaped. Specifically, lengthwise end portion 42 has first portion 50 angulated with respect to top side 40, and second portion 52 that is angulated with respect to first portion 50 and generally perpendicular to top side 40. Slots 46 are formed in portion 50. Similarly, lengthwise end portion 44 has first portion 54 angulated with respect to top side 40, and second portion 56 that is angulated with respect to first portion 54 and generally perpendicular to top side 40. This is illustrated in FIG. 13 which is an enlarged view of the portion of the view of FIG. 10 indicated by reference numeral 58. Slots 47 are formed in portion 54. Thus, lengthwise end portions 42 and 44 have substantially the same structure. In one embodiment, portion 54 is angulated with respect to top side 40 by about 135°, and portion 50 is angulated with respect to top side 40 by about 135°. However, it is to be understood that other degrees of angulation are possible.

Figure 2:
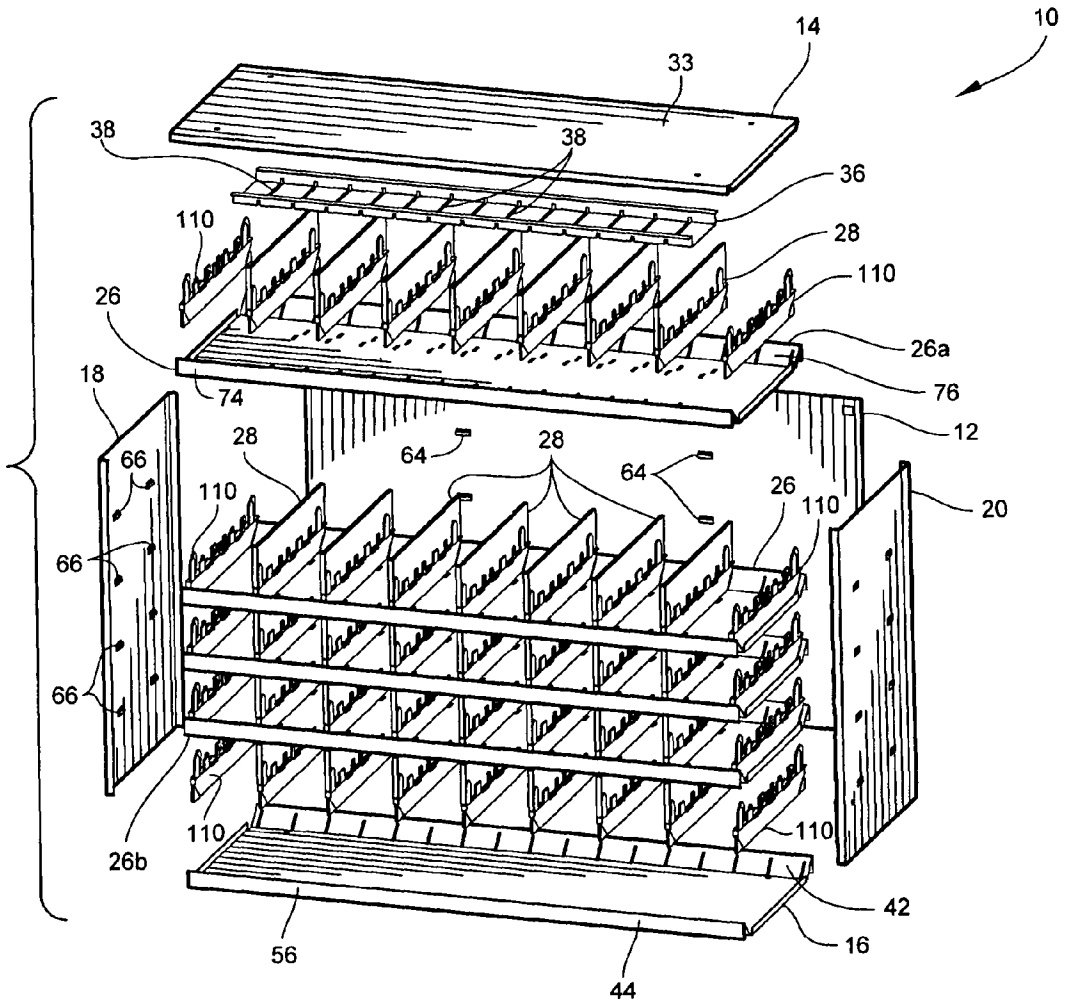
FIG. 2 is an exploded view of the storage unit of FIG. 1.
Figure 7:
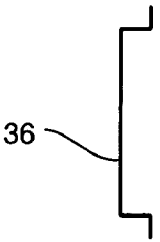
FIG. 7 is a view taken along line 7-7 of FIG. 6.
Figure 6:
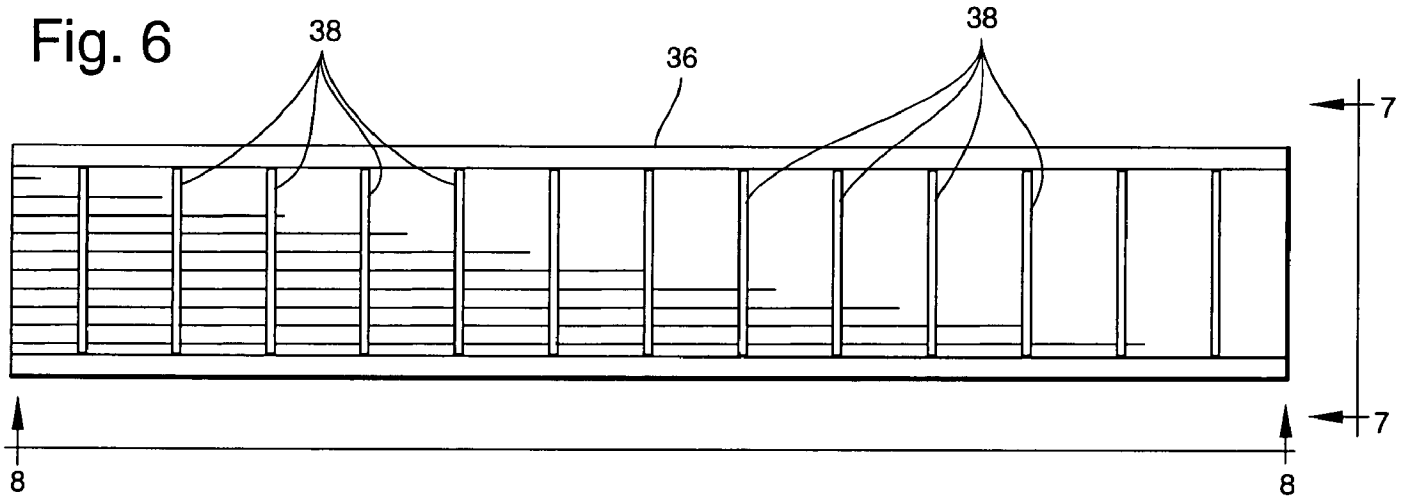
FIG. 6 is a side elevational view of a rail member shown in FIG. 3.
Figure 8:
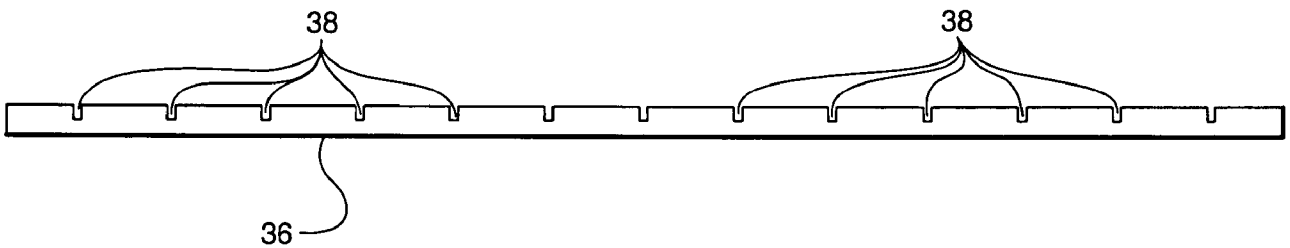
FIG. 8 is a view taken along line 8-8 of FIG. 6.
Figure 10:
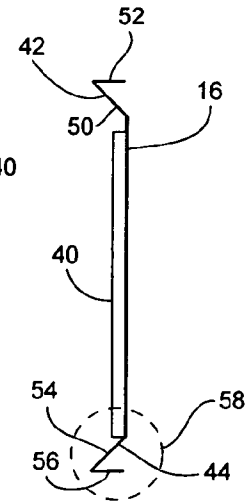
FIG. 10 is a cross-sectional view taken along line 10-10 of FIG. 9.
Figure 16:
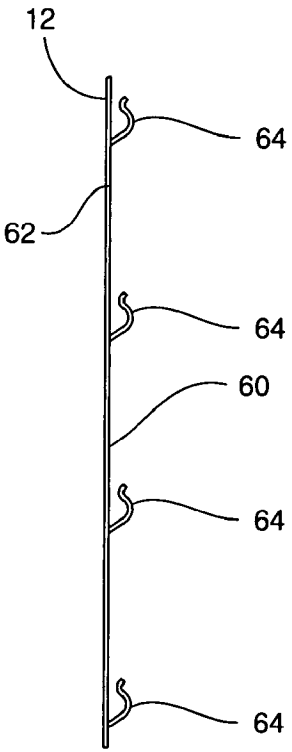
FIG. 16 is a cross-sectional view taken along line 16-16 of FIG. 15.
Figure 15:
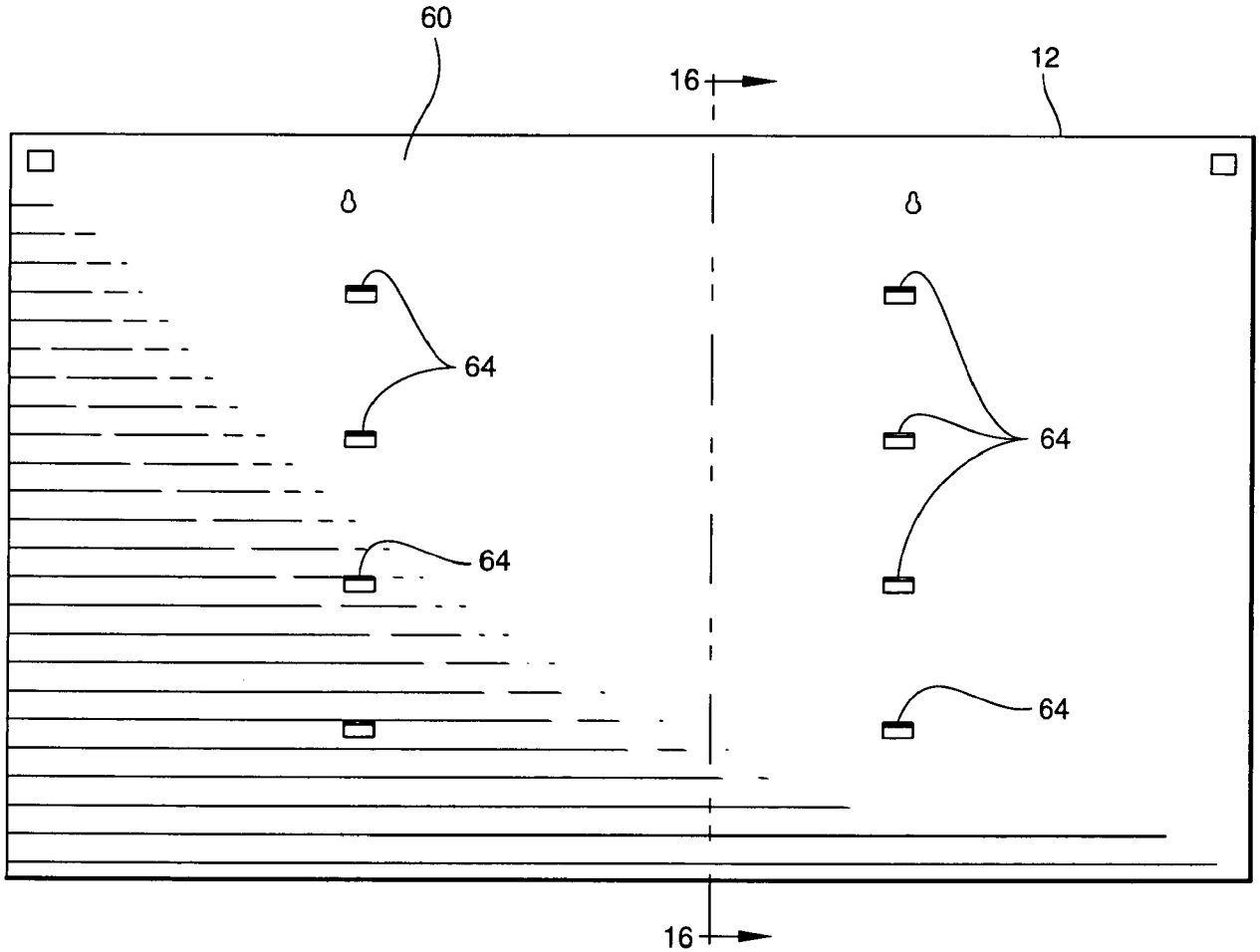
FIG. 15 is a front elevational view of a back panel shown in FIG. 2.

Referring to FIGS. 2, 15 and 16, there is shown back panel 12. Back panel 12 comprises front side 60 and rear side 62. Front side 60 confronts interior 24 of housing 22. Back panel 12 further comprises a plurality of protruding members 64 that extend from front side 60. In one embodiment, each protruding member 64 is configured as a hook. Referring to FIGS. 1 and 2, each opposing side panel 18 and 20 has an interior wall and a plurality of protruding members 66 that extend from the interior wall. In a preferred embodiment, protruding members 66 have the same shape as protruding members 64. Shelf members 26 are removably mounted to protruding members 64 and 66. It is to be understood that the locations of protruding members 64 and 66 as shown in FIGS. 1, 2 and 15 are just examples and that protruding members 64 and 66 can be located at other locations. Furthermore, the actual number of protruding members 64 and 66 can be increased to accommodate more shelf members 26 or to provide more optional shelf positions.

Figure 21:
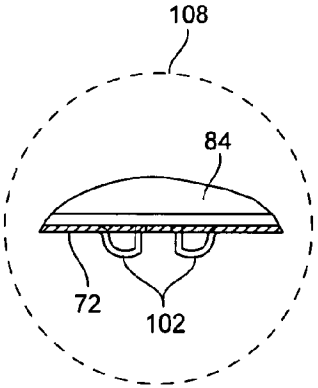
FIG. 21 is an enlarged view of a portion of the view shown in FIG. 19.
Figure 23:
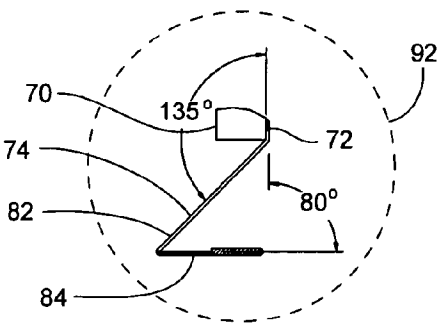
FIG. 23 is an enlarged view of a portion of the view shown in FIG. 18.
Figure 22:
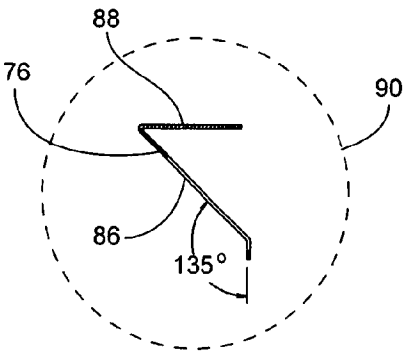
FIG. 22 is an enlarged view of a portion of the view shown in FIG. 18.
Figure 24:
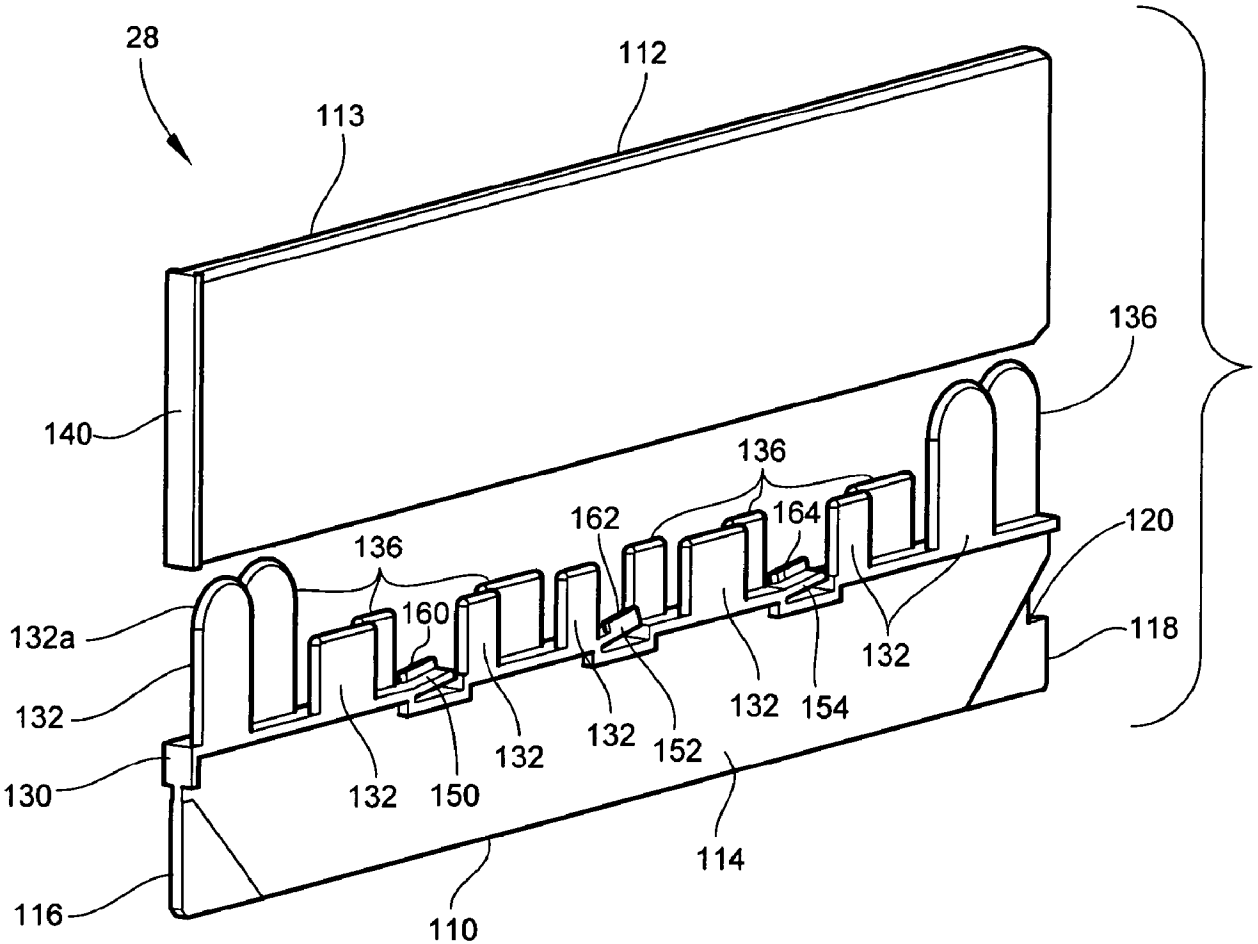
FIG. 24 is an exploded view, in perspective, of a divider member shown in FIGS. 1 and 2.
Figure 25:
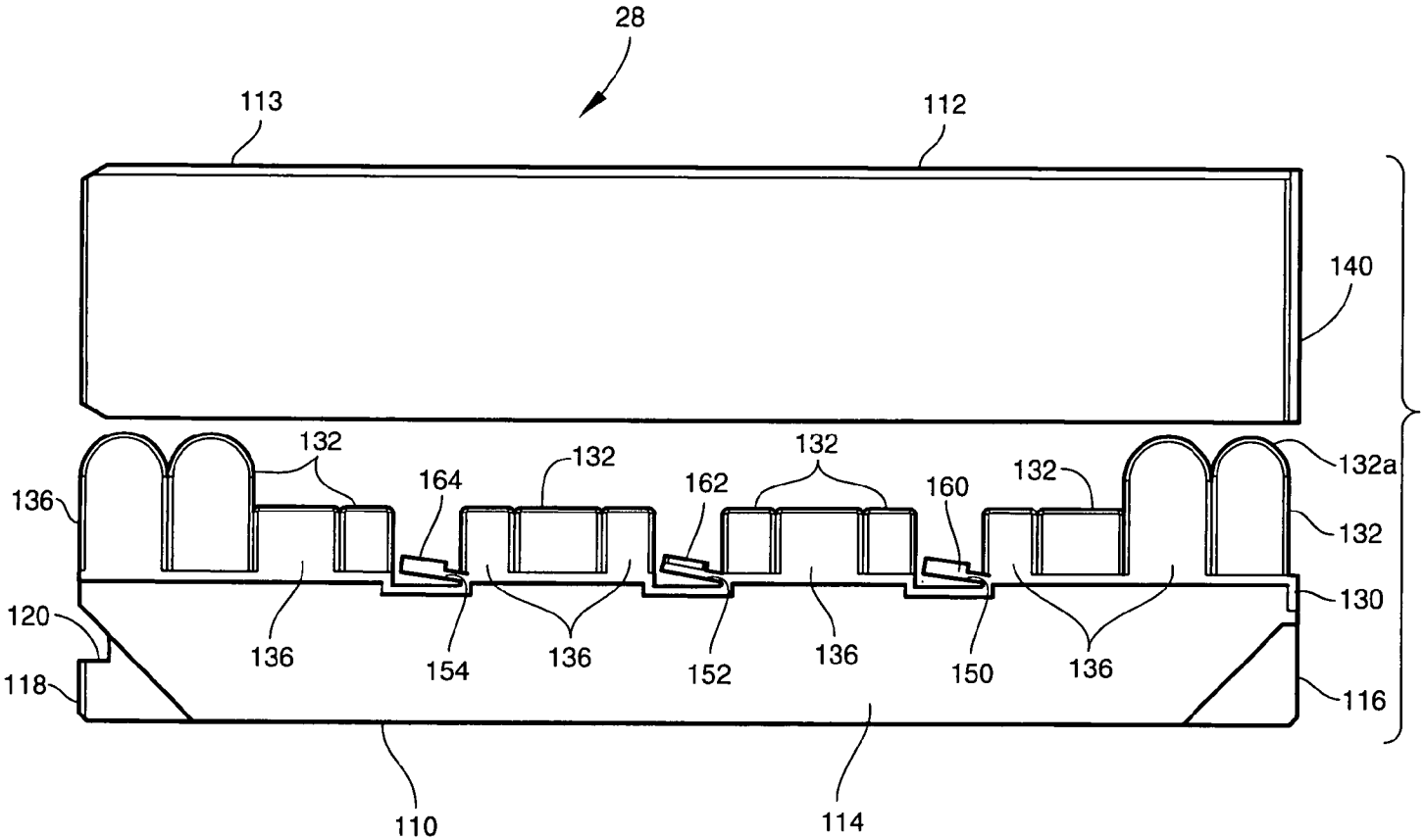
FIG. 25 is an exploded, side elevational view of the divider member of FIG. 24.
Figure 29:
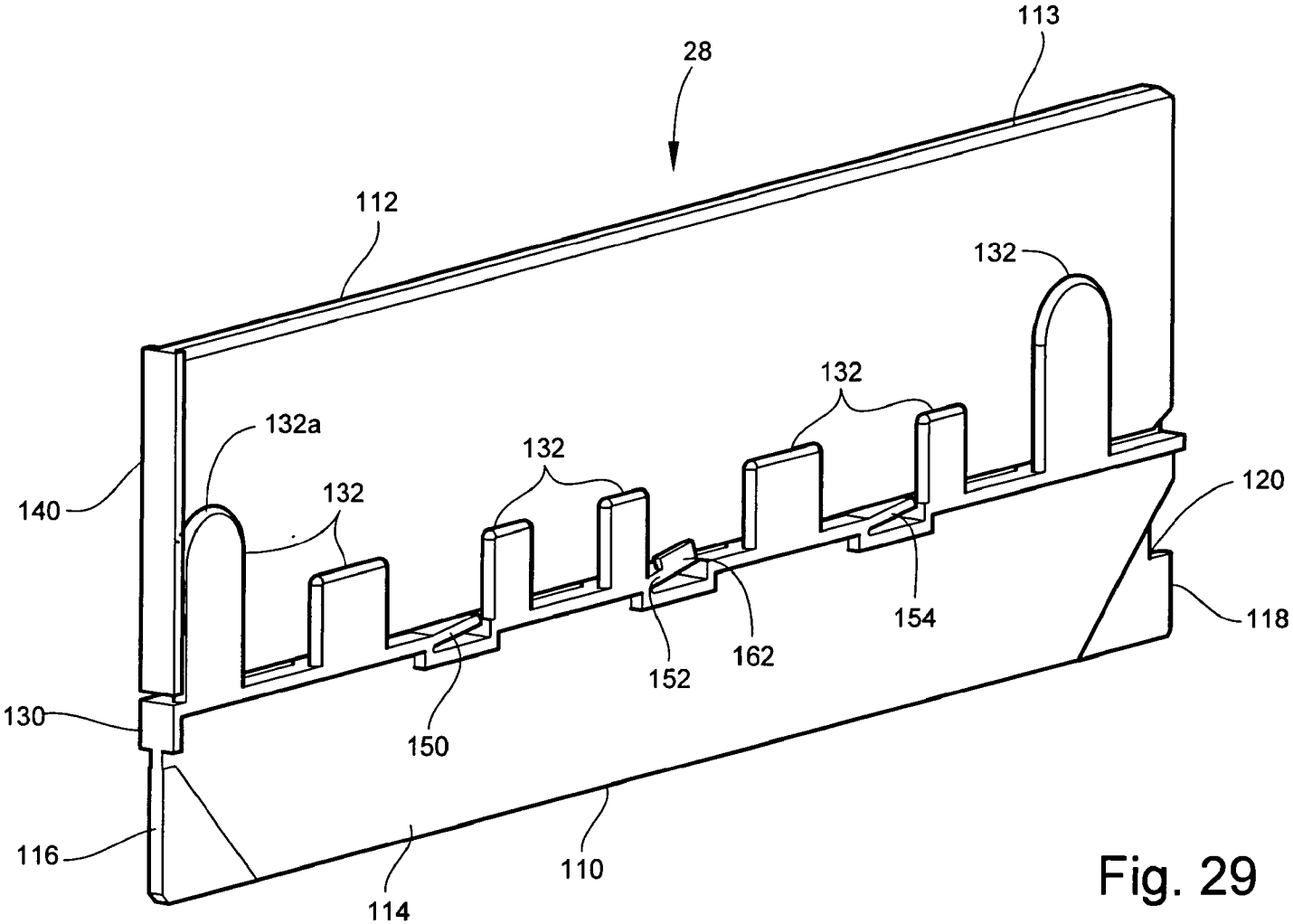
FIG. 29 is a perspective view of the divider member of FIG. 24 showing a top member removably mounted to the base member.
Figure 30:
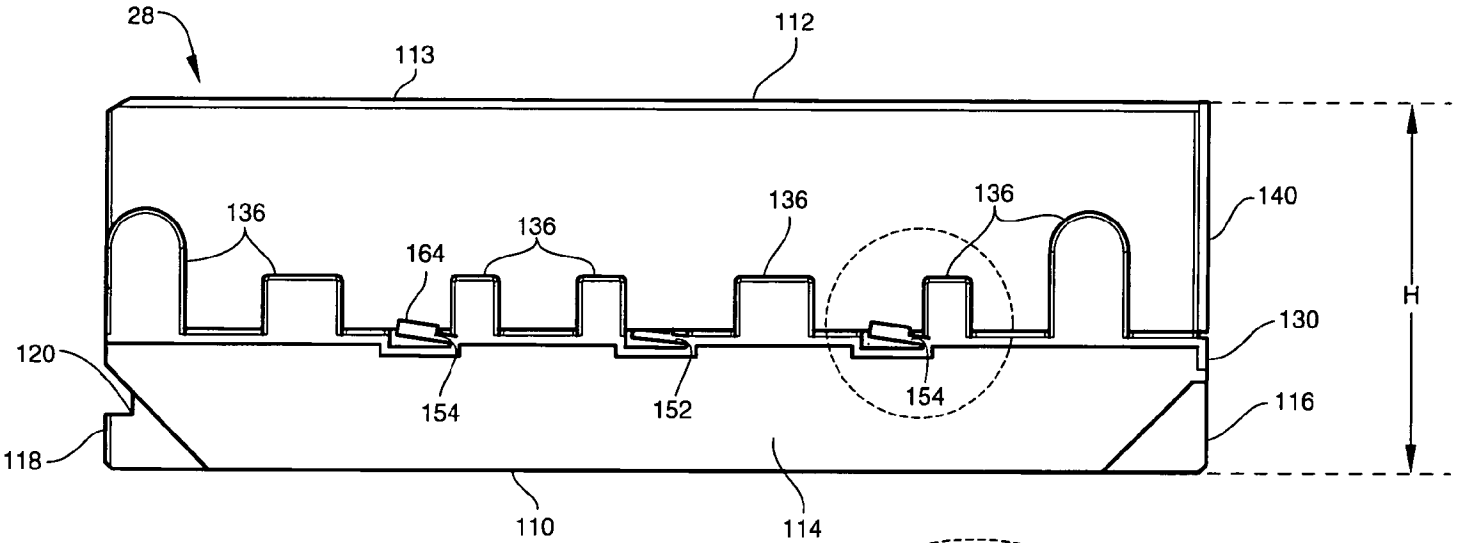
FIG. 30 is a side elevational view of the divider member of FIG. 29 showing the top member removably mounted to the base member such that resilient members, depicted in FIGS. 24 and 25, are in an uncompressed state.
Figure 31:
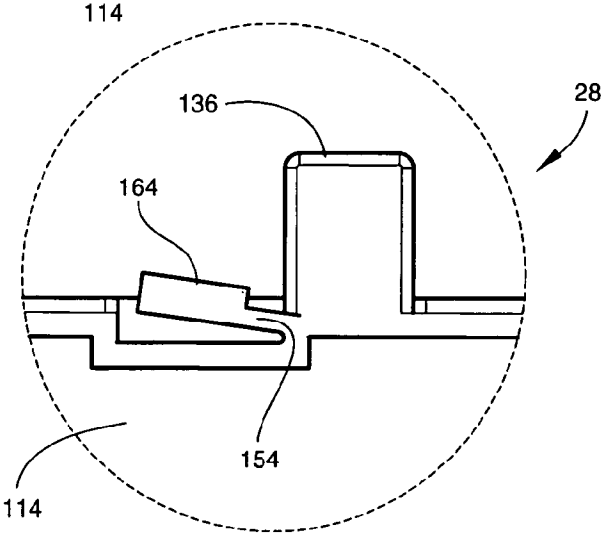
FIG. 31 is an enlarged view of a portion of the view shown in FIG. 30.

Referring to FIGS. 1, 2 and 17-23, each shelf member 26 has top side 70, bottom side 72, and pair of opposing lengthwise end portions 74 and 76. Lengthwise end portion 74 has a plurality of slots 78 formed therein. Similarly, lengthwise end portion 76 has a plurality of slots 79 formed therein. Each of slots 78 and 79 is sized for receiving a portion of a corresponding divider member 28 in the same manner in which divider members 28 are inserted into slots 46 and 47 of bottom panel 16. Each shelf member 26 has longitudinally extending axis 80. Slots 78 and 79 are generally perpendicular to longitudinally extending axis 80. In one embodiment, slots 78 and 79 are equidistantly spaced. In another embodiment, slots 78 and 79 are not equidistantly spaced. In accordance with the invention, each lengthwise end portion 74 and 76 is generally triangular shaped. Lengthwise end portion 74 has first portion 82 that is angulated with respect to top side 70, and second portion 84 that is angulated with respect to first portion 82 and generally perpendicular to top and bottom sides 70 and 72, respectively. Slots 78 are formed in portion 82. Similarly, lengthwise end portion 76 has first portion 86 that is angulated with respect to top side 70, and second portion 88 that is angulated with respect to first portion 86 and generally perpendicular to top and bottom sides 70 and 72, respectively. Slots 79 are formed in portion 86. Thus, lengthwise end portions 74 and 76 have substantially the same structure. Each slot 78 is substantially coplanar with a corresponding slot 79. In one embodiment, portion 82 is angulated with respect to top side 70 by about 135°, and portion 86 is also angulated with respect to side 70 by about 135°. This is illustrated in FIGS. 22 and 23 which are enlarged views of the portions of the view of FIG. 18 indicated by reference numerals 90 and 92, respectively. However, it is to be understood that other degrees of angulation are possible. When storage unit 10 is completely assembled as shown in FIG. 1, front portions 84 of shelf members 26 are substantially coplanar.

Figure 17A:
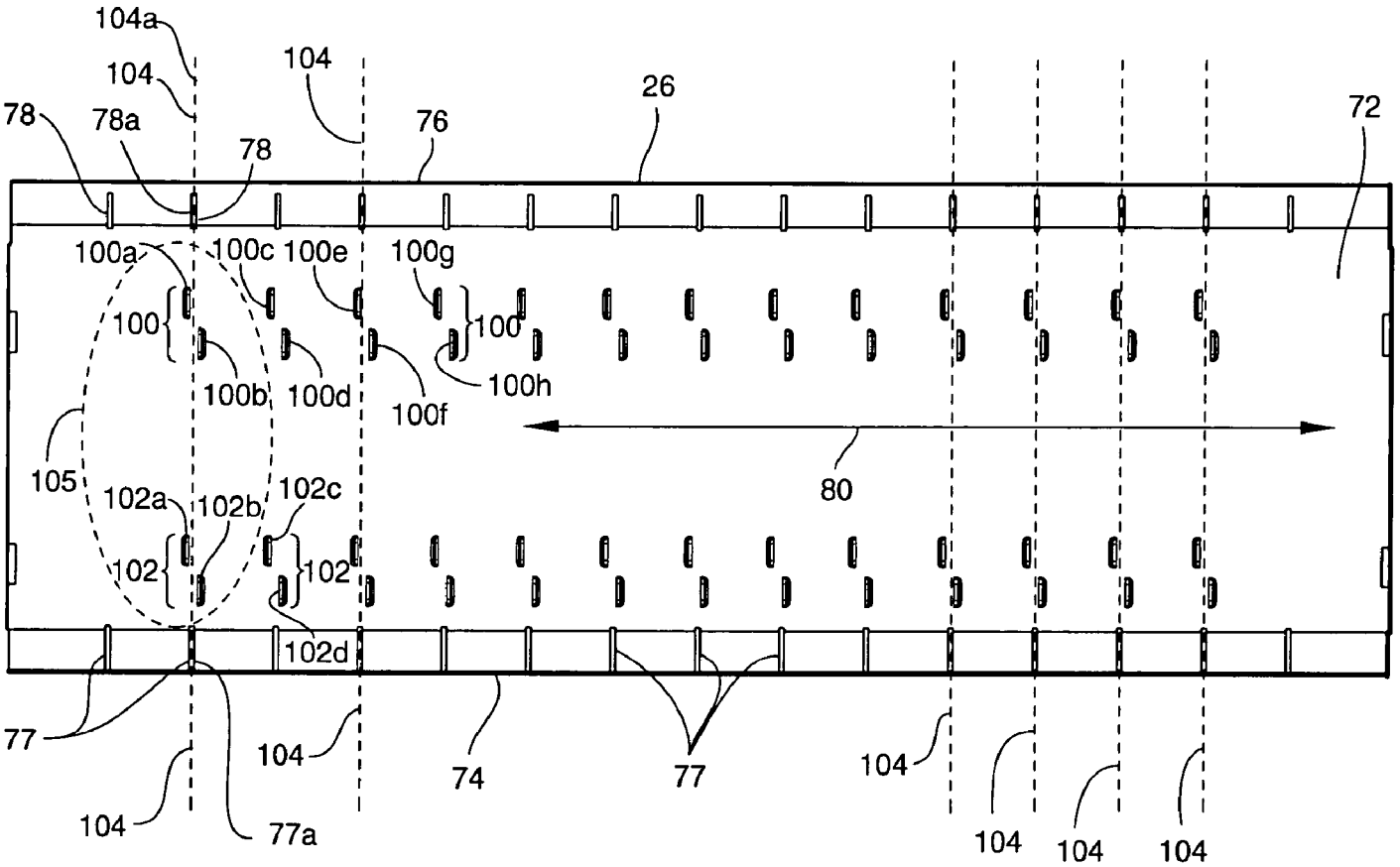
FIG. 17A is a bottom plan view of the shelf member shown in FIG. 17.
Figure 17B:
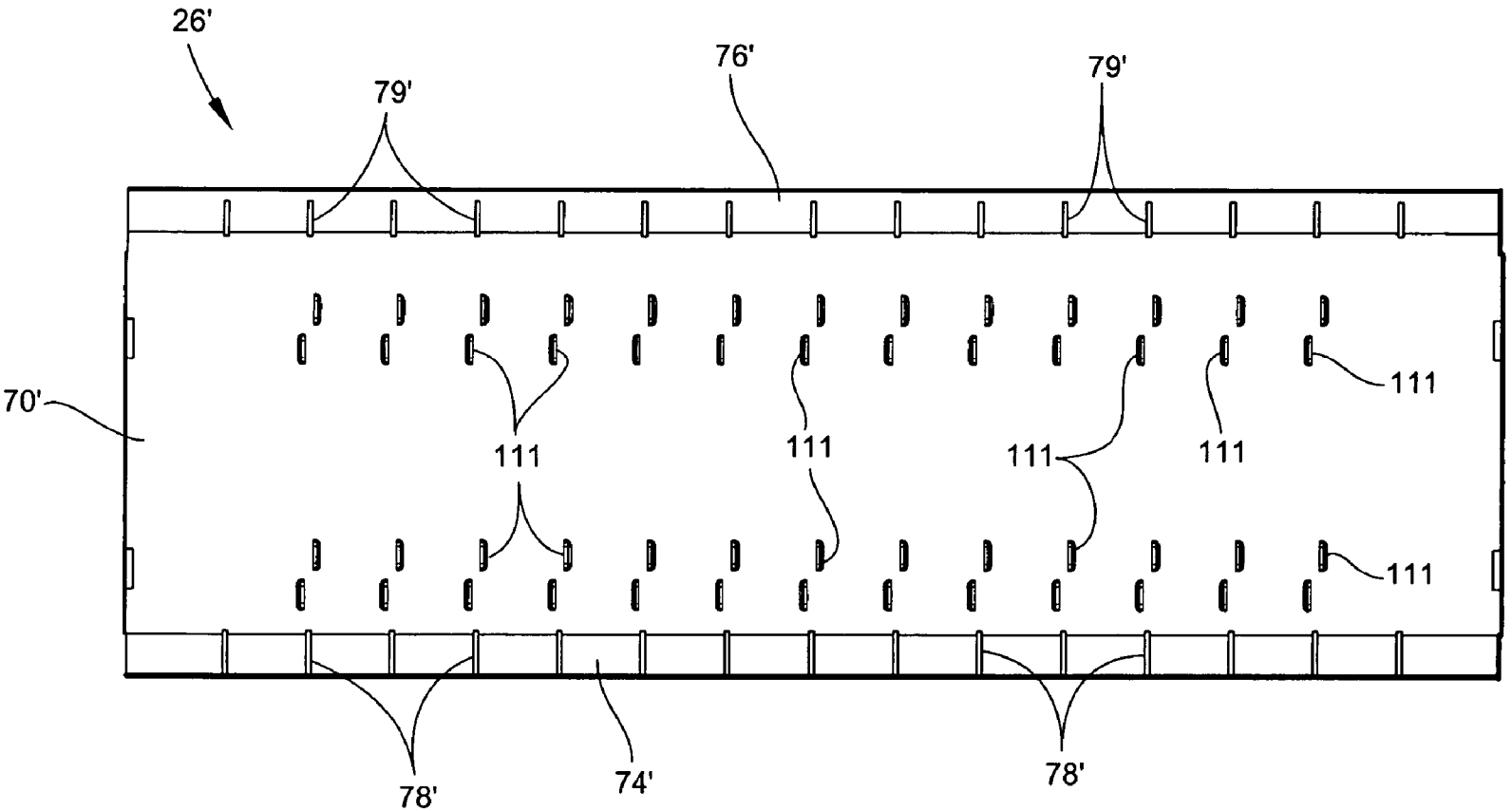
FIG. 17B is a top plan view of a shelf member in accordance with an alternate embodiment of the invention.
Figure 20:
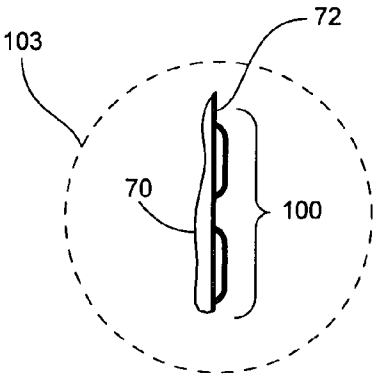
FIG. 20 is an enlarged view of a portion of the view shown in FIG. 18.

Referring to FIGS. 17, 17A and 18-21, each shelf member 26 comprises a first plurality of pairs 100 of protruding members 100*a* and 100*b* that extend downward from bottom side 72 and are located near lengthwise end portion 76 (see FIG. 17A). This is also illustrated in FIG. 20 which is an enlarged view of the portion of the view shown in FIG. 18 indicated by reference numeral 103. Shelf member 26 further comprises a second plurality of pairs 102 of protruding members 102*a* and 102*b* that extend downward from bottom side 72 and are located near lengthwise end portion 74 (see FIG. 17A). This is also illustrated in FIG. 21 which is an enlarged view of the portion of the view shown in FIG. 19 that is indicated by reference numeral 108. Protruding member 100*a* is substantially aligned with protruding member 102*a*. Similarly, protruding member 100*b* is substantially aligned with protruding member 102*b*. Each pair 100 of protruding members 100*a* and 100*b* corresponds to a particular pair 102 of protruding members 102*a* and 102*b* so as to define a set of pairs of protruding members. For example, pair 100 of protruding members 100*a* and 100*b* and pair 102 of protruding members 102*a* and 102*b* define set 105 of protruding members. In order to facilitate understanding of the invention, the ensuing description makes reference to reference axes 104. Specifically, reference axes 104 are used to aid in the explanation of the structure of portions of each shelf member 26 and the placement of divider members 28 with respect to shelf members 26. Axes 104 extend laterally and are substantially perpendicular to longitudinally extending axis 80. In one embodiment, protruding members 100*a* and 100*b* are arranged in a staggered formation with respect to axis 104 (see FIG. 17A) and protruding members 102*a* and 102*b* are arranged in a staggered formation with respect to axis 104. Referring to FIG. 17B, there is shown an alternate embodiment of shelf member 26. Alternate shelf member 26' has lengthwise end portions 74' and 76' that have substantially the same configuration as lengthwise end portions 74 and 76, respectively. Lengthwise end portions 74' and 76' have slots 78' and 79', respectively. The slots 78' and 79' function in the same manner as slots 78 and 79, respectively. Shelf member 26' is configured so that the protruding members which extend from the bottom side (not shown) thereof are formed by a stamping process that is applied to the top surface 70'. As a result, corresponding indentations 111 are formed in top surface 70' which result in the protrusions (not shown) being formed on and extending downward from the bottom side (not shown) of shelf member 26'. The configuration of shelf member 26' is suitable when metal is the material from which shelf member 26' is fabricated.

Referring to FIGS. 17, 17A and 18-21, each axis 104 corresponds to a single set of pairs of protruding members 100 and 102 (e.g. set 105). Each axis 104 is substantially coplanar with a corresponding slot 78 and a corresponding slot 79. The protruding members of each pair in set 105 are offset in opposite directions with respect to the corresponding axis 104 such that one protruding member of each pair 100 and 102 is located on one side of the axis 104 and the other protruding member of each pair 100 and 102 is located on the other side of axis 104. For example, protruding members 100*a* and 100*b* are offset in opposite directions such that protruding member 100*a* is located on one side of axis 104*a* and protruding member 100*b* is located on the other side of axis 104*a*. Similarly, protruding members 102*a* and 102*b* are offset in opposite directions such that protruding member 102*a* is located on one side of axis 104*a* and protruding member 102*b* is located on the other side of axis 104*a*.

In an alternate embodiment, protruding members 100*a* and 100*b* are not arranged in a staggered formation with respect to axis 104 but instead, are positioned so that they are substantially aligned with each other and are the same distance from longitudinally extending axis 80. Similarly, in an alternate embodiment, protruding members 102*a* and 102*b* are not arranged in a staggered formation with respect to axis 104 but instead, are positioned so that they are substantially aligned with each other and are the same distance from longitudinally extending axis 80. These alternate embodiments are shown in FIGS. 47A, 47B and 47C. Alternate shelf member 400 has a top side 402, a bottom side 404 and lengthwise end portions 406 and 408. Lengthwise end portions 406 and 408 have generally the same configuration as lengthwise end portions 74 and 76, respectively. Lengthwise end portions 406 and 408 have slots 409 that function in the same manner as slots 78 and 79 described in the foregoing description. Protrusions 410 extend downward from bottom side 404 and are formed by a stamping process that is applied to top side 402. Protrusions 410 are also shown in FIG. 47C which is an enlarged view of the portion of the view of FIG. 47B indicated by reference numeral 411. In this embodiment, protrusions 410 are arranged in pairs wherein the protrusions of each pair are substantially aligned with each other and are not staggered. Furthermore, there are three pairs of protrusions 410 that are substantially aligned with a corresponding pair of slots 409A and 409B in lengthwise end portions 404 and 406, respectively. The aforementioned stamping process creates indentations 412 in top side 402.

Referring to FIGS. 2-5, 17 and 17A, when storage unit 10 is completely assembled, each slot 38 in rail member 36 is substantially coplanar with a corresponding slot 78 in lengthwise end portion 74 of uppermost shelf member 26*a* and a corresponding slot 79 in lengthwise end portion 76 of uppermost shelf member 26*a*. Each laterally extending axis 104 of a particular shelf member 26 (see FIG. 17A) is substantially coplanar with corresponding slots in lengthwise end portions 74 and 76 of a shelf member 26 that is located directly beneath the aforementioned particular shelf member 26. For example, each laterally extending axis 104 of shelf member 26*a* is substantially coplanar with a corresponding slot 78 and a corresponding slot 79 of shelf member 26*c*. Similarly, each laterally extending axis 104 of shelf member 26*b* is substantially coplanar with a corresponding slot 46 and a corresponding slot 47 of bottom panel 16.

Figure 14:
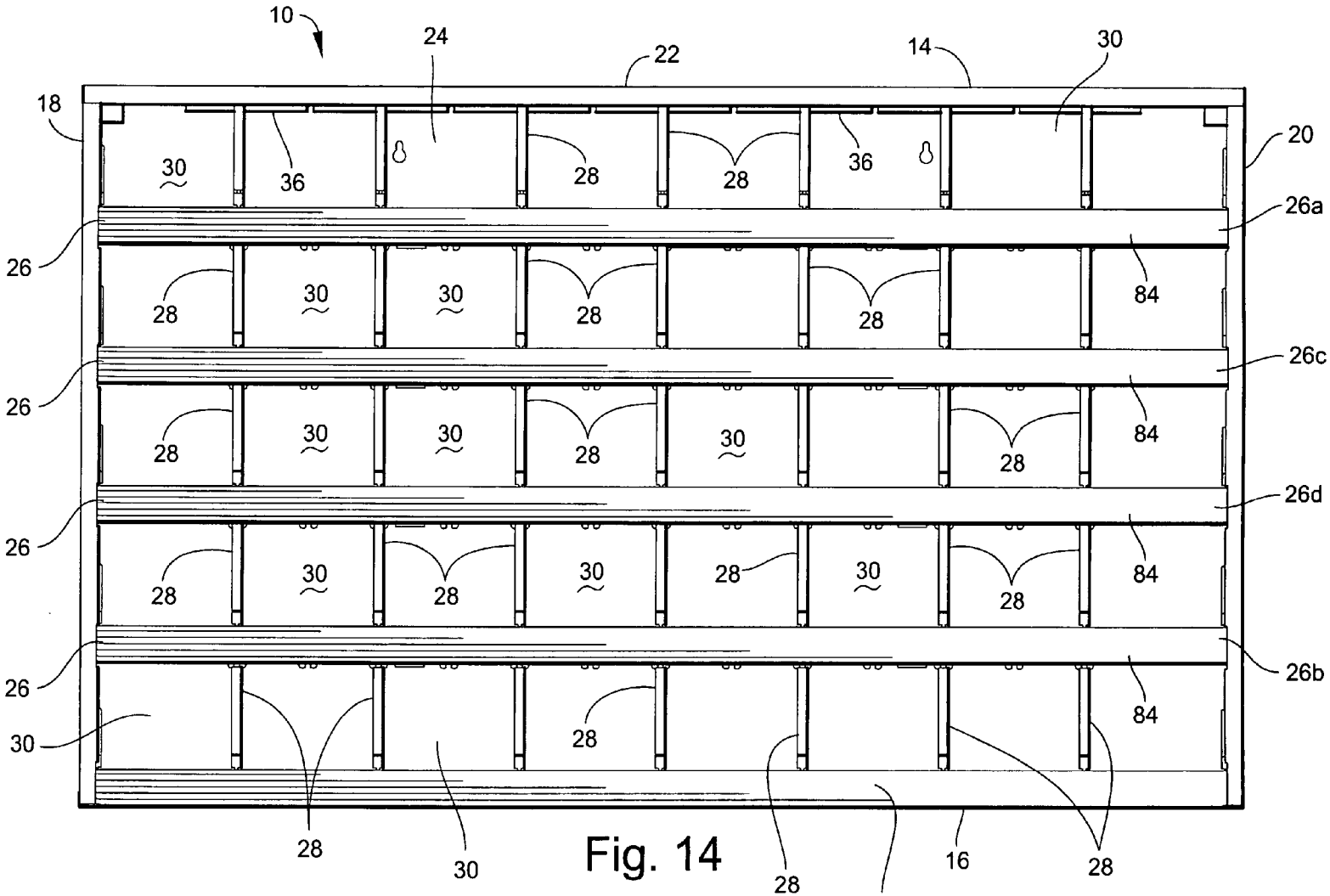
FIG. 14 is a front elevational view of the storage unit of FIG. 1.

Referring to FIGS. 1, 2, and 14, when each divider member 28 is positioned on shelf member 26*b*, which is below shelf member 26*d*, divider member 28 contacts bottom side 72 of shelf member 26*d* and is positioned along a corresponding laterally extending axis 104 of bottom side 72 of shelf member 26*d* such that protruding member 100*a* (of shelf member 26*d*) is located on one side of divider member 28 and protruding member 100*b* (of shelf member 26*d*) is located on the other side of divider member 28, and portions of divider member 28 are inserted into slots 78 and 79 of shelf member 26*b* that are substantially coplanar with the laterally extending axis 104 of shelf member 26*d* along which the divider member 28 is positioned. The manner in each which divider member 28 is positioned between shelf members 26 is described in detail in the ensuing description.

Similarly, when each divider member 28 is positioned between bottom panel 16 and lowermost shelf member 26*b*, divider member 28 contacts bottom side 72 of shelf member 26*b* and is positioned along a corresponding laterally extending axis 104 of shelf member 26*b* such that protruding members 100*a* and 102*a* (of shelf member 26*b*) are located on one side of divider member 28 and protruding members 100*b* and 102*b* (of shelf member 26*b*) are located on the other side of divider member 28, and portions of divider member 28 are inserted into corresponding slots 46 and 47 (of bottom panel 16) that are substantially coplanar with the laterally extending axis 104 (of shelf member 26*b*) along which the divider member 28 is positioned.

Figure 33:
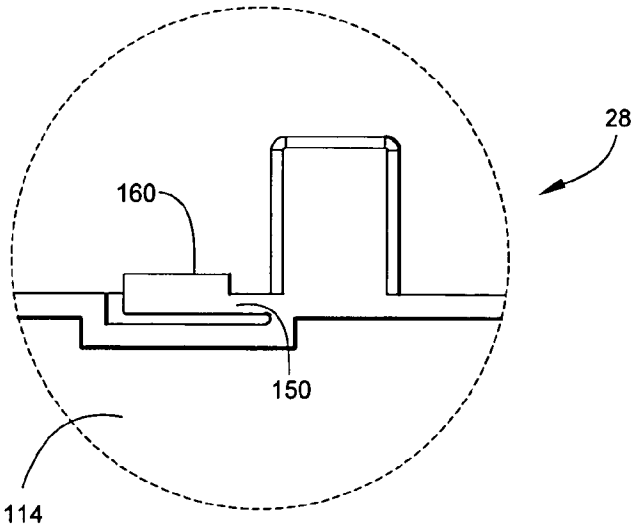
FIG. 33 is an enlarged view of a portion of the view shown in FIG. 32.
Figure 34:
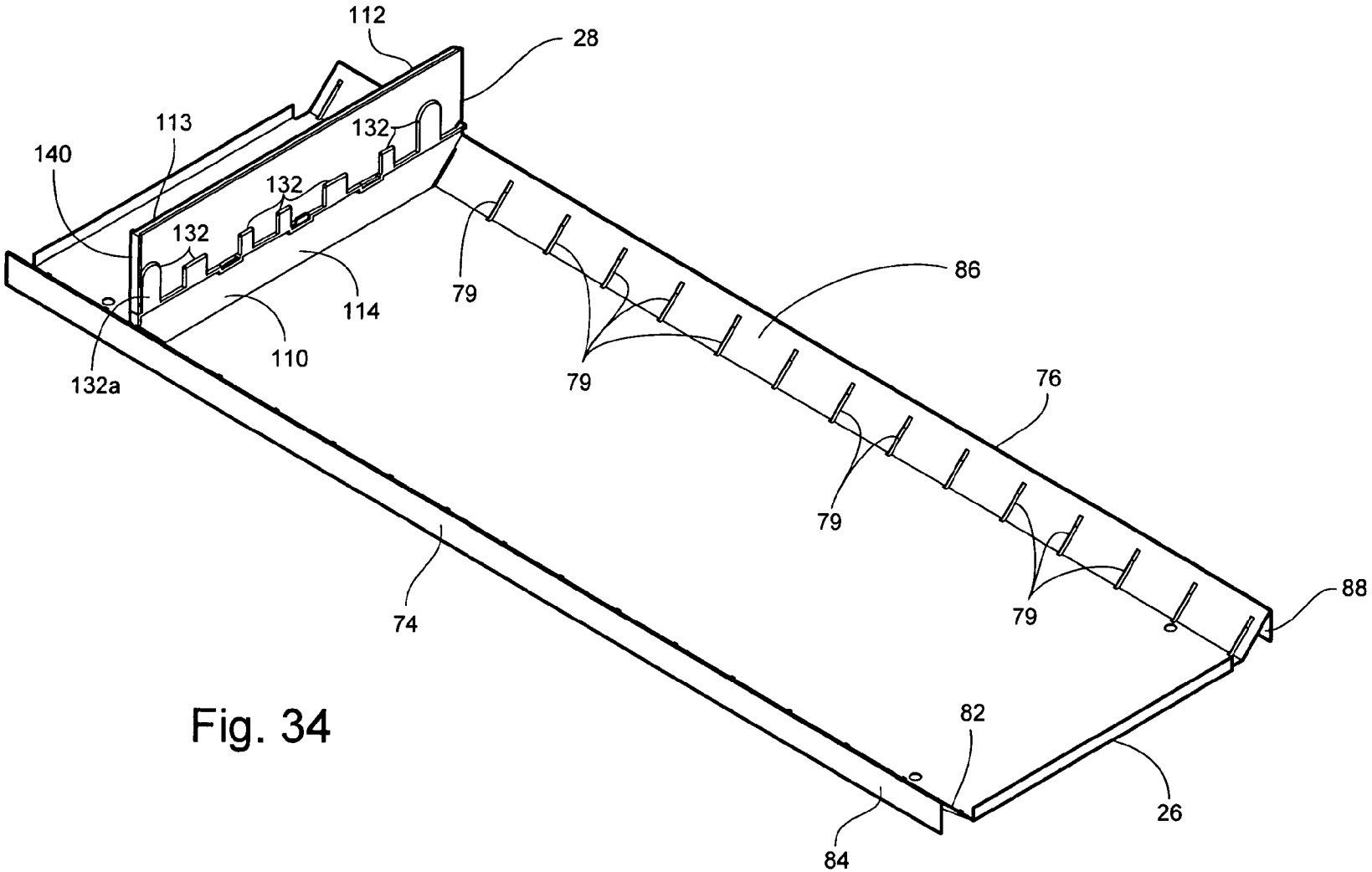
FIG. 34 is a perspective view of the divider member removably mounted to one of the shelf members.
Figure 34A:
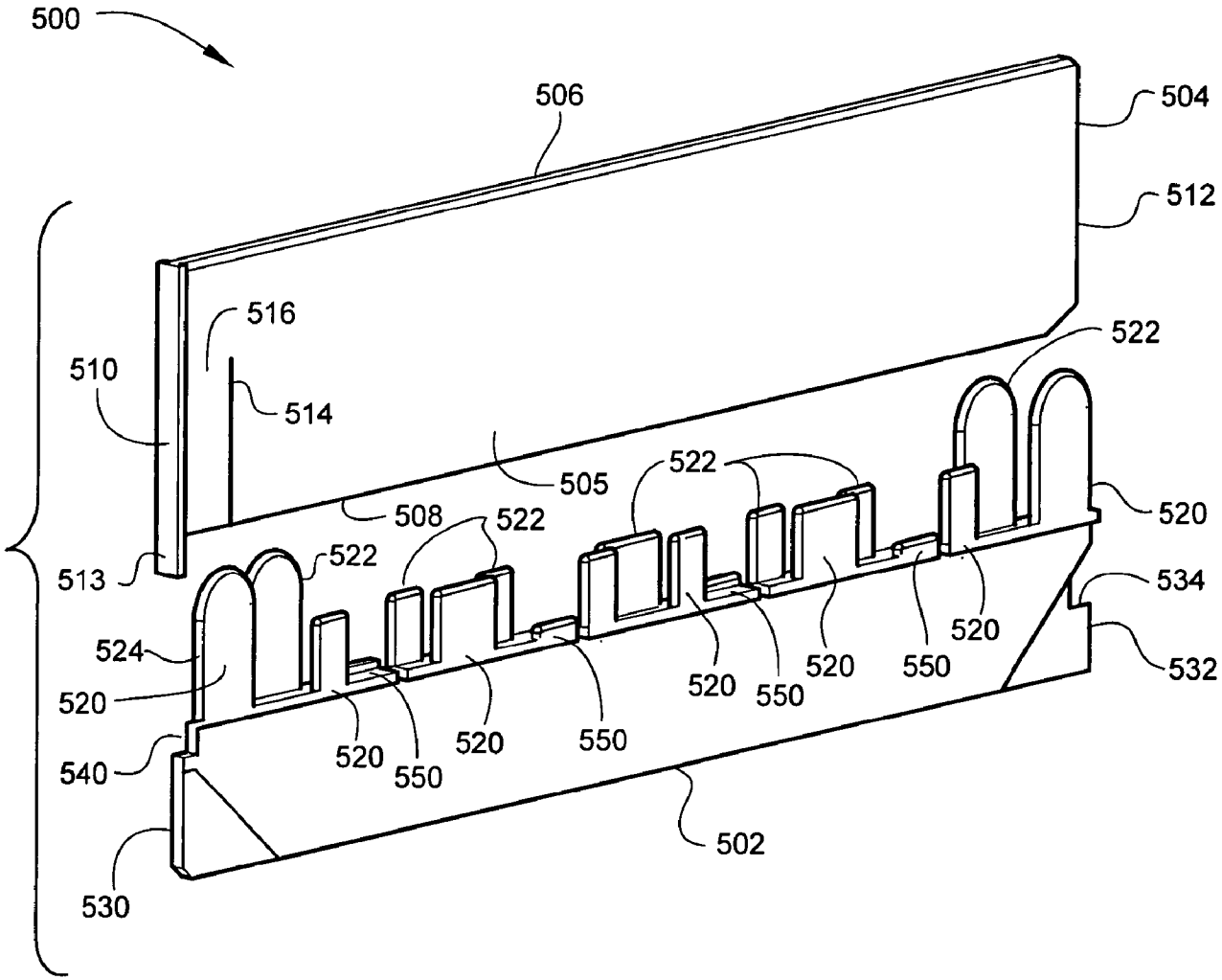
FIG. 34A is an exploded view of a divider member in accordance with another embodiment of the invention.

Referring to FIGS. 1, 2, and 24-34, there is shown divider member 28. Each divider member 28 comprises base member 110 and top member 112 that is removably mounted to base member 110. In a preferred embodiment, top member 112 has a generally planar shape. Base member 110 comprises a lower portion 114 that has distal ends 116 and 118. Distal end 118 has a notch 120. Referring to FIG. 34, distal ends 116 and 118 are sized to be removably inserted into corresponding slots 78 and 79, respectively, of shelf member 26. In a preferred embodiment, distal end 118 is tapered to facilitate insertion into a corresponding slot 79. In order to removably mount a divider member 28 on a shelf member 26, a user first mounts only base member 110 on shelf member 26 by first inserting distal end 118 into a slot 79 of lengthwise end portion 76 and then lowering base member 110 so that distal end 116 is inserted into a corresponding slot 78 (in lengthwise end portion 74) that is coplanar with the aforementioned slot 79 in lengthwise end portion 76.

Referring to FIGS. 1, 2, and 24-34, base member 110 further comprises upper portion 130 that comprises a first plurality of upwardly protruding spaced members 132 positioned along first axis 134 and a second plurality of upwardly protruding spaced members 136 positioned along second axis 138. First and second axes 134 and 138, respectively, are substantially parallel to and offset from each other thereby defining longitudinally extending channel 139. Top member 112 is removably mounted to upper portion 130. Specifically, top member 112 is inserted into longitudinally extending channel 139. Top member 112 includes flanged end portion 140 that contacts upwardly protruding member 132*a* when top member 112 is completely inserted into longitudinally extending channel 139. The height of each upwardly protruding, spaced member 132 and 136 can be varied depending upon the size of top member 112. Furthermore, the distance in which the first and second plurality of upwardly protruding spaced members 132 and 136, respectively, are offset from one another can be varied so as to vary the size of longitudinally extending channel 139 so as to accommodate top members 112 of different sizes.

Figure 32:
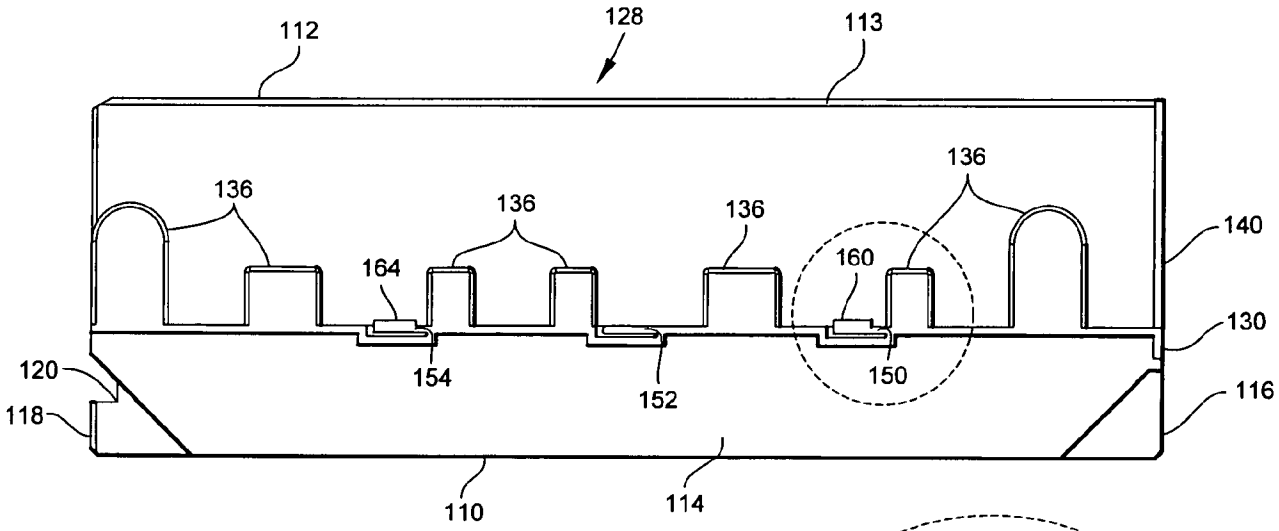
FIG. 32 is a side elevational view of the divider member of FIG. 29 showing the top member removably mounted to the base member such that resilient members, shown in FIGS. 24 and 25, are compressed.

Referring to FIGS. 1, 2 and 24-34, upper portion 130 of base member 110 further comprises resilient members 150, 152 and 154 that have a compressed state and a normal, uncompressed state. Resilient members 150, 152 and 154 are positioned along channel 139. Resilient members 150, 152 and 154 comprise upwardly extending flange portions 160, 162 and 164, respectively. The normal uncompressed state of resilient members 150, 152 and 154 is illustrated in FIGS. 24, 25, 26, 29 and 30. The compressed state of resilient members 150, 152 and 154 is shown in FIGS. 32 and 33. The main purpose of resilient members 150, 152 and 154 is to allow a user to easily insert top member 112 into longitudinally extending channel 139 when base member 110 is already mounted on a shelf member 26 or bottom panel 16 and to allow the completely assembled divider members 28 to be snugly positioned between (i) shelf members 26, (ii) top panel 14 and uppermost shelf member 26*a*, and (iii) bottom panel 16 and lowermost shelf member 26*b* (see FIG. 1). Once top member 112 is completely inserted into channel 139, resilient members 150, 152 and 154 create a slight upward force that pushes top member 112 upward so as to cause top member 112 to completely contact the bottom side of the shelf member or top panel member that is above the top member 112. Flange portions 160, 162 and 164 abut top member 112 when top member 112 is inserted into longitudinally extending channel 139. Specifically, resilient members 150, 152 and 154 compensate for non-uniformity in the height between shelf members 26 or between top panel 14 and uppermost shelf member 26*a* or between lowermost shelf member 26*b* and bottom panel 16 by allowing the height H (see FIG. 30) of each divider member 28 to be varied. Thus, the degree of compression of resilient members 150, 152 and 154, when the divider members 28 are positioned in storage unit 10, may vary depending upon the actual height between shelf members 26 or between top panel 14 and uppermost shelf member 26*a*, or between lowermost shelf member 26*b* and bottom panel 16. The thickness, length and shape of resilient members 150, 152 and 154 can be varied in order to achieve the desired tension.

Referring to FIGS. 1-5, 32, 33 and 34, when each divider member 28 is removably mounted on a shelf member 26, end 118 of base member 110 is inserted into a corresponding slot 79 and end 116 is inserted into a corresponding slot 78 that is substantially coplanar with the aforementioned slot 79. When base member 110 is mounted to shelf member 26, longitudinally extending channel 139 is substantially aligned with a corresponding laterally extending axis 104 of the shelf member 26 that is positioned above the divider member 28. Top member 112 is then inserted into the longitudinally extending channel 139 of base member 110. As top member 112 is being slid into longitudinally extending channel 139, top edge portion 113 of top member 112 is substantially aligned with a corresponding axis 104 of the shelf member 26 that is above the divider member 28. As top member 112 slides into the interior of storage unit 10, top edge portion 113 slides between protruding members 102*a* and 102*b*, and between protruding members 100*a* and 100*b*. When top member 112 is completely inserted into longitudinally extending channel 139, flanged edge portion 140 abuts protruding member 132*a*, and resilient members 150, 152, and 154 are compressed to a degree that depends upon the actual height between that particular shelf member 26 and the shelf member 26 directly above the aforementioned particular shelf member. The resilient members 150, 152 and 154 ensure that the top edge portion 113 of top member 112 firmly abuts bottom side 72 of the upper shelf member 26 and that top edge 113 stays between protruding members 100*a* and 100*b* and between protruding members 102*a* and 102*b*. Divider members 28 are positioned between bottom panel 16 and lowermost shelf member 26*b* in the same manner as described in the foregoing description. When divider members 28 are to be positioned between uppermost shelf member 26*a* and top panel 14, base member 110 is mounted to shelf member 26*a* in the same manner as described above. However, when top member 112 is inserted into longitudinally extending channel 139, top edge portion 113 of top member 112 is inserted into a corresponding one of slots 38 of rail member 36 (see FIGS. 3-5) that is substantially coplanar with the longitudinally extending channel 139. Resilient members 150, 152 and 154 function in the same manner as described above and cause top member 112 to be snugly positioned within a corresponding slot 38 of rail member 36. FIG. 14 shows a plurality of divider members 28 equidistantly positioned within storage unit 10 to provide a plurality of openings or compartments 30 having the same size. It is to be understood that divider members 28 can be positioned so as to provide a plurality of openings or compartments 30 that have different sizes. Such a configuration provides a user with the option of utilizing drawers of different sizes in the spaces or compartments 30. This is illustrated in FIG. 14.

Divider member 28 can be fabricated from a variety of materials, e.g. plastic, rubber, metal, etc. Furthermore, top member 112 can be fabricated from metal, wood, plastic, rubber, etc.

Figure 36:
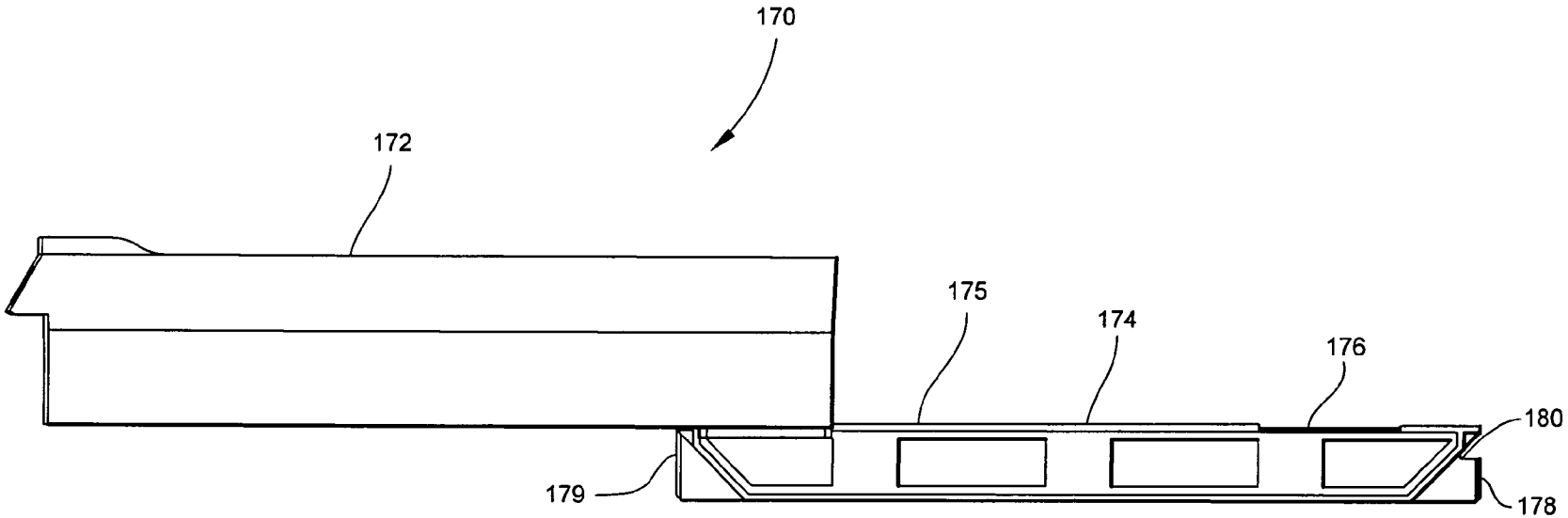
FIG. 36 is a side elevational view of the drawer assembly of FIG. 35 showing movement of the drawer relative to the drawer support member.
Figure 36A:
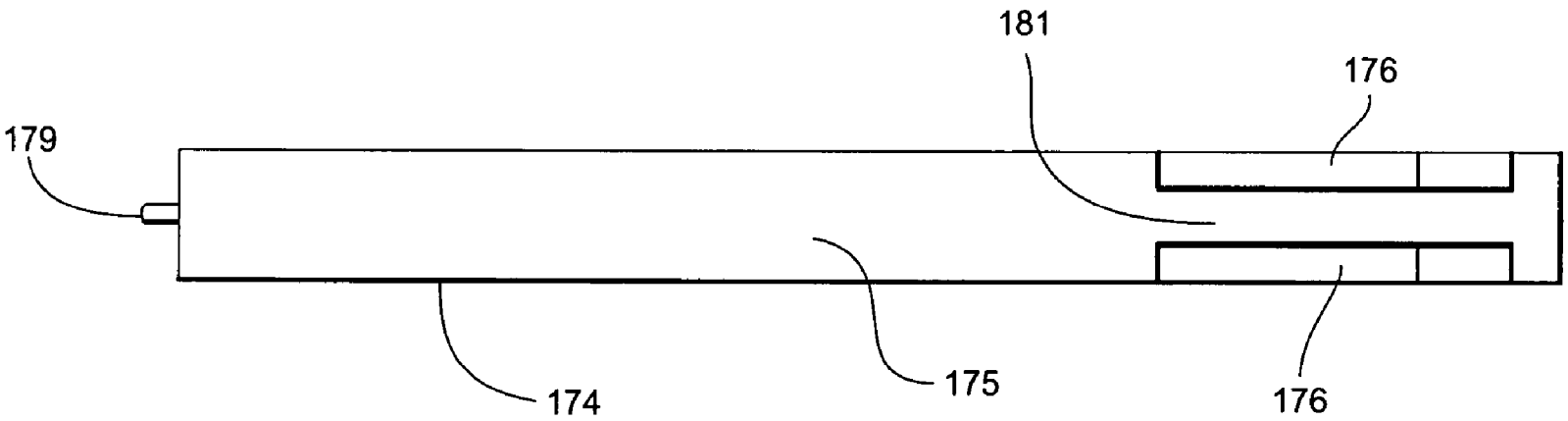
FIG. 36A is a plan view of the drawer support member shown in FIG. 35.
Figure 37:
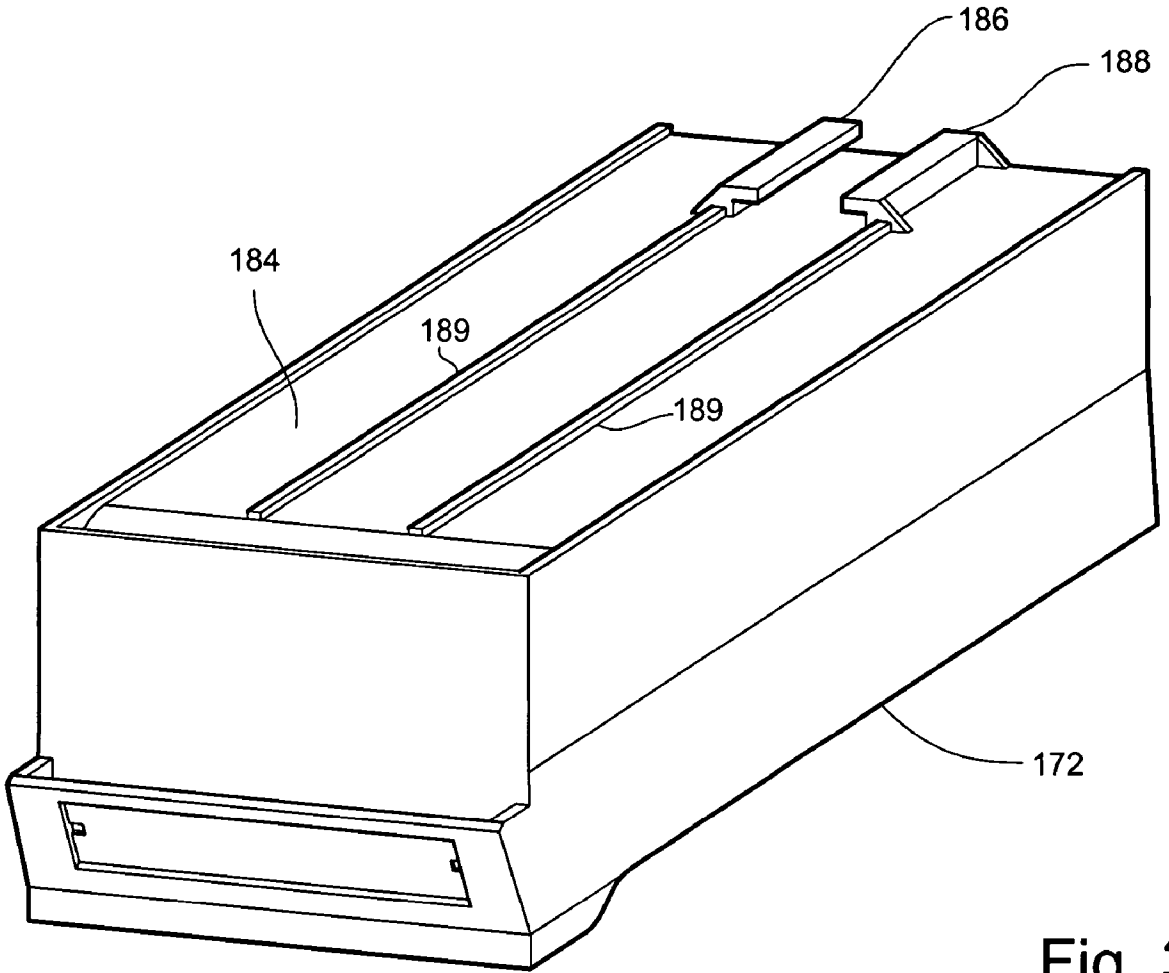
FIG. 37 is a perspective view of the underside of the drawer shown in FIG. 35.

Referring to FIGS. 35-38, there is shown drawer assembly 170 that can be used with storage unit 10 of the present invention. Drawer assembly 170 comprises drawer 172 which has compartment 173. Drawer assembly 170 further comprises drawer support member 174. Drawer 172 is slidably attached to drawer support member 174 thereby allowing drawer 172 to slide with respect to drawer support member 174. Drawer support member 174 includes top surface portion 175, cut-outs 176, and distal end portions 178 and 179. Drawer support member 174 includes cut-out or notch 180 that is adjacent distal end portion 178. Cut-outs 176 form relatively narrow portion 181 of top surface portion 175. As shown in FIG. 37, drawer 172 includes bottom side 184 and a pair of opposing extending engagement members 186 and 188. In a preferred embodiment, drawer 172 includes parallel tracks 189 that extend from engagement members 186 and 188 along the bottom side 184 of drawer 172. Narrow portion 181 of drawer support member 174 is sized to fit between, but not under, engagement members 186 and 188. In order to movably mount drawer 172 on drawer support member 174, narrow portion 181 is first positioned between engagement members 186 and 188. Next, drawer 172 is moved with respect to drawer support member 174 so that the wider portion of top surface portion 175 slides between tracks 189 and under engagement members 186 and 188, as shown in FIG. 36. Once the wider portion of top surface portion 175 is slidably positioned under engagement members 186 and 188, drawer 172 can slide upon top surface portion 175 and extend out of storage unit 10 without tipping or falling out of storage unit 10. In order to disengage drawer 172 from drawer support member 174, drawer 172 is moved relative to drawer support member 174 so that relatively narrow portion 181 becomes aligned with engagement members 186 and 188. Once relatively narrow portion 181 becomes aligned with engagement members 186 and 188, drawer 172 can be dismounted from drawer support member 174.

Figure 38:
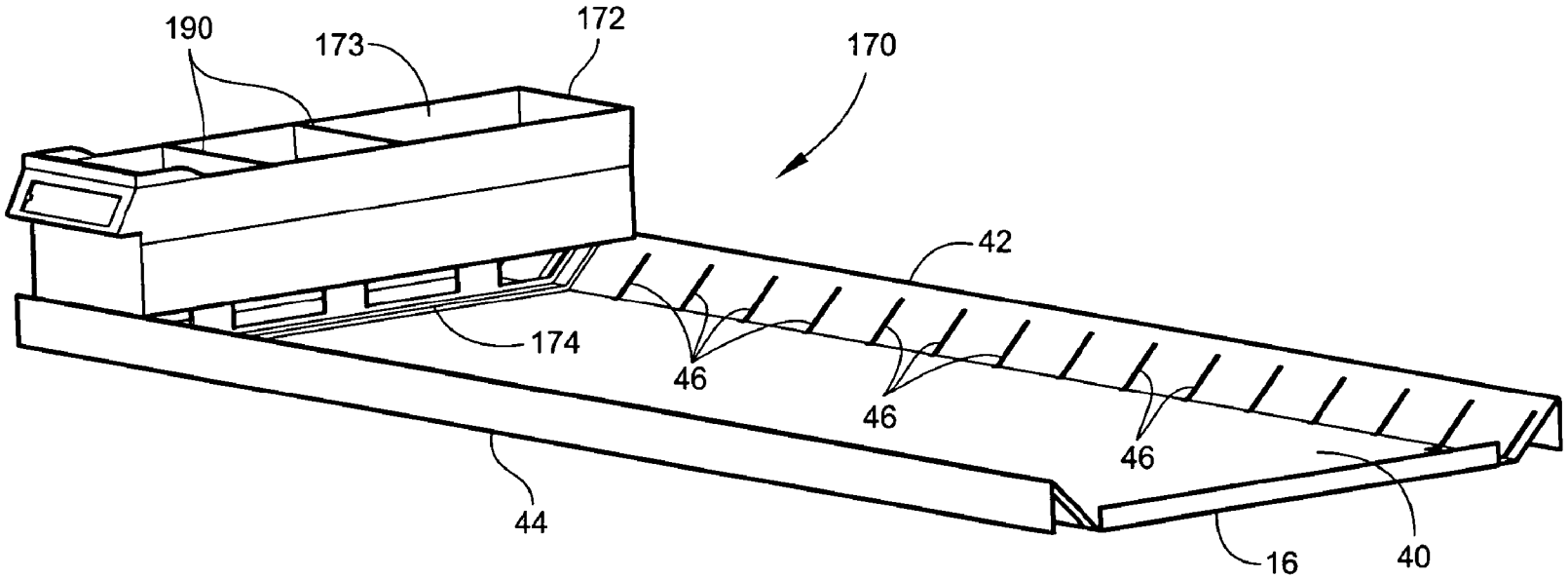
FIG. 38 is a perspective view showing the drawer assembly of FIG. 35 removably mounted to a shelf member.

In order to mount drawer assembly 170 to bottom panel 16, the user first grasps drawer assembly 170 and inserts end portion 178 into a predetermined slot 46 in lengthwise end portion 42 in such a manner that notch 180 engages the perimetrical edge of the slot 46. Next, the user then lowers the opposite end of drawer assembly 170 so that distal end 179 is inserted into a corresponding slot 47 of lengthwise end portion 44. FIG. 38 shows drawer assembly 170 mounted on bottom panel 16. It is to be understood that drawer assembly 170 is mounted on shelf member 26 in the same manner in which drawer assembly 170 is mounted on bottom panel 16. Drawer 172 includes compartment dividers 190 that are movably positioned within compartment 173. This feature is further described in the ensuing description.

Figure 39:
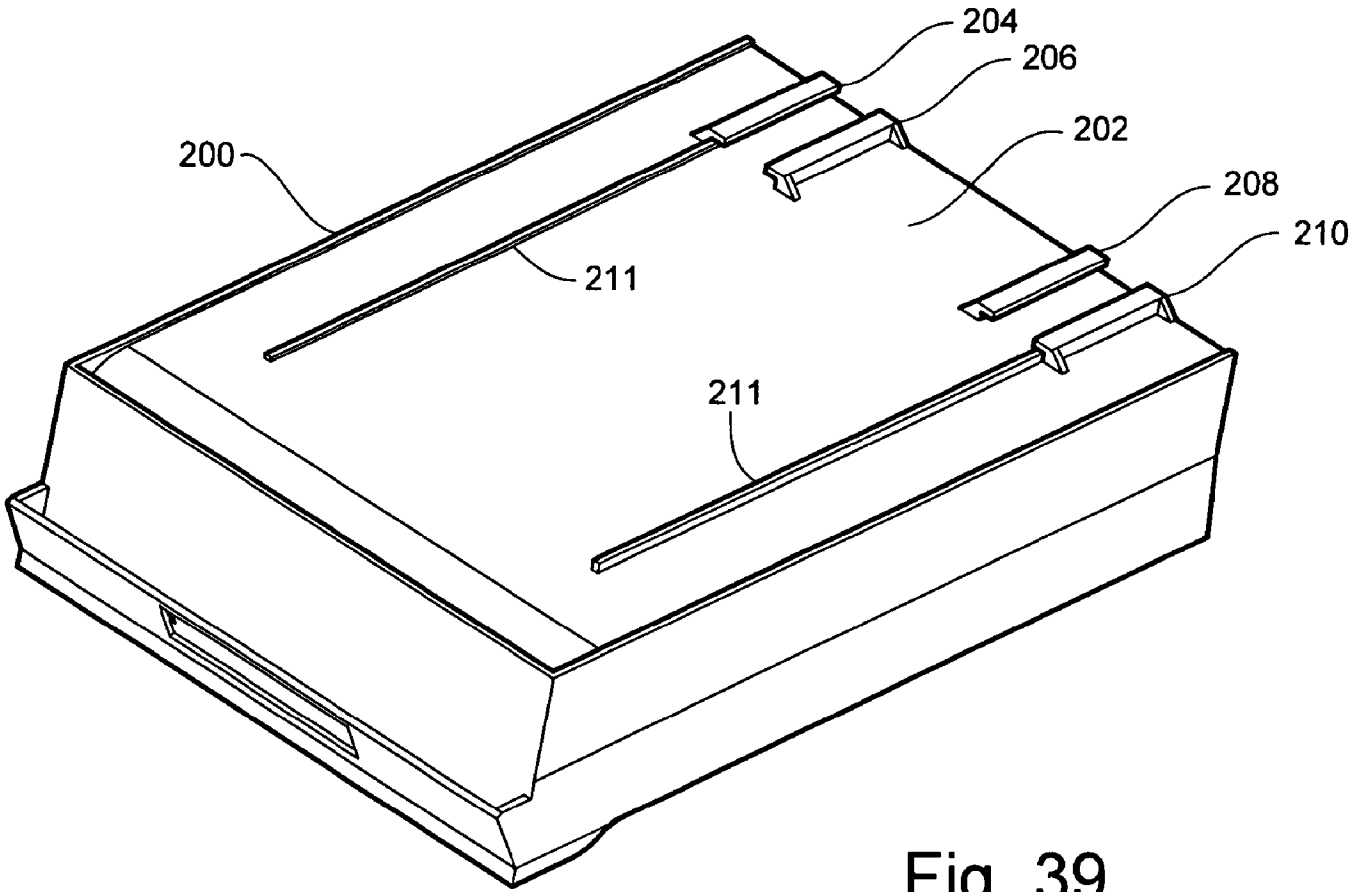
FIG. 39 is a perspective view of the underside of a relatively larger size drawer.
Figure 40:
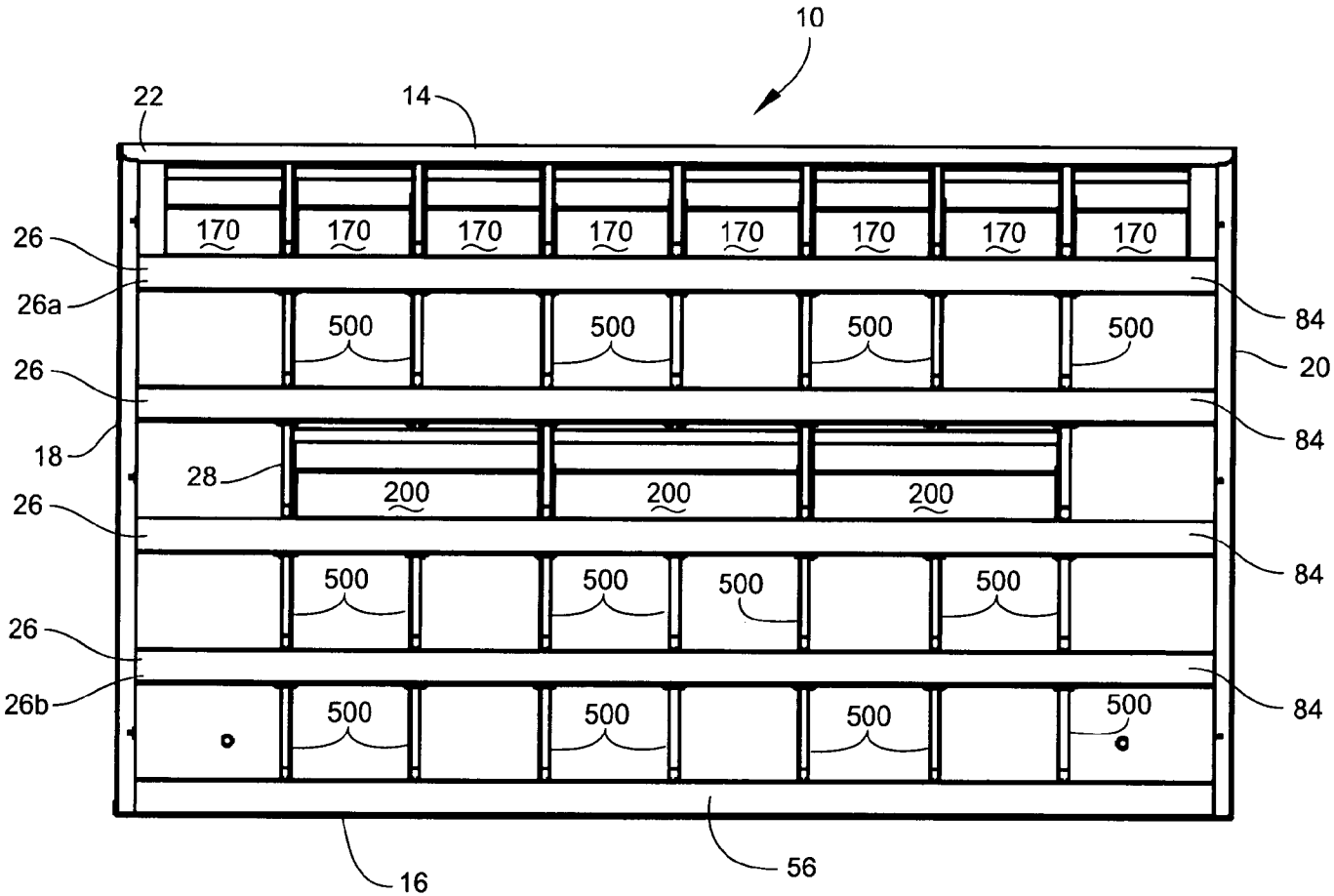
FIG. 40 is a side-elevational view of the storage unit of FIG. 1 having a plurality of drawers movably disposed therein.
Figure 42:
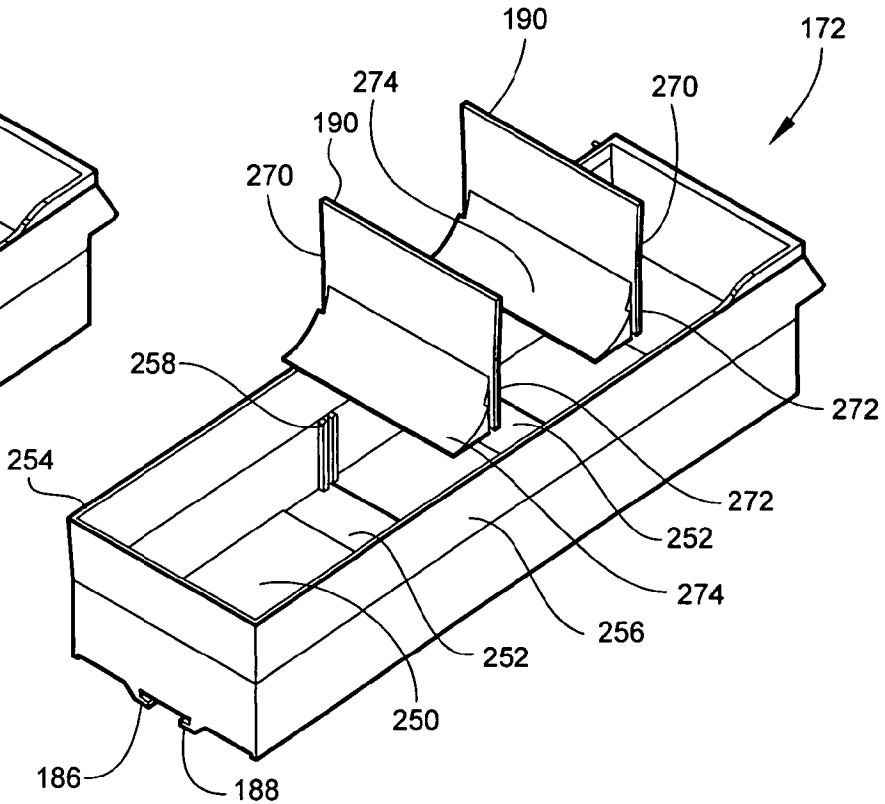
FIG. 42 is an exploded view, in perspective, of the drawer of FIG. 41.
Figure 41:
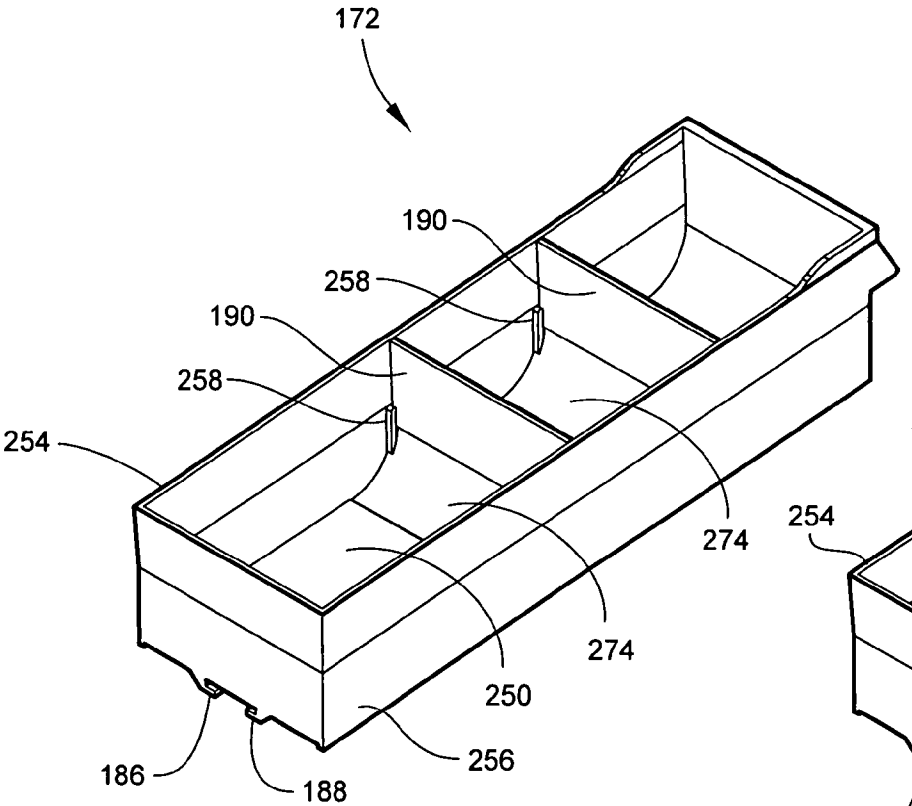
FIG. 41 is a perspective view of the drawer shown in FIG. 35.
Figure 43:
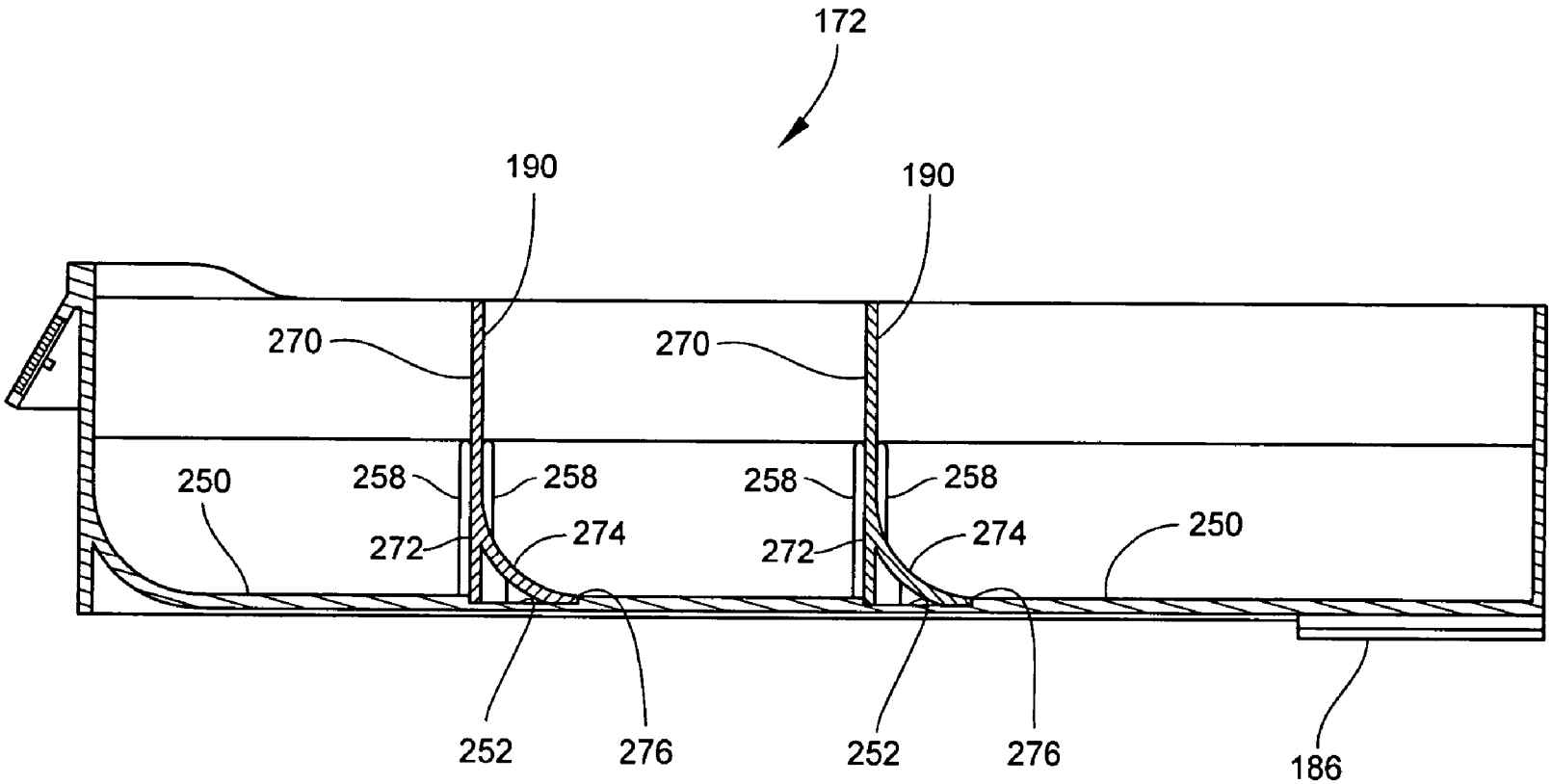
FIG. 43 is a cross-sectional view of the drawer of FIG. 41.
Figure 45:
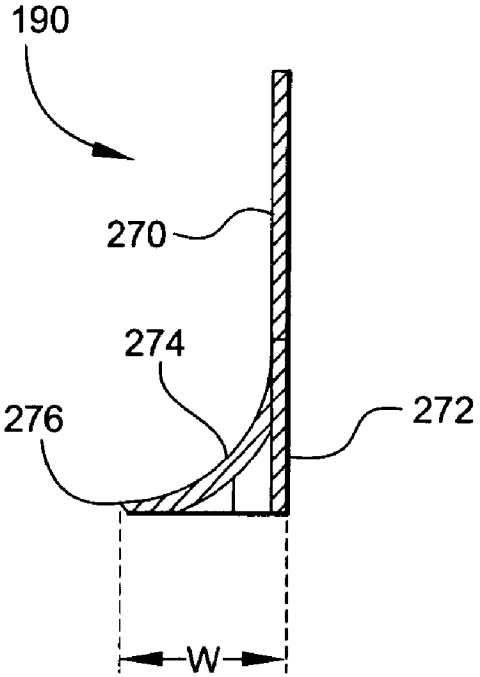
FIG. 45 is a cross-sectional view of the compartment divider of FIG. 44.
Figure 44:
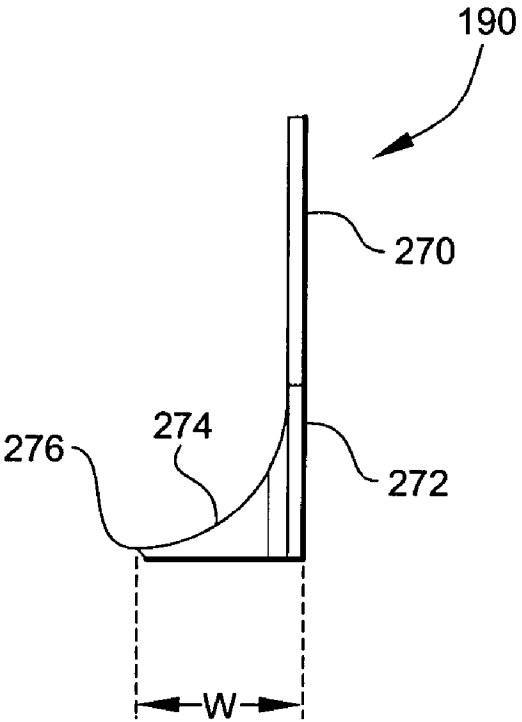
FIG. 44 is a side elevational view of a compartment divider depicted in FIGS. 41 and 42.

Referring to FIGS. 14 and 39, storage unit 10 can be configured to utilize drawers of varying sizes. This is accomplished by positioning divider members 28 so to form openings or compartments 30 of varying sizes so as to receive drawers of varying sizes. Referring to FIG. 39, drawer 200 includes bottom side 202, a first pair of engagement members 204 and 206, a second pair of engagements 208 and 210, and a pair of parallel tracks 211. Each pair of these engagement members function in the same manner as engagement members 186 and 188 described in the foregoing description. Thus, each drawer 200 is slidably mounted upon a pair of drawer support members (not shown, but each of which being substantially the same as drawer support member 174). Tracks 211 both function as guides and allows the drawer 200 to slide upon the drawer support members (not shown) with steady movement. Drawer 200 also includes a storage compartment and compartment dividers movably positioned within the storage compartment. Although two sizes of drawers (e.g. drawers 172 and 200) are shown, it is to be understood that divider members 28 can be positioned so as to provide openings or compartments 30 having different sizes such that more than two different sizes of drawers can be used in storage unit 10.

Referring to FIGS. 41-45, each drawer 172 has an interior bottom portion 250. Recesses 252 are formed in bottom portion 250. Drawer 172 further includes side walls 254 and 256 and guide members 258 that are attached to side walls 254 and 256. Guide members 258 define tracks for receiving portions of compartment dividers 190. Each compartment divider 190 has an upper portion 270 and lower portion 272. Lower portion 272 includes curved portion 274 that extends to end 276 (see FIGS. 43, 44 and 45). Lower portion 272 has a width W that is sized for placement within a recess 252 in bottom portion 250. The placement of lower portion 272 within a recess 252 and the placement of upper portion 270 between guide members 258 cooperate to provide firm and snug placement of compartment divider 190 within the interior of drawer 172.

Figure 47:
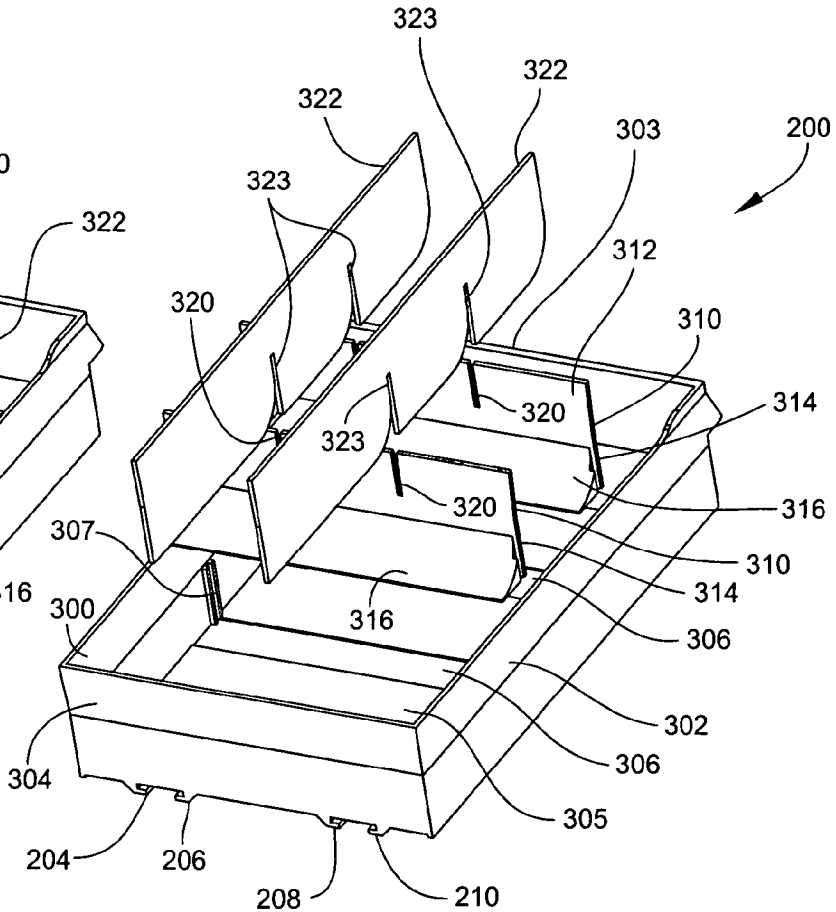
FIG. 47 is an exploded view, in perspective, of the drawer shown in FIG. 46.
Figure 46:
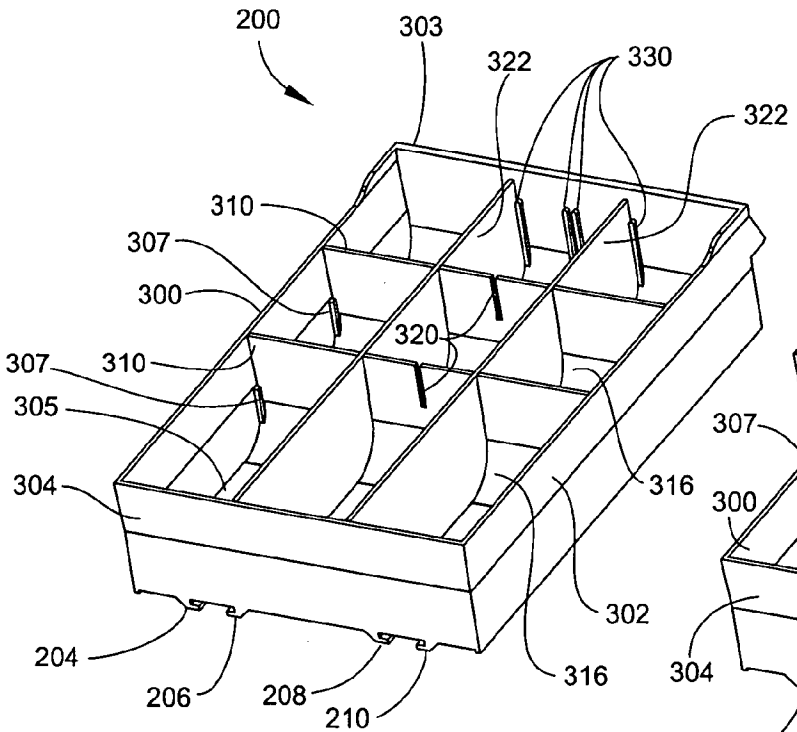
FIG. 46 is a perspective view of the drawer shown in FIG. 39 as seen from the rear of the drawer.
Figure 46A:
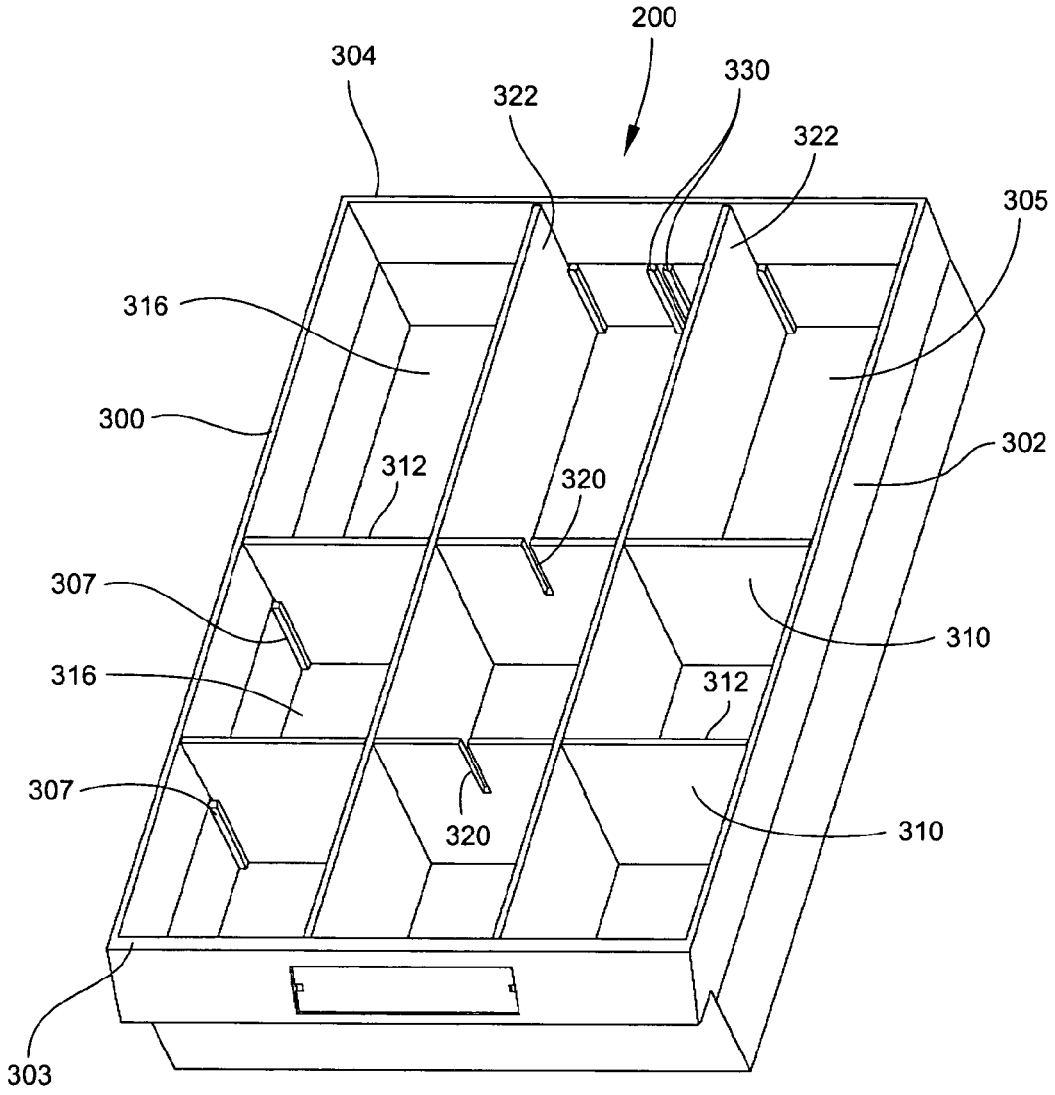
FIG. 46A is a perspective view of the drawer shown in FIG. 39 as seen from the front of the drawer.
Figure 47A:
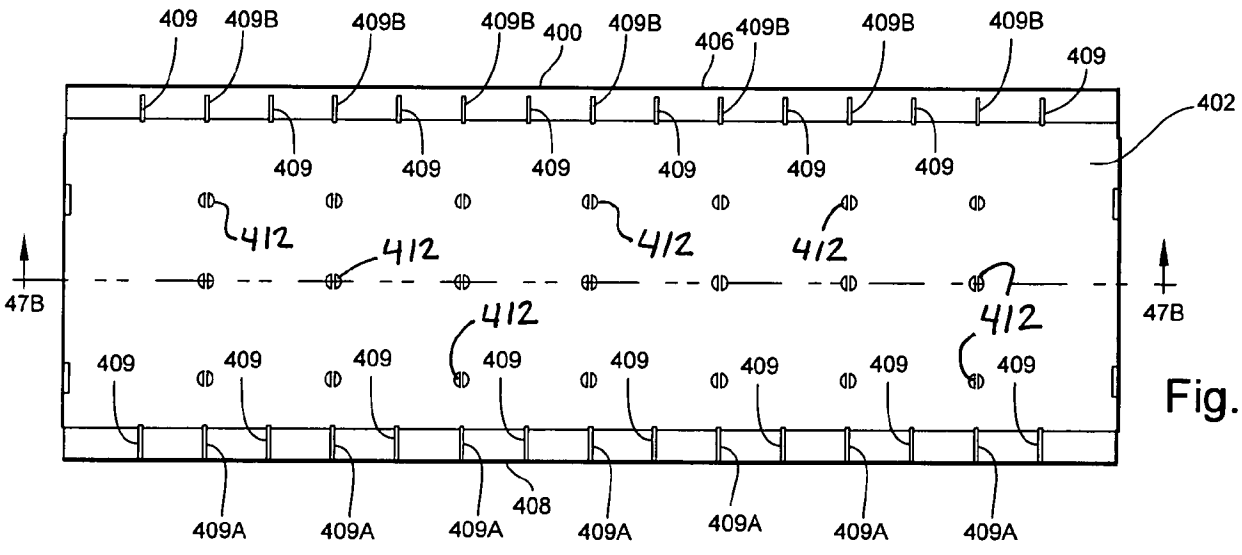
FIG. 47A is a plan view of a shelf member in accordance with another embodiment of the present invention.
Figure 47B:
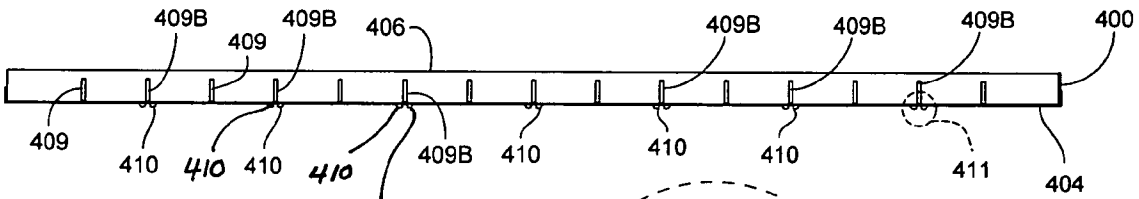
FIG. 47B is a cross-sectional view taken along line 47B-47B of FIG. 47A.
Figure 47C:
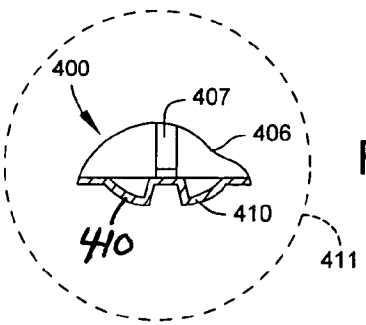
FIG. 47C is an enlarged view of a portion of the view in FIG. 47B.

Referring to FIGS. 46, 46A and 47, there is shown drawer 200 which was described in the foregoing description. Each drawer 200 comprises side walls 300 and 302, front wall 303, rear wall 304 and bottom surface 305. Bottom surface 305 includes recesses 306. Each drawer 200 includes guide members 307 that are attached to side walls 300 and 302. Guide members 307 have the same function as guide members 258 described in the forgoing description. Compartment dividers 310 are removably positioned within the interior of each drawer 200 in the same manner as compartment dividers 190 are removably positioned within the interior of each drawer 172. Each compartment divider 310 has generally the same structure as compartment divider 190. Specifically, each compartment divider 310 has top portion 312 and bottom portion 314. Bottom portion 314 includes curved portion 316. Bottom portion 314 is sized for placement in a recess 306. Guide members 307 define tracks for receiving portions of compartment divider 310. The placement of bottom portion 314 within a recess 306 and the placement of top portion 312 between guide members 307 cooperate to provide firm and snug placement of compartment divider 310 within the interior of drawer 200. Each compartment divider 310 includes slots 320 formed in the upper portion 312. Slots 320 are sized to receive portions of divider member 322. Each divider member 322 has a plurality of slots 323 that engage slots 320 of compartment divider 310. Divider members 322 cooperate with compartment dividers 310 to form a plurality of smaller size compartments suitable for storing small size components or objects. Guide members 330 are attached to front and rear walls 303 and 304, respectively, and define tracks for receiving portions of divider member 322. Compartment divider 310 can be configured to include a plurality of slots 320 to provide the user with options as to the placement of divider member 322.

Storage unit 10 can be fabricated from a variety of materials. In a preferred embodiment, divider members 28 and drawer assemblies 170 and 200 are fabricated from plastic and the remaining components of storage unit 10 are fabricated from metal. However, other suitable materials can be used.

Figure 34B:
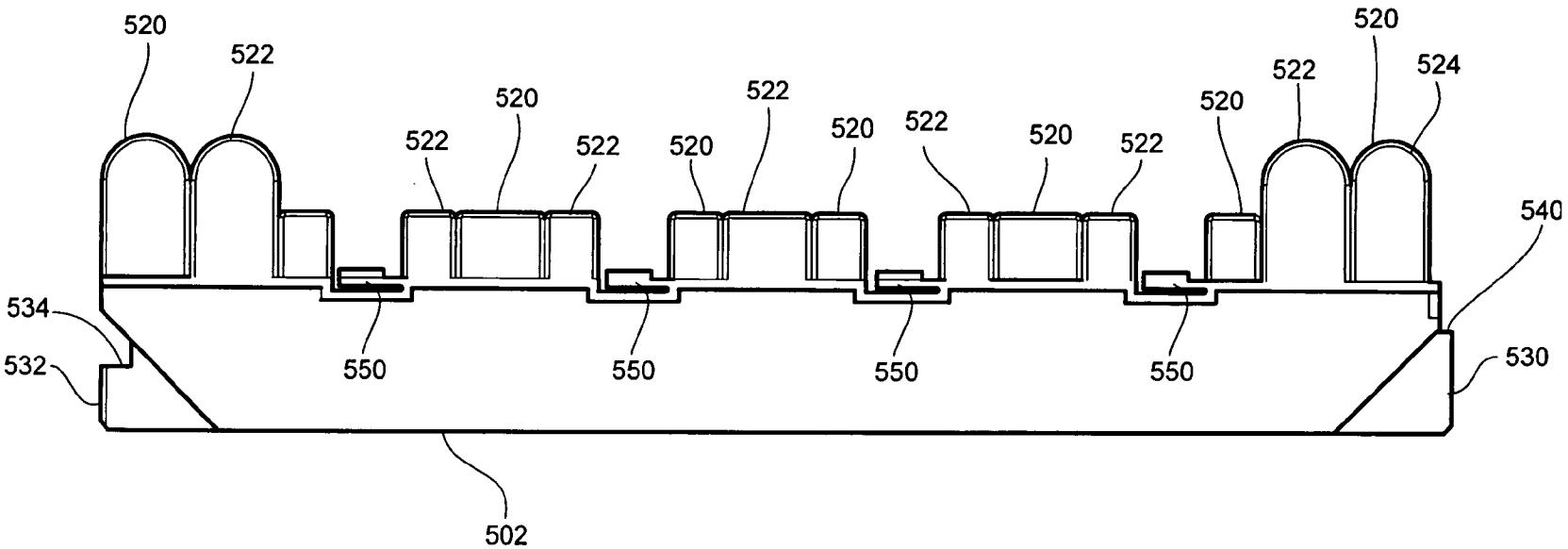
FIG. 34B is a side-elevational view of a bottom member of the divider member of FIG. 34A.
Figure 34C:
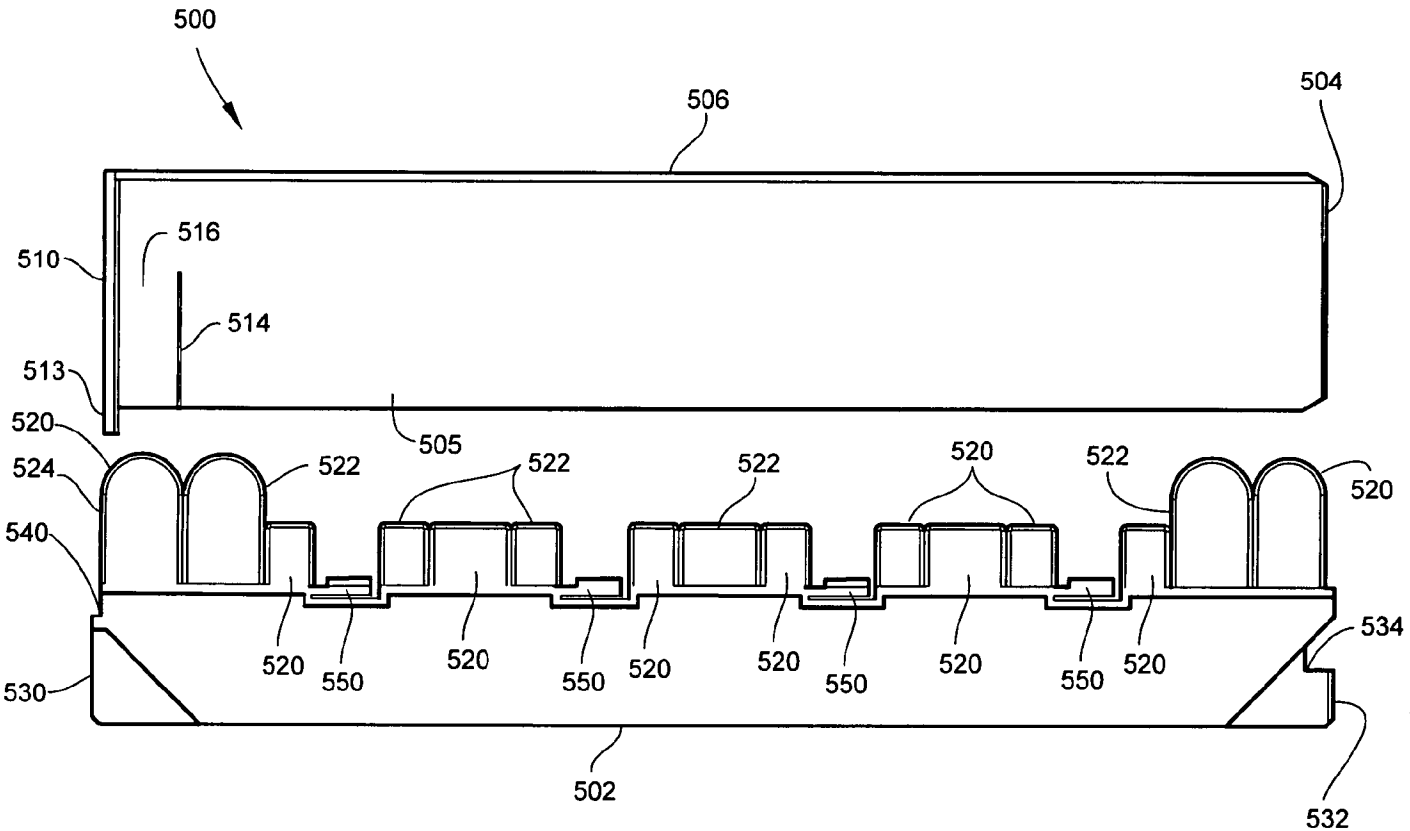
FIG. 34C is an exploded, side elevational view showing the interconnection between the bottom member and a top member of the divider member of FIG. 34A.
Figure 34D:
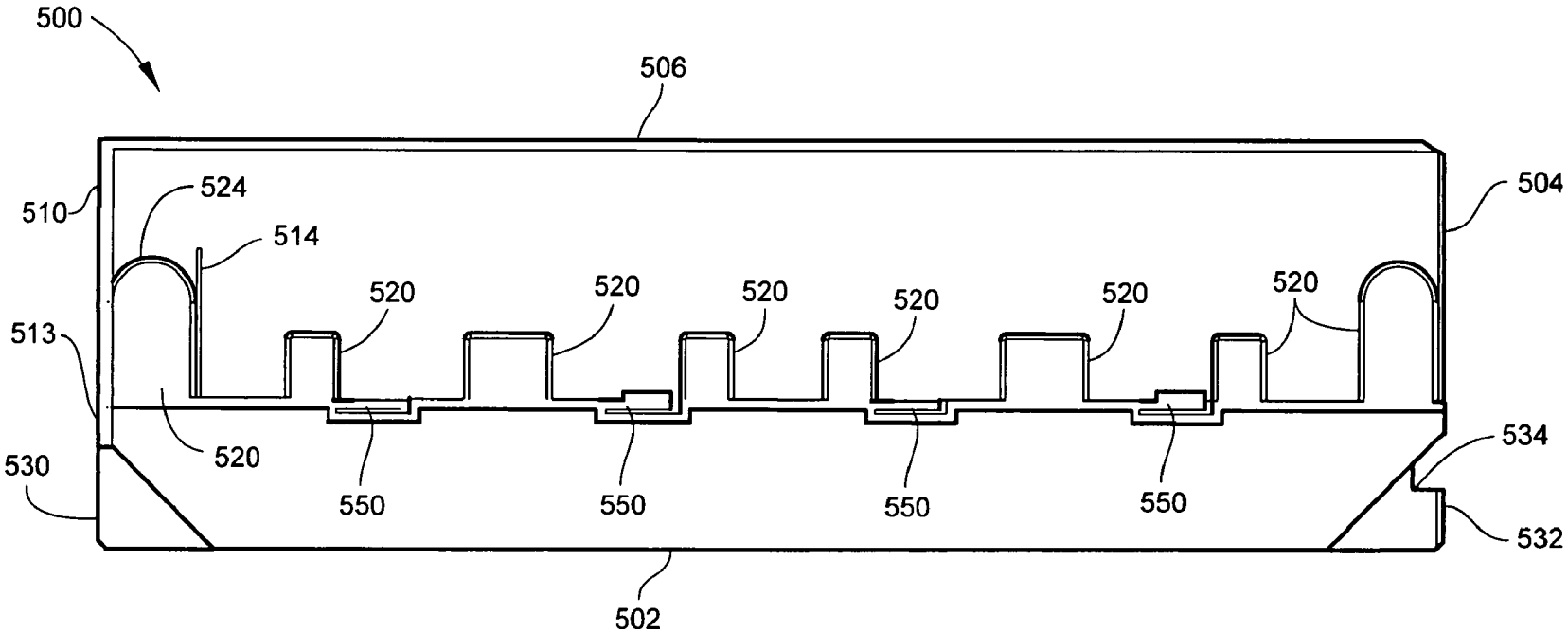
FIG. 34D is a side elevational view illustrating the top and bottom members of FIG. 34C removably attached together.

Referring to FIGS. 34A, 34B, 34C, 34D and 40, there is shown alternate divider member 500 in accordance with another embodiment of the present invention. Divider member 500 has the same purpose as divider member 28 described in the foregoing description. Divider member 500 has generally the same configuration as divider member 28 with the exception of a few structural modifications. Divider member 500 generally comprises base member 502 and top member 504. In a preferred embodiment, top member 504 has generally planar opposed sides, one of which being side 505 and the other side not being shown. Top member 504 has top lengthwise end 506 and bottom lengthwise end 508. In a preferred embodiment, top lengthwise end 506 is beveled so as to facilitate placement between the protruding members (e.g. members 100*a*, 100*b*, 102*a*, 102*b*) that extend downward from the bottom side of each shelf member 26. Top member 504 further comprises front end 510 and rear end 512. In a preferred embodiment, front end 510 is flanged. Front end 510 includes extending portion 513 which extends downward beyond bottom lengthwise end 508. Top member 504 includes guide member 514 that is attached to side 505. Guide member 514 extends generally parallel to flanged front end 510. The portion of side 505 that is between flanged front end 510 and guide member 514 is indicated by reference numeral 516. Guide member 514 can be attached to side 505 or integrally formed during the manufacturing process of top member 504. The purpose of guide member 514 and portion 516 will be explained in the ensuing description. Base member 502 is generally the same in construction as base member 110 described in the foregoing description pertaining to divider member 28. Base member 502 includes a first plurality of upwardly protruding spaced members 520 positioned along a first axis and a second plurality of upwardly protruding spaced members 522 positioned along a second axis. The aforementioned first and second axes function in the same manner as axes 134 and 138 (see FIG. 27) and are substantially parallel to and offset from each other thereby defining a longitudinally extending channel. This longitudinally extending channel has the same purpose and function as longitudinally extending channel 139 shown in FIG. 27 and described in the foregoing description. A first one of the upstanding protruding members 520 is indicated by reference numeral 524. Protruding member 524 is sized so as to snugly fit between flanged front end 510 and guide member 514 when top member 504 is attached to base member 502 as shown in FIG. 34D. Referring to FIGS. 34B and 34C, base member 502 has distal ends 530 and 532 which function in substantially the same manner as distal ends 116 and 118, respectively, of base member 110 (see FIG. 26). Notch 534 is located adjacent to distal end 532 and functions in the same manner as notch 120 of base member 110. Distal end 530 includes a stepped portion 540 that is sized for receiving extending portion 513 of flanged front end 510 when top member 504 and base member 502 are attached together as shown in FIG. 34D. Base member 502 further includes resilient members 550 that have the same purpose, function and configuration as resilient members 150, 152 and 154 described in the foregoing description.

Figure 34E:
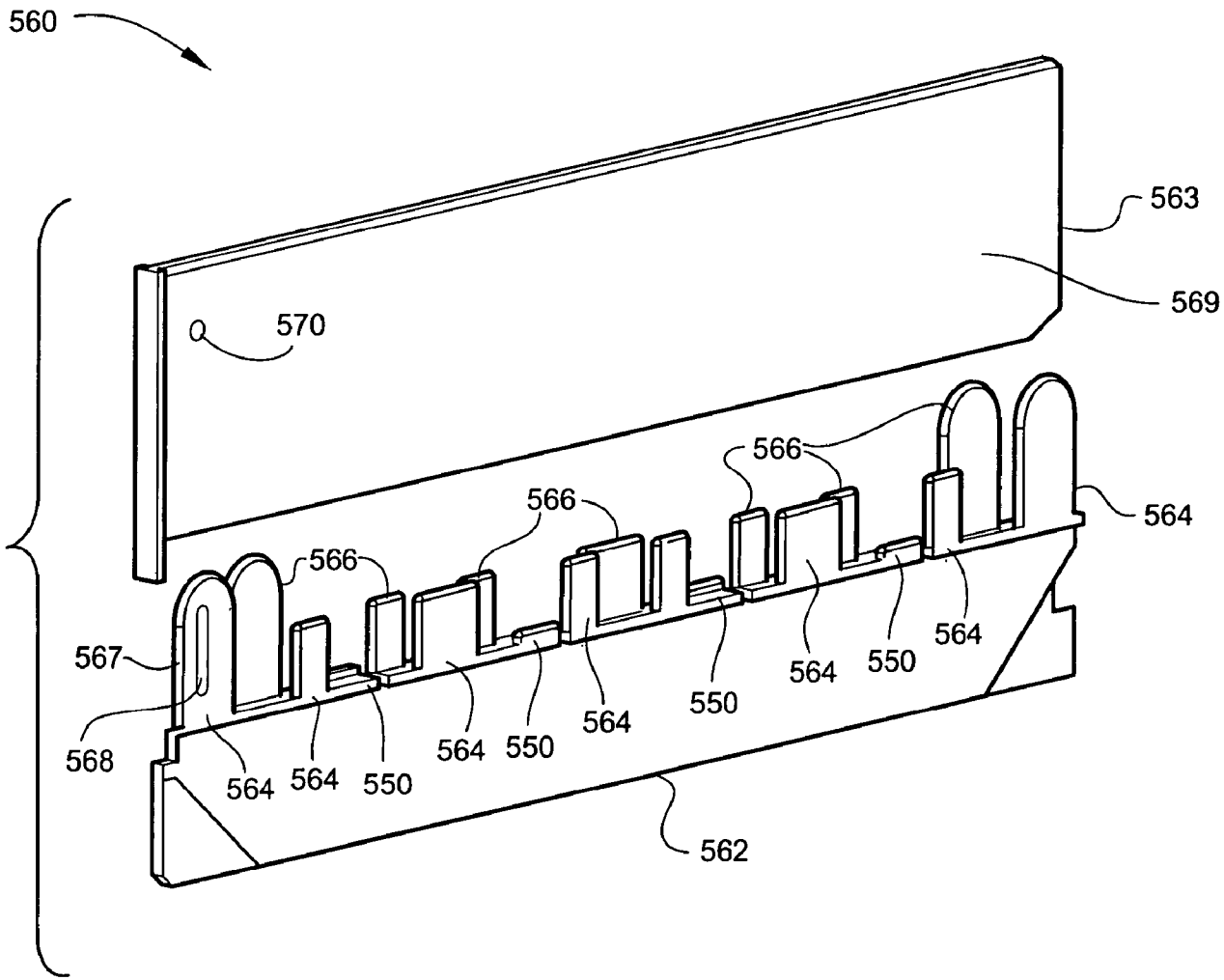
FIG. 34E is a perspective view of a divider member in accordance with a further embodiment of the present invention.
Figure 35:
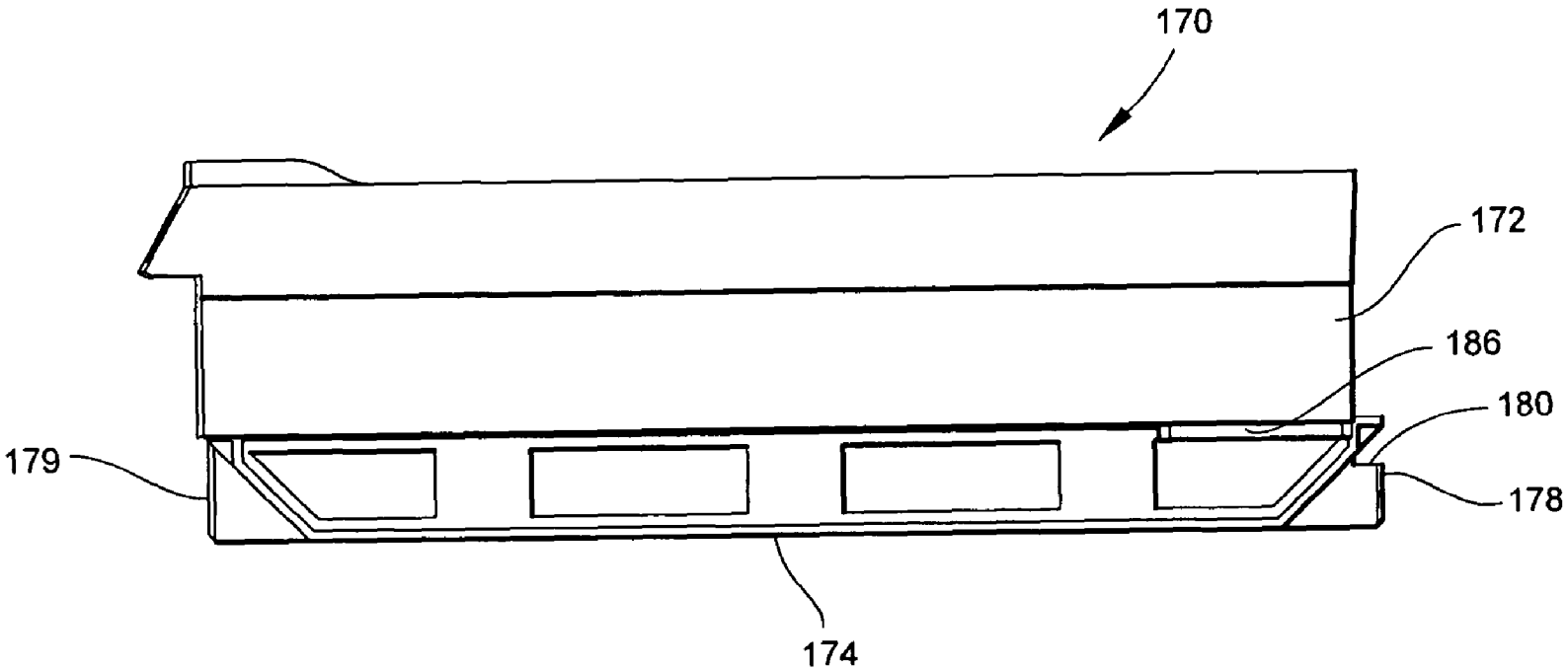
FIG. 35 is a side elevational view of a drawer assembly having a drawer and a drawer support member.

Referring to FIG. 34E, there is shown divider member 560 in accordance with a further embodiment of the invention. Divider member 560 has the same purpose as divider members 28 and 500 described in the foregoing description. Divider member 560 has generally the same configuration as divider member 500 with the exception of a few structural modifications. Divider member 560 generally comprises base member 562 and top member 563. Base member 562 includes a first group of upwardly protruding spaced members 564 that have the same purpose as protruding spaced members 520 shown in FIG. 34A. Base member 562 further includes a second group of upwardly protruding spaced members 566 that have the same purpose as protruding spaced members 522. A first one of the upwardly protruding members 564 is indicated by reference numeral 567. Upwardly protruding member 567 includes a generally vertically extending slot 568. Top member 563 includes side 569 and a protruding member or tab 570 that protrudes from side portion 569. Tab 570 is sized for insertion into slot 568. As top member 563 is being mounted to base member 562, tab 570 frictionally moves along the surface of front, upwardly protruding member 567 until tab 570 snaps into slot 568. Top member 563 is prevented from being dismounted from base member 562 when tab 570 is positioned in slot 568. In order to remove top member 563 from base member 562, the user gently pries upwardly protruding member 567 away from side 569 so as to facilitate removal of tab 570 from slot 568.

Figure 48:
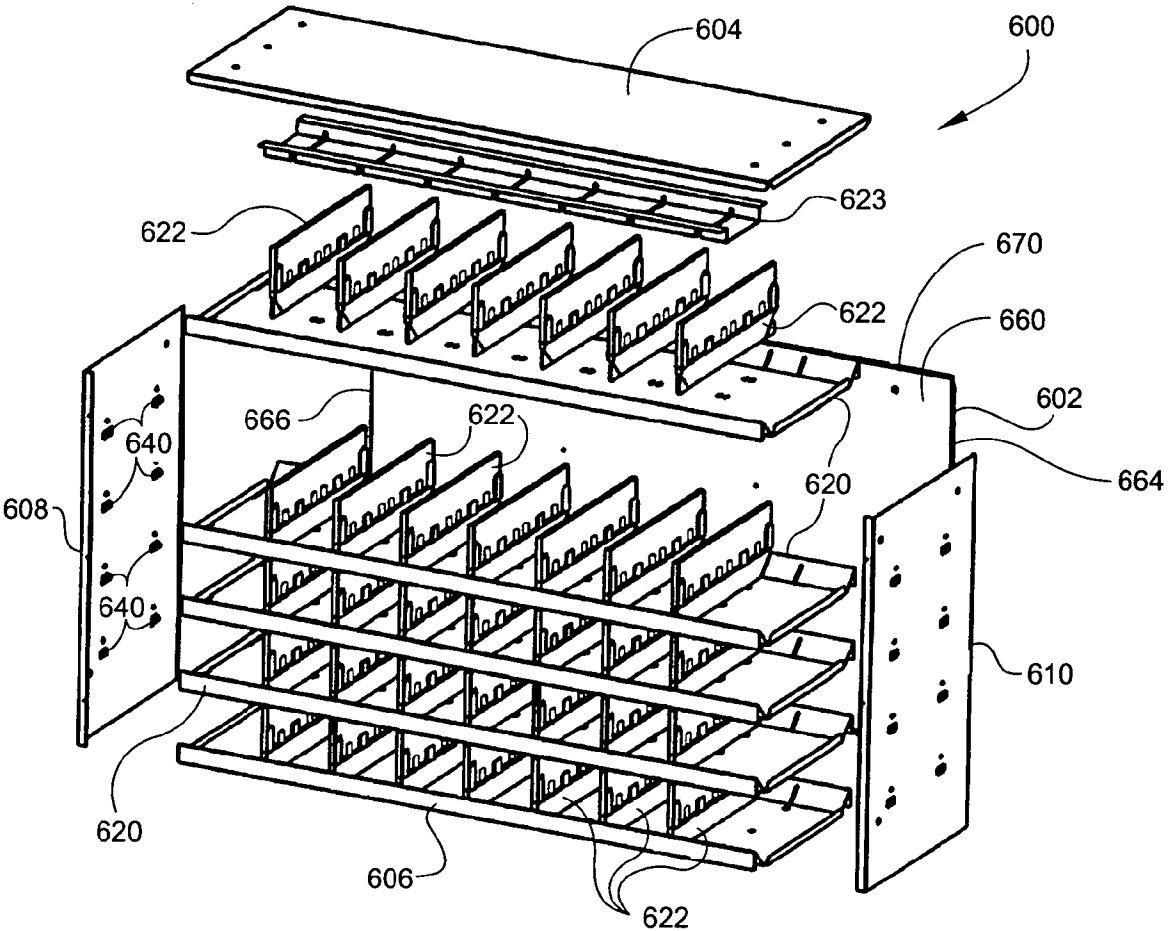
FIG. 48 is an exploded view of a storage unit in accordance with a further embodiment of the present invention.
Figure 48A:
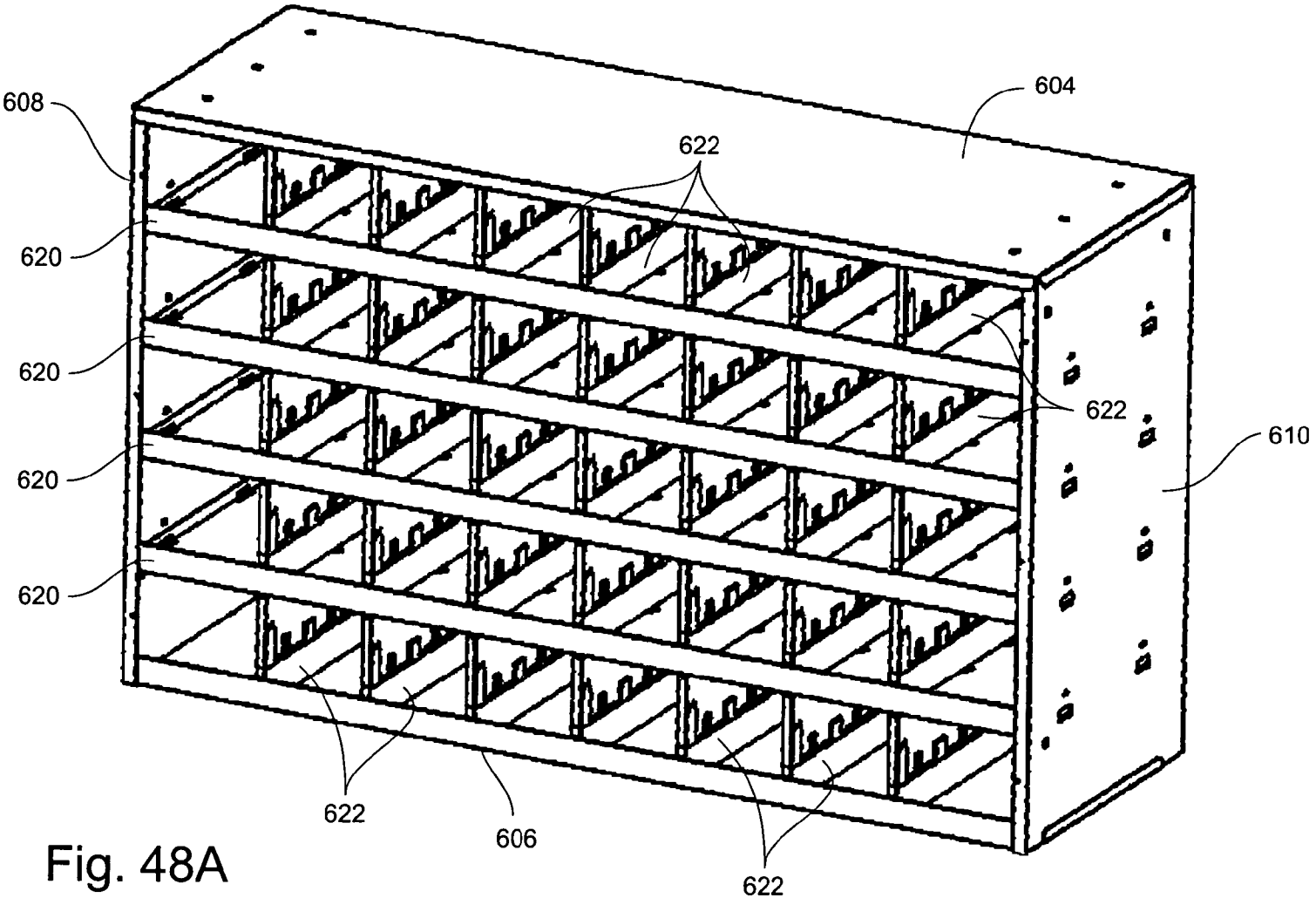
FIG. 48A is a perspective view of the storage unit of FIG. 48 completely assembled.
Figure 49A:
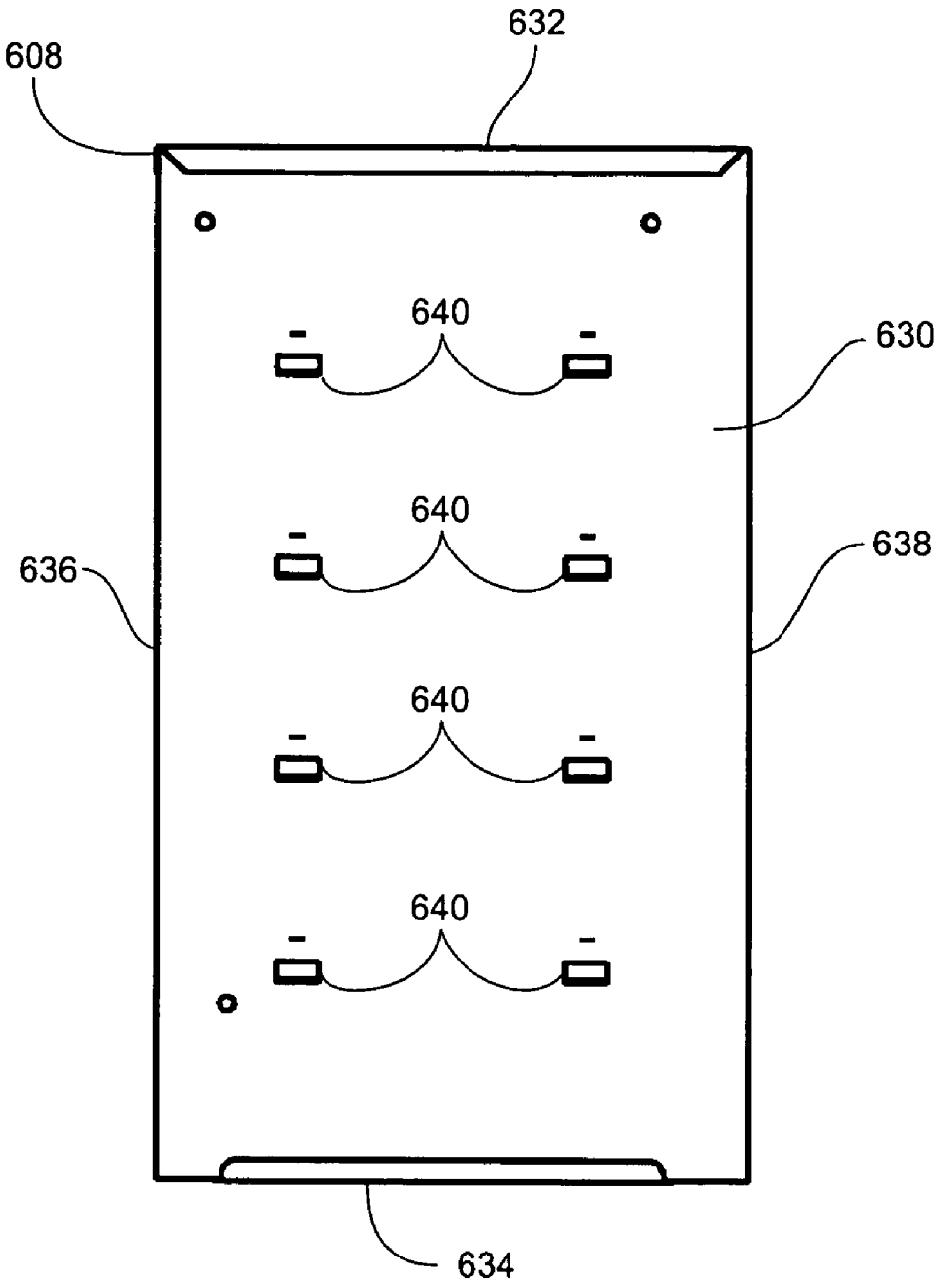
FIG. 49A is a side elevational view of a side panel shown in FIGS. 48 and 48A.
Figures 49B, 49C, 49D, 49E, 49F, 49G:
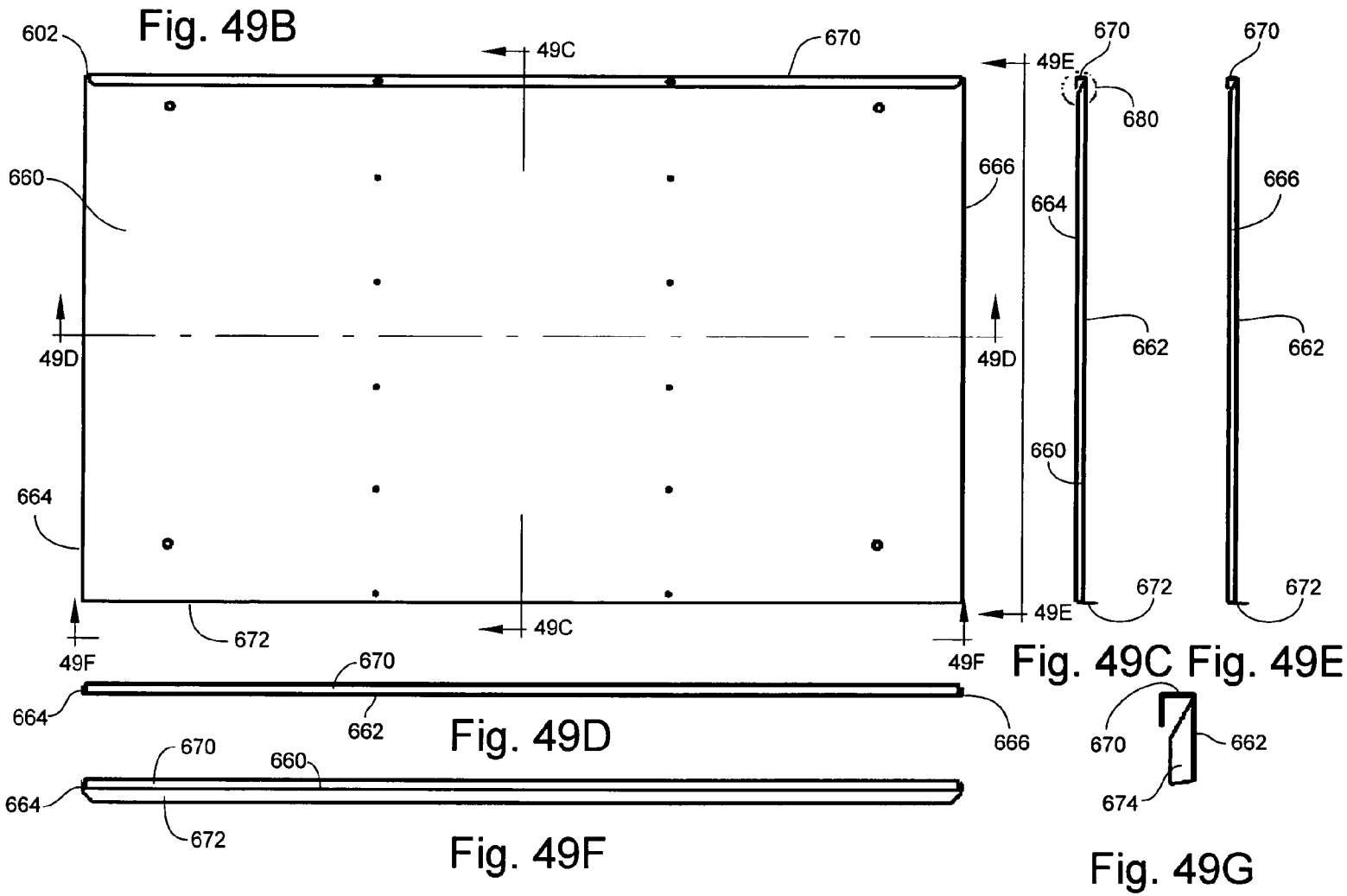
FIG. 49B is a side elevational view of the back panel depicted in FIG. 48.
FIG. 49C is a cross-sectional view taken along line 49C-49C of FIG. 49B.
FIG. 49D is a cross-sectional view taken along line 49D-49D of FIG. 49B.
FIG. 49E is an end view taken along line 49E-49E of FIG. 49B.
FIG. 49F is a view taken along line 49F-49F of FIG. 49B.
FIG. 49G is an enlarged view of a portion of the view of FIG. 49C.
Figure 50:
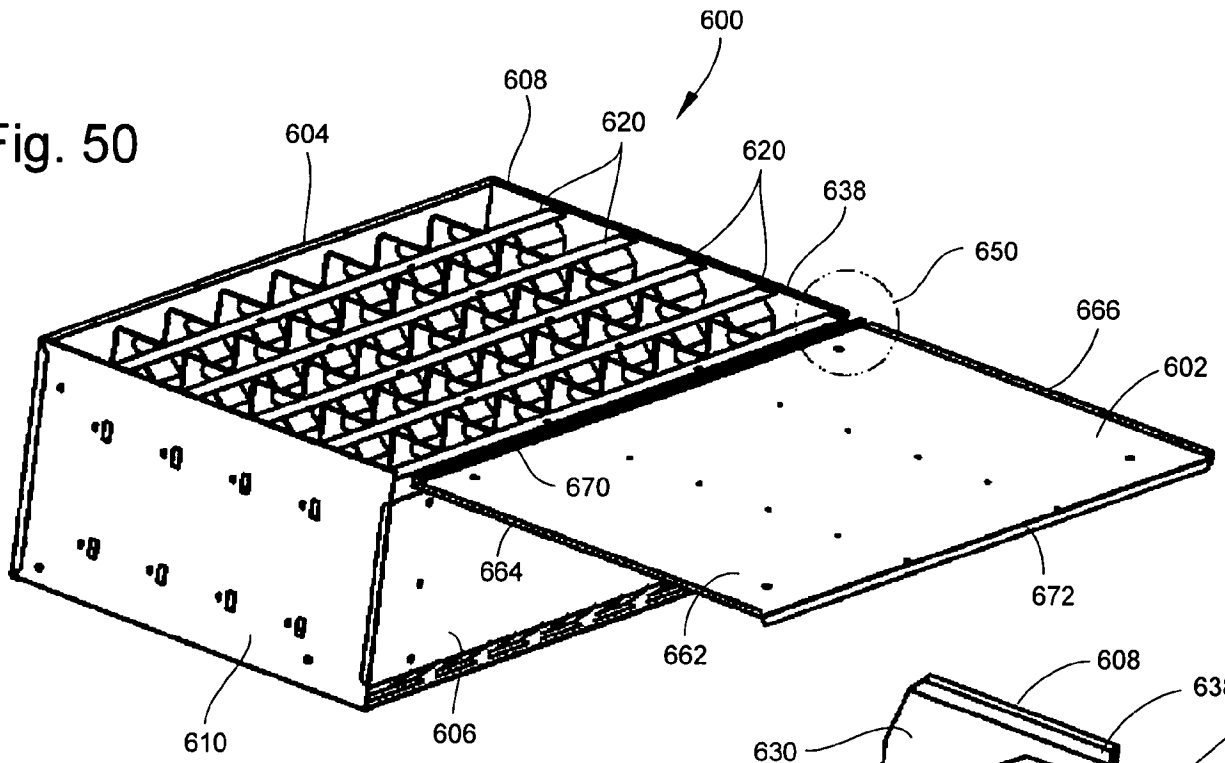
FIG. 50 is an exploded view of the storage unit of FIG. 48 illustrating the manner in which the back panel is removably attached to the side panels.
Figure 51:
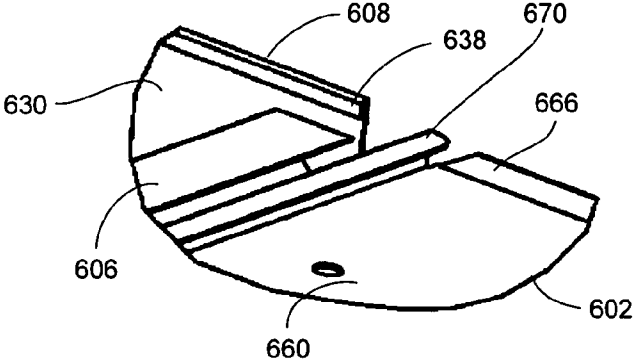
FIG. 51 is an enlarged view of a portion of the view of FIG. 50.
Figure 51A:
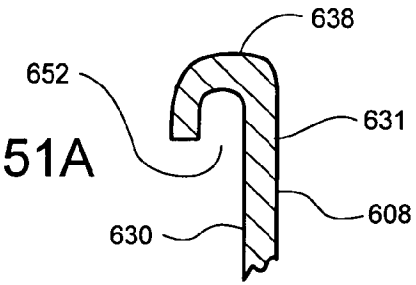
FIG. 51A is a partial, cross-sectional view of a lengthwise end of the side panel shown in FIG. 49A.
Figure 52:
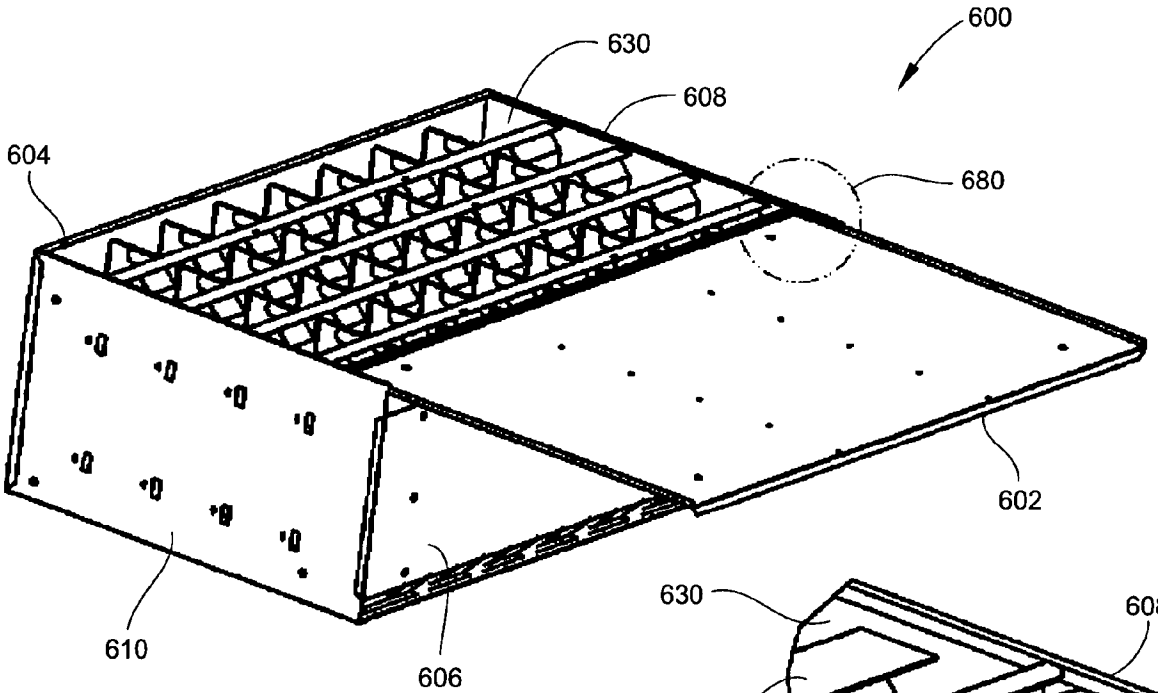
FIG. 52 is a perspective view of the storage unit of FIG. 48 showing the back panel partially attached to the side panels.
Figure 53:
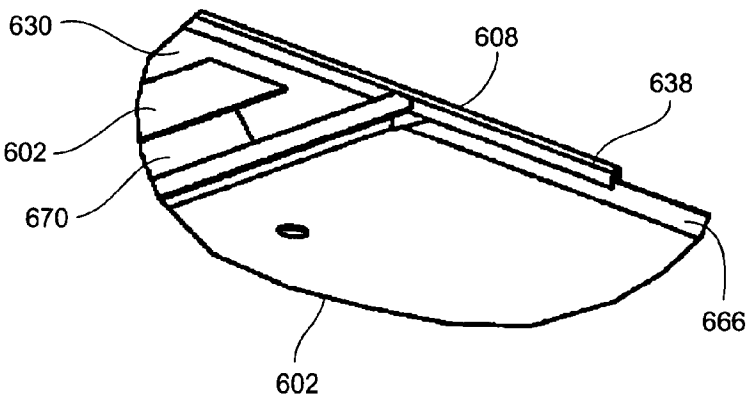
FIG. 53 is an enlarged view of a portion of the view of FIG. 52.
Figures 54, 55:
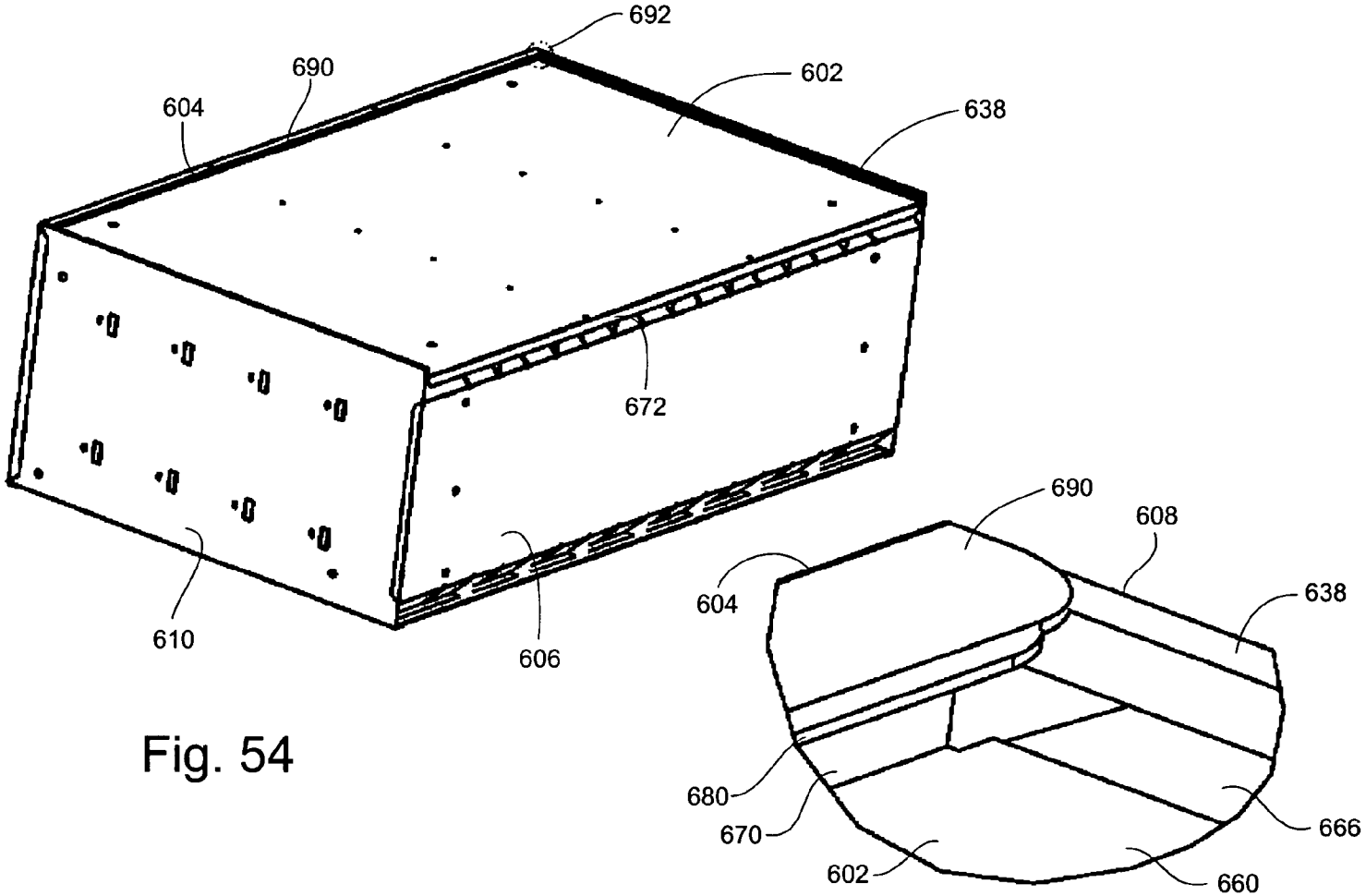
FIG. 54 is a perspective view of the storage unit of FIG. 48 showing the back panel completely attached to the side panels.
FIG. 55 is an enlarged view of a portion of the view of FIG. 54.

Referring to FIGS. 48 and 48A, there is shown an exploded view of alternate storage unit 600 in accordance with another embodiment of the invention. Storage unit 600 generally comprises back panel 602, top panel 604, bottom panel 606, and a pair of opposing side panels 608 and 610. When these components are attached together, they define a housing structure having an interior similar to interior 24 of storage unit 10 which was described in the foregoing description. Storage unit 600 further includes shelf members 620 and divider members 622. Shelf members 620 and divider members 622 have the same purpose and substantially the same structure as shelf members 26 and divider members 28, respectively, of storage unit 10 which was described in the foregoing description. Storage unit 600 includes rail member 623 which has the same function and substantially the same structure as rail member 36 which is shown in FIG. 2 and described in the foregoing description. In accordance with this embodiment of the invention, top panel 604, bottom panel 606 and shelf members 620 are not attached to back panel 602. Therefore, back panel 602 does not have protruding members (such as protruding members 64) for supporting shelf members 620. Thus, top panel 604, bottom panel 606 and shelf members 620 are attached to opposing side panels 608 and 610. In accordance with this embodiment of the invention, back panel 602 is removably attached to opposing side panels 608 and 610. This feature is described in the ensuing description. Referring to FIGS. 49A, 50, 51 and 51A, there is shown opposing side panel 608. Opposing side panel 608 has inner side 630 and an outer or exterior side 631 (see FIG. 51A), widthwise end portions 632 and 634 (see FIG. 49A), and flanged lengthwise end portions 636 and 638. Side panel 608 includes protruding members 640 on inner side 630 that are used to support shelf members 620. FIG. 51 is an enlarged view of the portion of the view in FIG. 50 indicated by reference numeral 650. As shown in FIGS. 51, and 51A, flanged lengthwise end portion 638 of side panel 608 is configured to provide channel 652 that extends for substantially the entire length of flanged lengthwise end portion 638. It is to be understood that opposing side panel 610 has substantially the same structure as side panel 608. Prior to discussing the purpose of the function of channel 652 (and the corresponding channel of opposing side panel 610), it would be beneficial to first discuss the particular structure of back panel 602. Referring to FIGS. 49B-49G, back panel 602 comprises interior side 660, which confronts the interior of storage unit 600, and opposite, external side 662. Back panel 602 further comprises flanged widthwise end portions 664 and 666, and flanged lengthwise end portions 670 and 672. FIG. 49G is an enlarged view of the portion of the view in FIG. 49C which is indicated by a dotted circle and reference numeral 680. Each flanged widthwise end portion 664 and 666 is sized to fit in a corresponding channel in the lengthwise end of a corresponding side panel. For example, flanged widthwise end portion 666 is sized to fit into and slide through channel 652 (see FIG. 51A). Similarly, flanged portion 664 is sized to fit into and slide through the corresponding channel (not shown) in the lengthwise end of side panel 610. FIGS. 50-55 illustrate how back panel 602 is slidably attached to side panels 608 and 610. FIG. 53 is an enlarged view of the portion of the view of FIG. 52 indicated by reference numeral 680. Thus, in order to removably attach back panel 602 to side panels 608 and 610, the user first maneuvers back panel 602 so that flanged widthwise end portion 666 is aligned with channel 652 and flanged widthwise end portion 664 is aligned with the channel (not shown) in the corresponding lengthwise end portion (not shown) of side panel 610. Next, the user moves back panel 602 so that the flanged widthwise end portions (e.g. portions 664 and 666) enter and slide through the respective channels in the opposing side panels 608 and 610. Referring to FIGS. 54 and 55, when back panel 602 is completely attached to side panels 608 and 610, flanged lengthwise end portion 670 is positioned under flanged lengthwise end portion 690 of top panel 604 and flanged lengthwise end portion 672 abuts the lengthwise end portion of bottom panel 606. FIG. 55 is an enlarged view of the portion of the view of FIG. 54 indicated by the dotted circle and reference numeral 692. The removable back panel feature of storage unit 600 allows the user to insert divider members 622 from the rear of storage unit 600.

Figure 56:
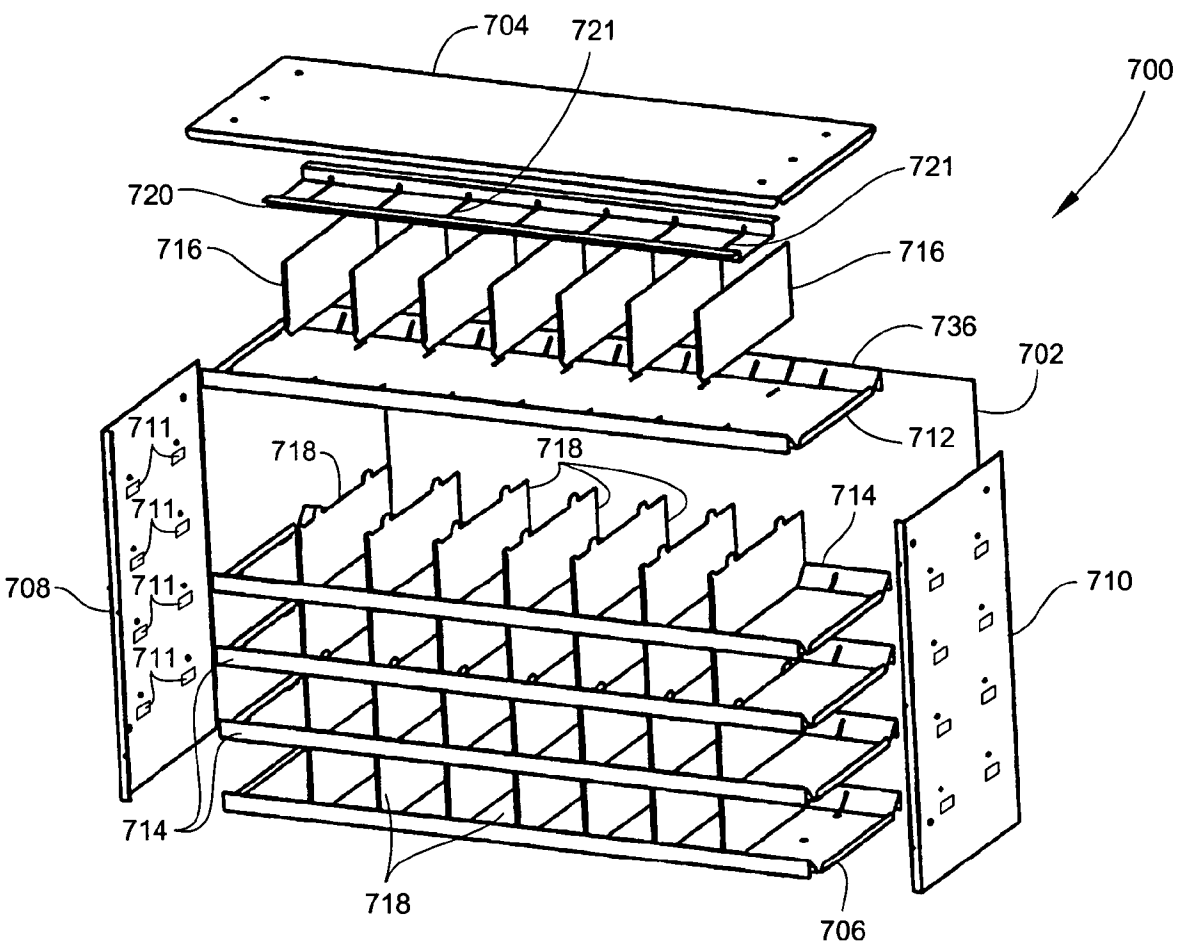
FIG. 56 is an exploded view, in perspective, of a storage unit in accordance with a further embodiment of the present invention.
Figure 57:
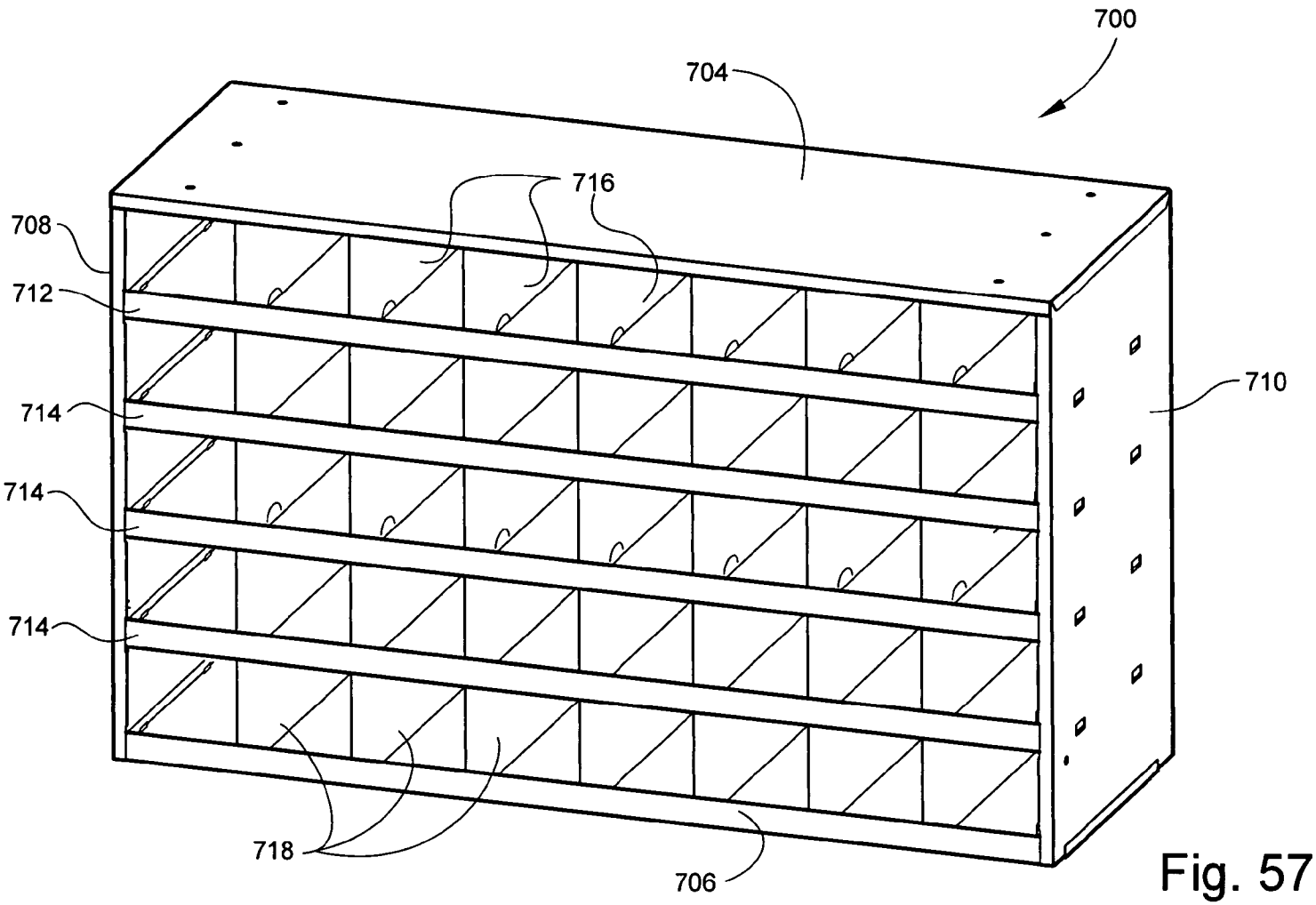
FIG. 57 is a perspective view of the storage unit of FIG. 56 completely assembled.
Figure 58:
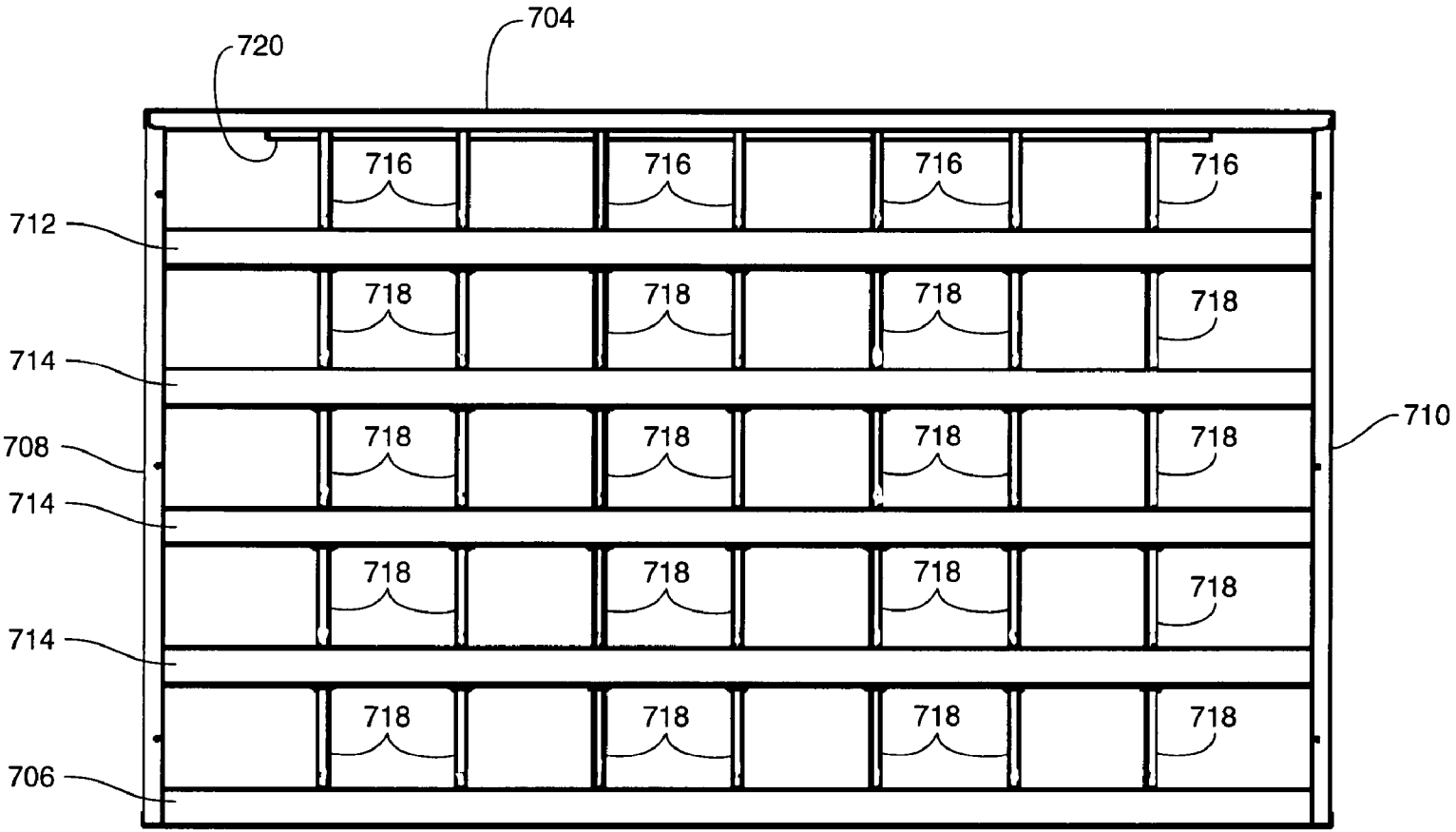
FIG. 58 is a front elevational view of the storage unit shown in FIG. 57.

Referring to FIGS. 56-58, there is shown an exploded view of storage unit 700 in accordance with a further embodiment of the invention. Storage unit 700 generally comprises back panel 702, top panel 704, bottom most shelf member 706, and a pair of opposing side panels 708 and 710. When these components are attached together, they define a housing structure having an interior similar to interior 24 of storage unit 10 which was described in the foregoing description. Side panels 708 and 710 have protruding members 711 which have the same purpose and function and substantially the same configuration as protruding members 64 (see FIG. 15) and protruding members 640 (see FIG. 49A). Storage unit 700 further includes uppermost shelf member 712, intermediate shelf members 714, top divider members 716 and lower divider members 718. Storage unit 700 further includes rail member 720 that is attached to the bottom side of top panel 704. Rail member 720 includes slots 721 that are spaced apart. Rail member 720 has generally the same structure as rail member 623 shown in FIG. 48 and described in the foregoing description. In accordance with this embodiment of the invention, top panel 704, bottommost shelf member 706, and shelf members 712 and 714 are not attached to back panel 702, and back panel 702 is slidably attached to side panels 708 and 710. In a preferred embodiment, back panel 702 and side panels 708, 710 have generally the same construction as back panel 602 and side panels 608, 610, respectively, which were described in the foregoing description.

Figures 59, 60, 61, 62, 63, 63A:
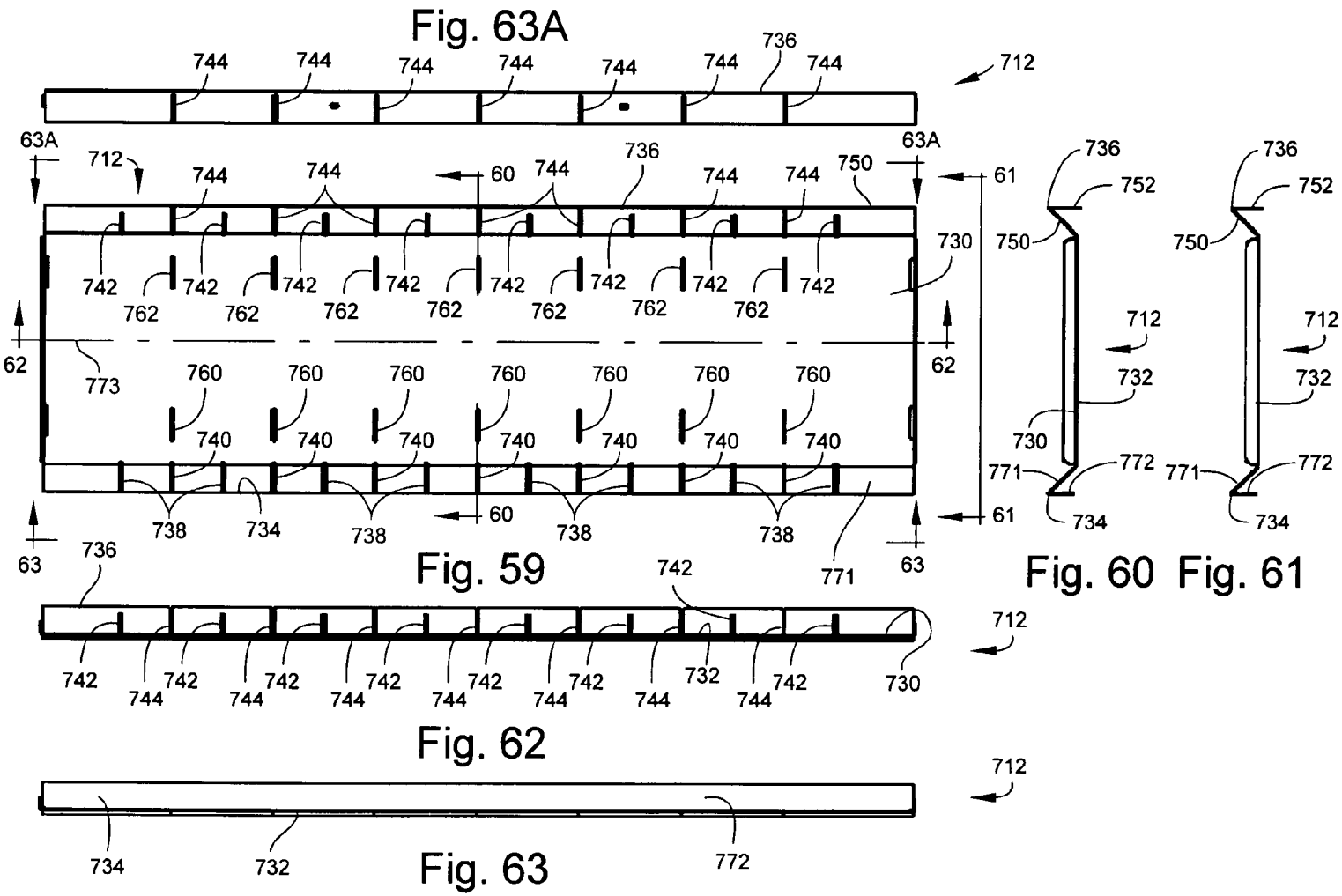
FIG. 59 is a plan view of an uppermost shelf member shown in FIGS. 56-58.
FIG. 60 is a cross-sectional view taken along line 60-60 in FIG. 59.
FIG. 61 is an end view taken along line 61-61 in FIG. 59.
FIG. 62 is a cross-sectional view taken along line 62-62 in FIG. 59.
FIG. 63 is a front end view taken along line 63-63 in FIG. 59.
FIG. 63A is a rear end view taken along 63A-63A in FIG. 59.

Referring to FIGS. 59-63A, there is shown upper most shelf member 712. Upper most shelf member 712 generally comprises top side 730, bottom side 732, and pair of opposing lengthwise end portions 734 and 736. Lengthwise end portions 734 and 736 have generally the same triangular shape as lengthwise end portions 74 and 76, respectively, of shelf member 26 described in the foregoing description. Lengthwise end portion 734 has a first plurality of slots 738 formed therein and a second plurality of slots 740 formed therein. Slots 738 and 740 are arranged in an alternating fashion, i.e. each slot 740 is located between a pair of slots 738. Similarly, lengthwise end portion 736 has a first plurality of slots 742 formed therein and a second plurality of slots 744 formed therein. Slots 742 and 744 are arranged in an alternating fashion, i.e. each slot 744 is located between a pair of slots 742. As shown in FIGS. 60 and 61, lengthwise end portion 736 has first portion 750 angulated with respect to top side 730, and second portion 752 that is angulated with respect to first portion 750 and generally perpendicular to top and bottom sides 730 and 732, respectively. Each slot 742 extends only through portion 750. Each slot 744 extends through both portions 750 and 752. The purpose of this configuration is discussed in the ensuing description. Top shelf member 712 further includes a first plurality of slots 760 and a second plurality of slots 762. In a preferred embodiment, slots 760 are equidistantly spaced and slots 762 are equidistantly spaced. Lengthwise end portion 734 comprises first portion 771 which is angulated with respect to top side 730 and a second portion 772 that is angulated with respect to first portion 771 and generally perpendicular to top and bottom sides 730 and 732, respectively. Slots 738 and 740 extend only through portion 771. All slots 738, 740, 742 and 744 are generally perpendicular to longitudinally extending axis 773. Each slot 760 is substantially aligned with a corresponding slot 762. Each slot 760 is also substantially aligned with a corresponding slot 740 and a corresponding slot 744. As will be explained in the ensuing description, each upper divider member 716 is removably positioned within a slot 740 and a corresponding slot 744. The other structural features of top shelf member 712 are explained in detail in the ensuing description.

Figures 64, 65, 66, 67, 68, 69:
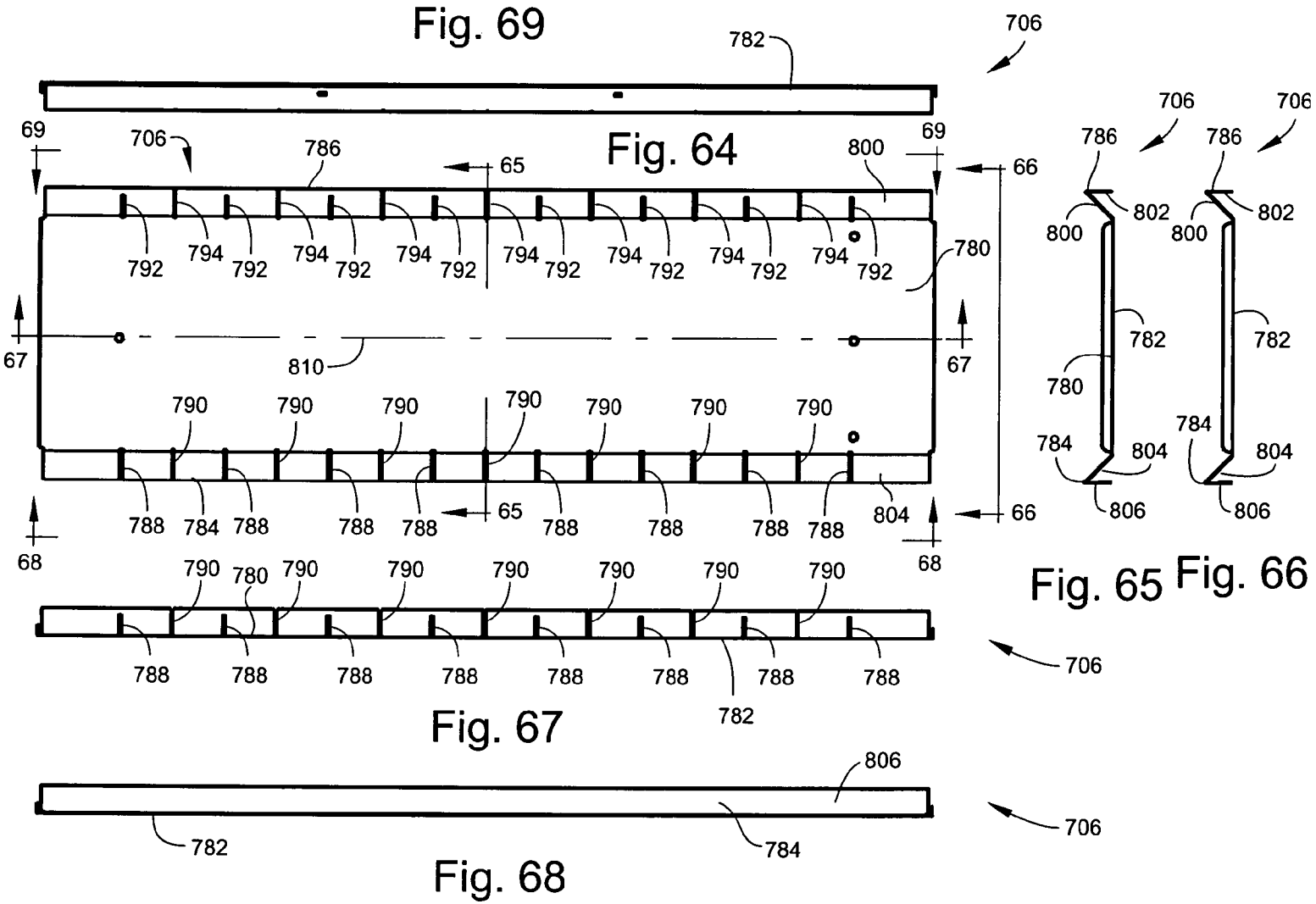
FIG. 64 is a plan view of a bottom most shelf member shown in FIGS. 56-58.
FIG. 65 is a cross-sectional view taken along line 65-65 in FIG. 64.
FIG. 66 is an end view taken along line 66-66 in FIG. 64.
FIG. 67 is a cross-sectional view taken along line 67-67 in FIG. 64.
FIG. 68 is a front end view taken along line 68-68 in FIG. 64.
FIG. 69 is a rear end view taken along 69-69 in FIG. 64.

Referring to FIGS. 64-69, there is shown bottom most shelf member 706. Bottom most shelf member 706 generally comprises top side 780, bottom side 782, and pair of opposing lengthwise end portions 784 and 786. Each of lengthwise end portions 784 and 786 has generally the same triangular shape as lengthwise end portions 74 and 76, respectively, of shelf member 26 described in the foregoing description. Lengthwise end portion 784 has a first plurality of slots 788 formed therein and a second plurality of slots 790 formed therein. Slots 788 and 790 are arranged in an alternating fashion, i.e. each slot 790 is located between a pair of slots 788. Similarly, lengthwise end portion 786 has a first plurality of slots 792 formed therein and a second plurality of slots 794 formed therein. Slots 792 and 794 are arranged in an alternating fashion, i.e. each slot 794 is located between a pair of slots 792. As shown in FIGS. 65 and 66, lengthwise end portion 786 has first portion 800 angulated with respect to top side 780, and second portion 802 that is angulated with respect to first portion 800 and generally perpendicular to top and bottom sides 780 and 782, respectively. Slots 792 and 794 extend only through portion 800. Similarly, lengthwise end portion 784 has first portion 804 that is angulated with respect to top side 780, and second portion 806 that is angulated with respect to first portion 804 and generally perpendicular to top and bottom sides 780 and 782, respectively. Slots 788 and 790 extend only through portion 804. All slots 788, 790, 792 and 794 are substantially parallel to longitudinally extending axis 810. Each slot 788 is substantially aligned with a corresponding slot 792. Each slot 790 is substantially aligned with a corresponding slot 794.

Figures 70, 71, 72, 73, 74, 75:
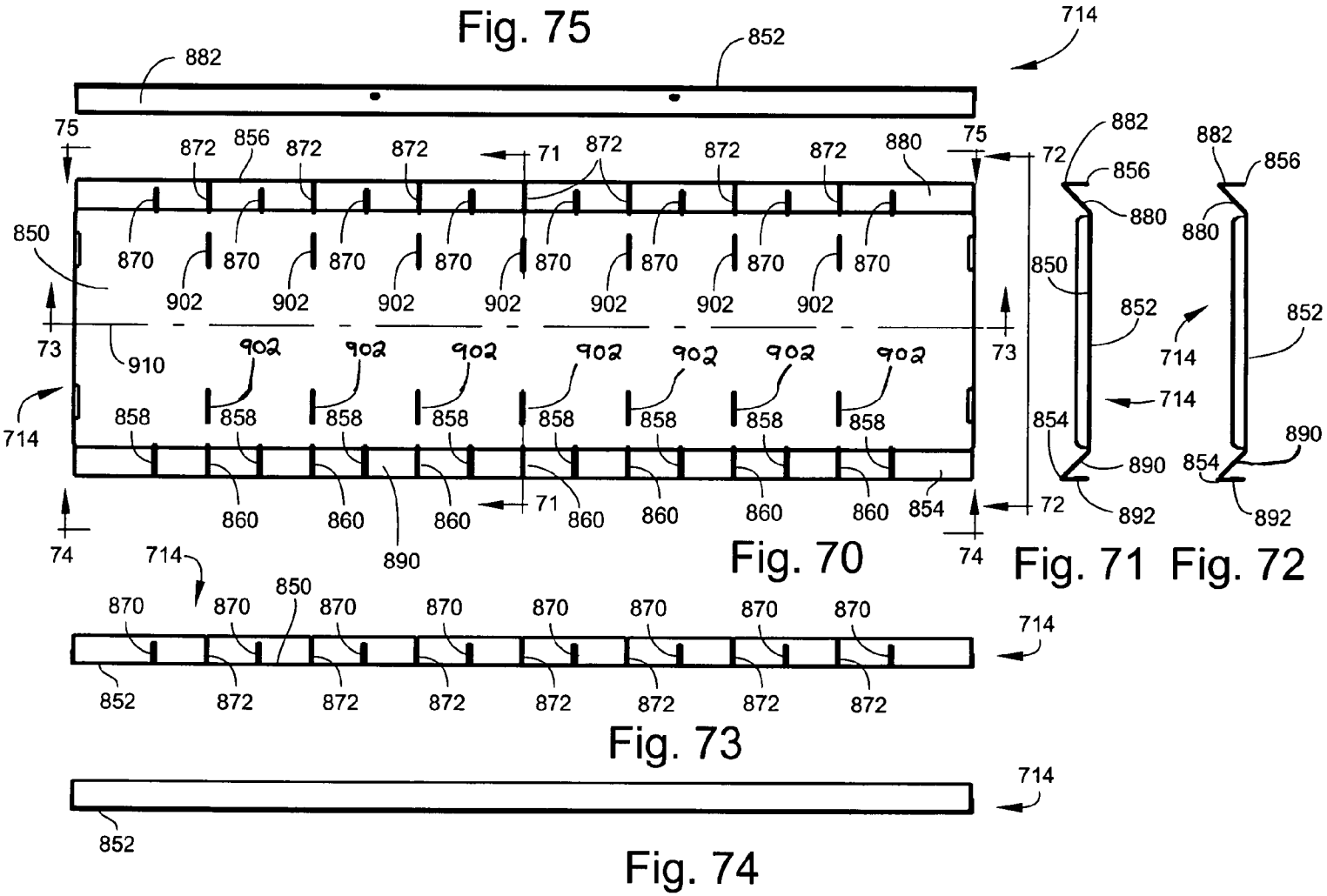
FIG. 70 is a plan view of one of the intermediate shelf members shown in FIGS. 56-58.
FIG. 71 is a cross-sectional view taken along line 71-71 in FIG. 70.
FIG. 72 is an end view taken along line 72-72 in FIG. 70.
FIG. 73 is a cross-sectional view taken along line 73-73 in FIG. 70.
FIG. 74 is a front end view taken along line 74-74 in FIG. 70.
FIG. 75 is a rear end view taken along 75-75 in FIG. 70.

Referring to FIGS. 70-75, there is shown one of the intermediate shelf members 714. Intermediate shelf member 714 generally comprises top side 850, bottom side 852, and pair of opposing lengthwise end portions 854 and 856. Each lengthwise end portion 854 and 856 has generally the same triangular shape as lengthwise end portions 74 and 76, respectively, of shelf member 26 described in the foregoing description. Lengthwise end portion 854 has a first plurality of slots 858 formed therein and a second plurality of slots 860 formed therein. Slots 858 to and 860 are arranged in an alternating fashion, i.e. each slot 860 is located between a pair of slots 858. Similarly, lengthwise end portion 856 has a first plurality of slots 870 formed therein and a second plurality of slots 872 formed therein. Slots 870 and 872 are arranged in an alternating fashion, i.e. each slot 872 is located between a pair of slots 870. As shown in FIGS. 71 and 72, lengthwise end portion 856 has first portion 880 angulated with respect to top side 850, and second portion 882 that is angulated with respect to first portion 880 and generally perpendicular to top and bottom sides 850 and 852, respectively. Slots 870 and 872 extend through only through portion 880. Lengthwise end portion 854 comprises first portion 890 which is angulated with respect to top side 850 and a second portion 892 that is angulated with respect to first portion 890 and generally perpendicular to top and bottom sides 850 and 852, respectively. Slots 858 and 860 extend only through portion 890. Intermediate shelf member 714 further includes a plurality of slots 902. All slots 858, 860, 870, 872, and 902 are generally perpendicular to longitudinally extending axis 910. Each slot 858 is substantially aligned with a corresponding slot 870. Each slot 902 is substantially aligned with a corresponding slot 860 and a corresponding slot 872.

Figure 76:
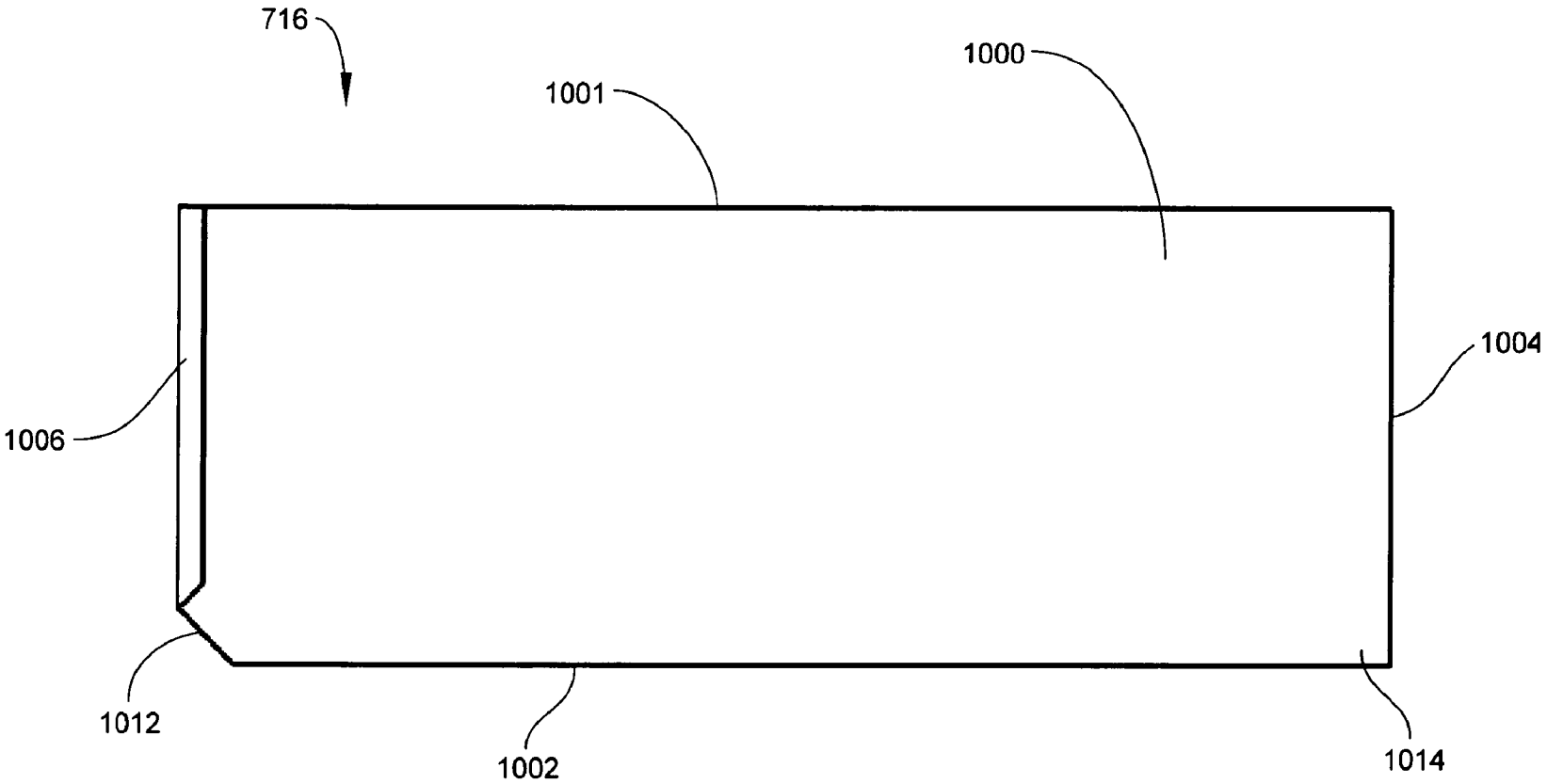
FIG. 76 is a side elevational view of an upper divider member shown in FIGS. 56-58.
Figure 80:
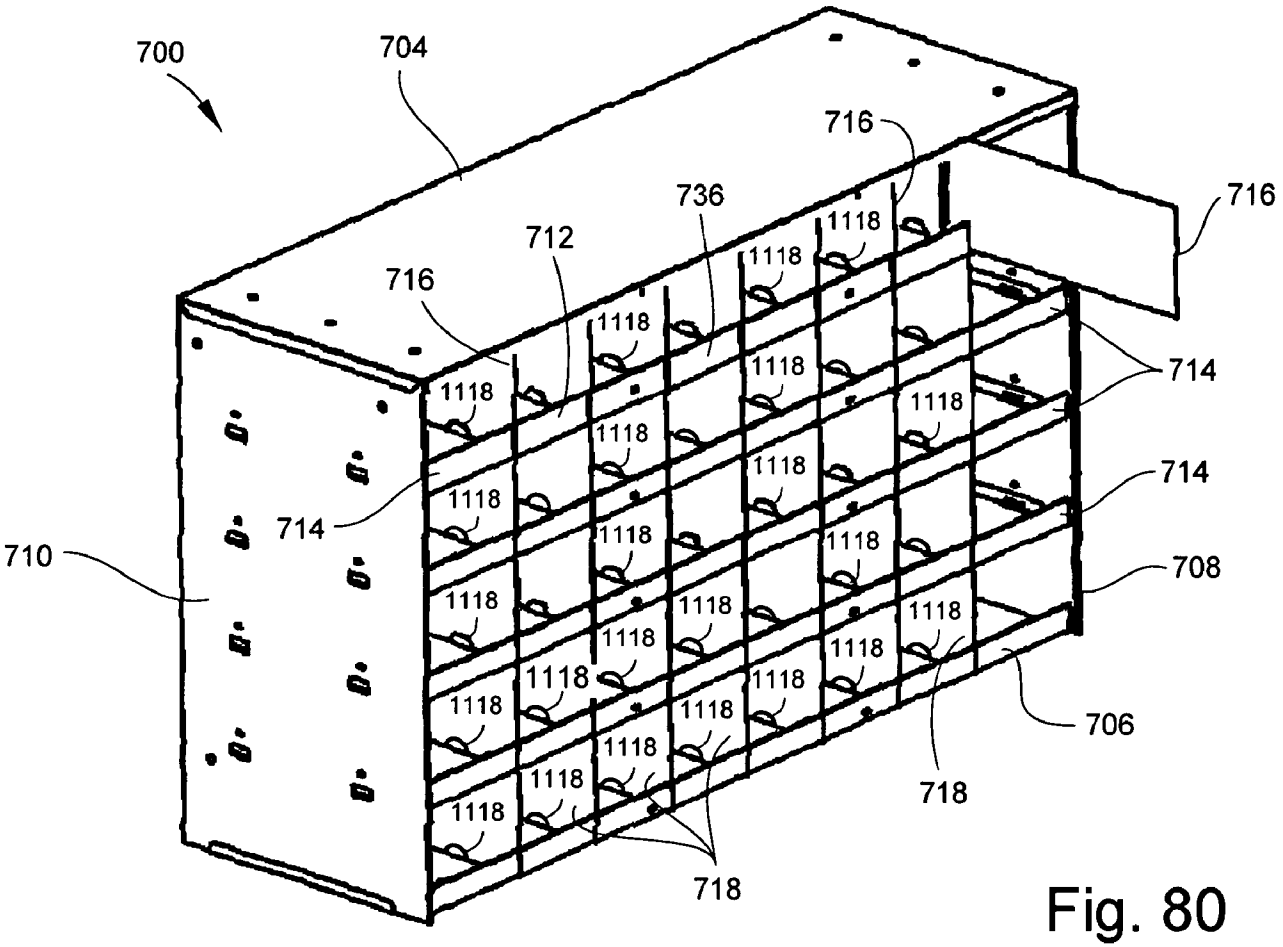
FIG. 80 is a perspective view of the rear side of the storage unit of FIGS. 57 and 58, the back panel not being shown so as to facilitate viewing of how the upper divider members are inserted into the storage unit.

Referring to FIG. 76, there is shown upper divider member 716. Upper divider member 716 comprises a generally planar portion 1000, lengthwise end 1001, lengthwise end 1002, rear widthwise end 1004 and front widthwise end 1006. In a preferred embodiment, front widthwise end 1006 is flanged. Upper divider member 716 includes lower, front portion 1012 that is adjacent to flanged front end 1006 and lower lengthwise end 1002. Upper divider member 716 further includes a rear lower portion indicated by reference numeral 1014. Referring to FIGS. 56, 59 and 80, upper divider members 716 are removably mounted to uppermost shelf member 712. Specifically, portion 1012 is disposed within a slot 740, portion 1014 is disposed within a corresponding slot 744, and lengthwise end 1001 is partially disposed within a corresponding slot 721 within rail member 720. Each slot 721 in rail member 720 is aligned with a corresponding pair of slots 740 and 744. As shown in FIG. 80, a user can insert an upper divider member 716 from the rear of storage unit 700 when the back panel 702 is removed. Rail member 720 functions as a guide and allows each upper divider member 716 to move in a relatively straight line as the user is pushing divider member 716 so that portion 1012 will enter a corresponding slot 740.

Figure 77:
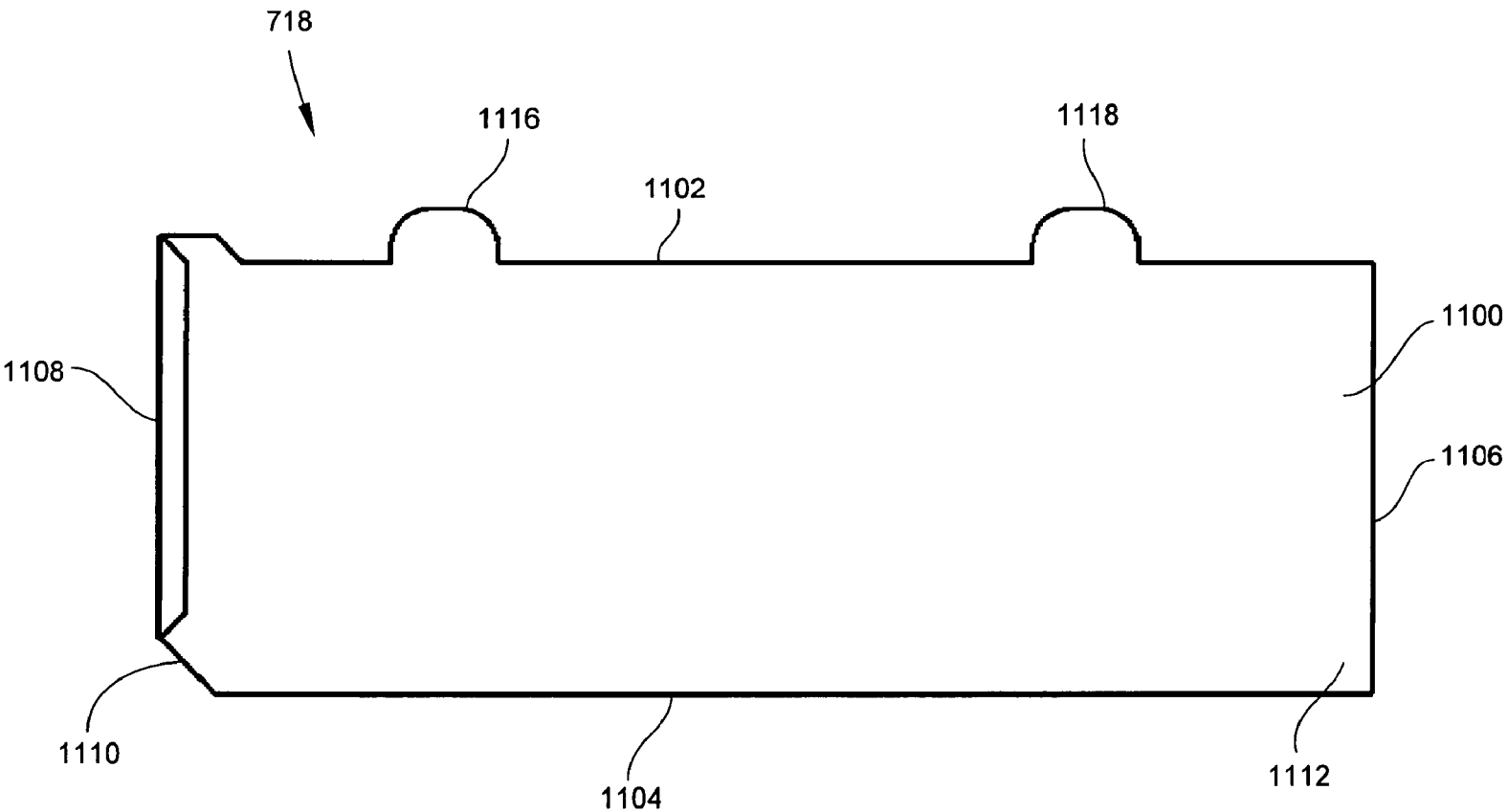
FIG. 77 is a side elevational view of a lower divider member shown in FIGS. 56-58.
Figure 78:
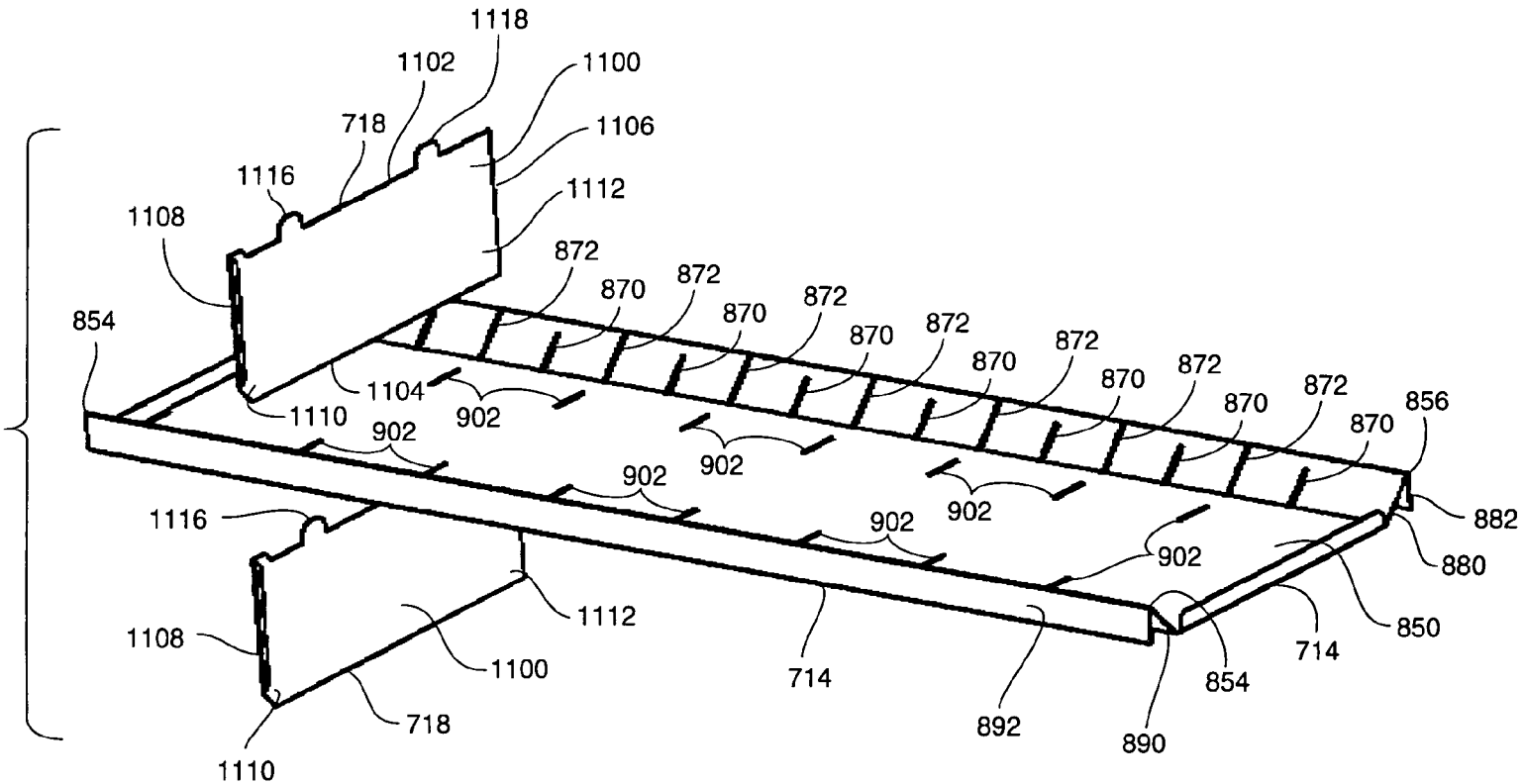
FIG. 78 is an exploded view, in perspective, illustrating the manner in which the lower divider member is removably mounted to a shelf member.
Figure 79:
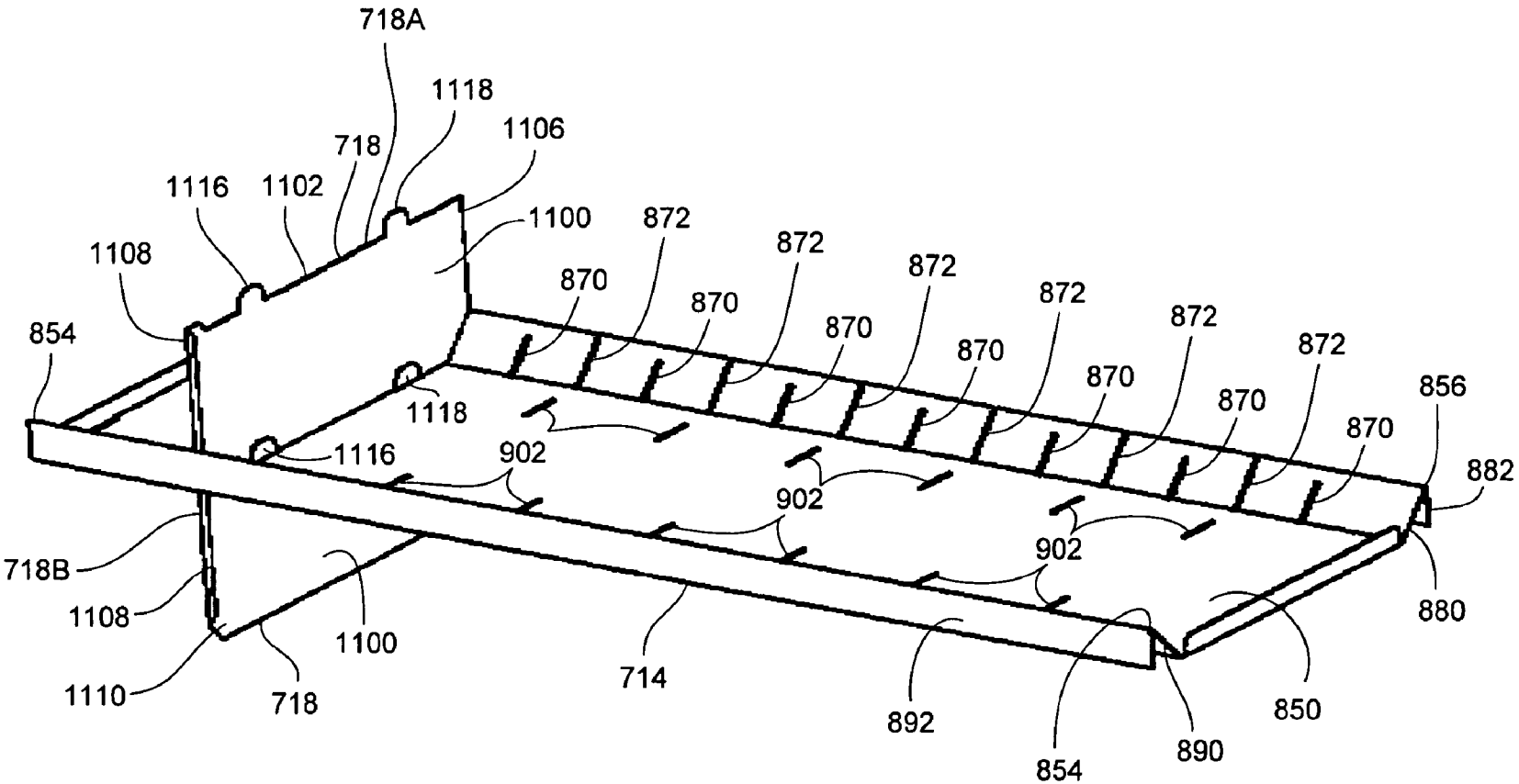
FIG. 79 is a perspective view showing the lower divider member mounted to the shelf member.

Referring to FIG. 77, there is shown a lower divider member 718. Each lower divider member 718 generally comprises generally planar portion 1100, lengthwise end 1102, lengthwise end 1104, rear widthwise end 1106 and front widthwise end 1108. In a preferred embodiment, front widthwise end 1108 is flanged and configured to have the same shape as front end 1006 of upper divider member 716 described in the foregoing description. Lower divider member 718 includes a lower, front portion 1110 and a rear, lower portion 1112. Lower divider member 718 further includes extending portions 1116 and 1118 that extend from lengthwise end 1102. Referring to FIGS. 56, 78 and 79, lower divider members 718 are configured to be removably mounted to intermediate shelf members 714 and lowermost shelf member 706. As shown in FIGS. 78 and 79, portion 1112 is removably disposed into a corresponding slot 872, portion 1110 of lower divider member 718 is removably disposed into a corresponding slot 860, and bottom lengthwise end 1104 is substantially flush with top surface 850 of shelf member 714. The extending portions 1116 and 1118 of each divider member 718 are removably inserted into corresponding slots 902 in the shelf member that is above that particular divider member 718. This is illustrated in FIG. 79. The divider member 718 that is removably mounted on shelf member 714 is indicated by reference numeral 718A and the divider member 718 below the shelf member 714 is indicated by reference numeral 718B. Extending portions 1116 and 1118 of divider member 718B protrude through slots 902 of shelf member 714 and frictionally contact planar surface 1100 of the divider member 718A.

Figure 81:
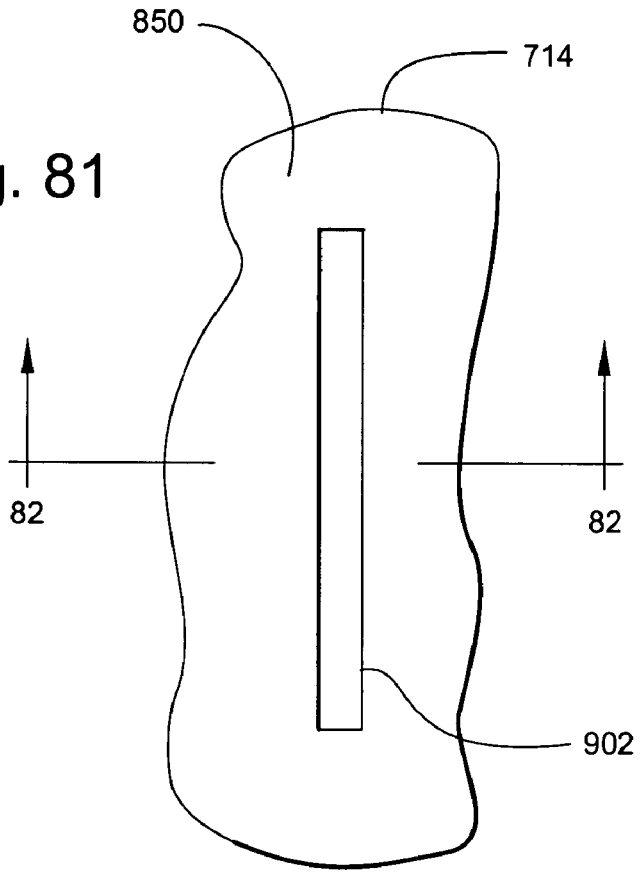
FIG. 81 a plan view of a portion of a shelf member of FIG. 70 illustrating a slot formed in the shelf member.
Figure 82:
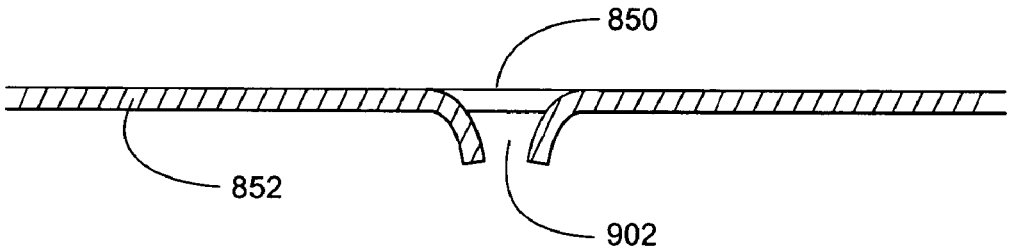
FIG. 82 is a cross-sectional view taken along line 82-82 in FIG. 81.

In one embodiment, slots 760 and 762 in shelf member 712 and slots 902 in shelf member 714 are rectangular shaped. This is illustrated in FIGS. 81 and 82. Although FIGS. 81 and 82 show only slot 902, it is to be understood that slots 760 and 762 have the same shape and configuration as slot 902.

In a preferred embodiment, storage unit 700 and all components thereof are fabricated from metal. However, it is to be understood that other suitable materials can be used as well.

The present invention provides many advantages and benefits including:

a) divider members 28 can be mounted on bottom panel 14 and shelf members 26 in various locations so as to form openings or compartments 30 of varying sizes;

b) base members 110 are easily mounted to bottom panel 14 and shelf members 26, and top members 112 are easily mounted to base members 110;

c) the height adjustment feature of each divider member 28 allows for a snug fit of the divider member 28 between shelf members 26, between uppermost shelf member 26*a* and top panel 14 and between lowermost shelf member 26*b* and bottom panel 16;

d) the height adjustment feature of each divider member 28 compensates for non-uniform height between shelf members 26, between uppermost shelf member 26*a* and top panel 14 and between lowermost shelf member 26*b* and bottom panel 16; and e) shelf members 26 and bottom panel 16 have a unique configuration that allows divider members 28 to be positioned in desired locations so as to provide drawer receiving spaces with desired sizes.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A storage unit assembly comprising:

first and second opposed side walls;

a top member, wherein said first and second opposed sidewalls are attached to the top member;

a bottom member, wherein said first and second opposed sidewalls are attached to the bottom member;

at least one shelf interposed between said first and second opposed side walls and between said top member and bottom member, said shelf comprising a first substantially planar portion upon which parts, components or hardware may be stored;

said shelf further comprising a second portion including a first substantially planar wall that extends at an obtuse angle from said first substantially planar portion, wherein said first substantially planar wall has at least one opening formed therethough, said opening being sized to receive a portion of a divider member; and said second portion including a second substantially planar wall extending at an acute angle from said first substantially planar wall of said second portion, said second substantially planar wall being generally perpendicular to said first substantially planar portion, said second substantially planar wall extending to a distal end that is spaced apart from said first substantially planar wall and said first substantially planar portion so as to form an open space that is bounded only by said first substantially planar wall and said second substantially planar wall, wherein when a portion of a divider member is inserted into said at least one opening in said first substantially planar wall, said portion of said divider member extends into said open space.

2. The storage unit assembly according to claim 1 wherein said at least one shelf has a front portion and a rear portion, wherein said second portion is part of said front portion, said shelf further comprising a third portion that is part of said rear portion, said third portion including a third substantially planar wall that extends at an obtuse angle from said first substantially planar portion, wherein said third substantially planar wall has at least one opening that is formed therethrough and substantially aligned with said opening in said first substantially planar wall of said second portion, said third portion further comprising a fourth substantially planar wall extending at an acute angle from said third substantially planar wall and being generally perpendicular to said first substantially planar portion.

3. The storage unit assembly according to claim 2 further comprising a divider having a first portion inserted into said opening of said first substantially planar wall and a second portion inserted into said opening of said third substantially planar wall.

4. The storage unit assembly according to claim 2 wherein said shelf further comprises a pair of opposed side portions extending from said first substantially planar portion, each of said pair of opposed side portions being adjacent a corresponding one of said first and second opposed side walls of said storage unit, said pair of opposed side portions being generally perpendicular to said first substantially planar portion.

5. The storage unit assembly according to claim 4 wherein said first substantially planar portion has openings formed therethrough, wherein one of said openings is proximate to one of said pair of opposed side portions and another of said openings is proximate to the other of said pair of opposed side portions.

6. The storage unit assembly according to claim 5 wherein each one of said opposed first and second side walls includes at least one protruding member received in a corresponding opening in said first substantially planar portion.

7. A shelf for a storage unit, comprising:

a substantially planar portion;

a ramped front portion contiguous with said substantially planar portion, wherein said ramped front portion includes a first substantially planar wall that extends at an obtuse angle from said first substantially planar portion and a second substantially planar wall that extends at an acute angle from said first substantially planar wall, wherein said first substantially planar wall has a plurality of slots formed therethrough, wherein each of said slots is sized to receive a portion of a divider member, said second substantially planar wall extending to a distal end that is spaced apart from said first substantially planar wall and said first substantially planar portion so as to form an open space that is bounded only by said first substantially planar wall and said second substantially planar wall, wherein when a divider member is inserted into one of said slots, a portion of said divider member extends into said open space; and a pair of opposed side portions extending from said first substantially planar portion, said pair of opposed side portions being generally perpendicular to said first substantially planar portion.

* * * * *